US011561074B2

(12) United States Patent
Spanner et al.

(10) Patent No.: US 11,561,074 B2
(45) Date of Patent: Jan. 24, 2023

(54) INTERMEDIATE FOR MANUFACTURING PROJECTILES OF A DEFORMABLE BULLET, PROJECTILE, DEFORMED PROJECTILE, TOOL FOR MANUFACTURING THE INTERMEDIATE AND METHOD FOR MANUFACTURING THE INTERMEDIATE

(71) Applicant: RUAG Ammotec GmbH, Fuerth (DE)

(72) Inventors: Florian Spanner, Nuremberg (DE); Marcus Stier, Neunburg vorm Wald (DE); Michael Koerber, Fuerth (DE)

(73) Assignee: RUAG AMMOTEC GMBH, Fuerth (DE)

( * ) Notice: Subject to any disclaimer, the term of this patent is extended or adjusted under 35 U.S.C. 154(b) by 45 days.

(21) Appl. No.: 16/770,852

(22) PCT Filed: Dec. 10, 2018

(86) PCT No.: PCT/EP2018/084238
§ 371 (c)(1),
(2) Date: Jun. 8, 2020

(87) PCT Pub. No.: WO2019/110850
PCT Pub. Date: Jun. 13, 2019

(65) Prior Publication Data

US 2020/0370872 A1 Nov. 26, 2020

(30) Foreign Application Priority Data

Dec. 8, 2017 (DE) ..... 10 2017 011 359.9

(51) Int. Cl.
*F42B 12/34* (2006.01)
*B21K 1/02* (2006.01)
*F42B 10/42* (2006.01)

(52) U.S. Cl.
CPC ..... *F42B 12/34* (2013.01); *B21K 1/025* (2013.01); *F42B 10/42* (2013.01)

(58) Field of Classification Search
CPC ..... F41B 12/34; F41B 10/42; F41B 33/00; F41B 33/007; B21K 1/025
See application file for complete search history.

(56) References Cited

U.S. PATENT DOCUMENTS 219,840 A * 9/1879 Winchester ..... F42B 12/74 86/54
1,101,743 A * 6/1914 Hoagland ..... F42B 12/34 102/508

(Continued)

FOREIGN PATENT DOCUMENTS

AT 405977 B 1/2000
DE 2909471 A1 9/1980

(Continued)

OTHER PUBLICATIONS

International Search Report for PCT/EP2018/084238, dated Apr. 2, 2019, and English Translation submitted herewith (5 pgs.).

(Continued)

*Primary Examiner* — Joshua E Freeman
(74) *Attorney, Agent, or Firm* — Fitch, Even, Tabin & Flannery, LLP

(57) ABSTRACT

Intermediate for the production of a projectile in particular a deformable bullet, consisting of a ductile blank, which is cold-formed into the intermediate by means of pressing, a cylindrical solid base end section and a press end section with a central press recess incorporated by means of pressing and a wall limiting the press recess to form an ogival shaped tip, wherein the wall is formed with at least two slots extending in the axial direction of the intermediate, which separate at least two prongs in the circumferential direction of the intermediate, wherein the at least two slots extend by (Continued)

more than 10% of an axial total longitudinal extension of the intermediate from the wall end towards the base end section.

14 Claims, 41 Drawing Sheets

(56) References Cited

U.S. PATENT DOCUMENTS

| | | | | |
|---|---|---|---|---|
| 2,045,964 | A * | 6/1936 | Rinkel | F42B 12/34 102/509 |
| 4,882,822 | A * | 11/1989 | Burczynski | F42B 12/34 86/54 |
| 5,259,320 | A | 11/1993 | Brooks | |
| 5,400,716 | A * | 3/1995 | Mayer | F42B 12/78 102/507 |
| 5,943,749 | A | 8/1999 | Swank | |
| 6,148,731 | A | 11/2000 | Winter | |
| 6,457,417 | B1 | 10/2002 | Beal | |
| D770,005 | S * | 10/2016 | Christiansen | D22/116 |
| D782,602 | S * | 3/2017 | Riley | D22/116 |
| 9,677,862 | B2 * | 6/2017 | Hendrixson | F42B 12/34 |
| D821,536 | S * | 6/2018 | Christiansen | D22/116 |
| 10,690,464 | B2 * | 6/2020 | Peterson | F42B 12/745 |
| 2001/0037706 | A1 * | 11/2001 | Kaminski | B23Q 11/1038 82/1.11 |
| 2002/0056397 | A1 | 5/2002 | Carr et al. | |
| 2008/0314280 | A1 * | 12/2008 | Martini Filho | F42B 12/34 102/510 |
| 2012/0090492 | A1 * | 4/2012 | Rebar | F42B 12/34 102/510 |
| 2015/0233687 | A1 * | 8/2015 | Krause | F42B 30/02 102/444 |
| 2015/0308799 | A1 * | 10/2015 | Powers, Jr. | F42B 12/34 102/510 |
| 2015/0330751 | A1 * | 11/2015 | Flint | F42B 12/74 102/507 |
| 2018/0161972 | A1 * | 6/2018 | Hsiao | B25B 13/56 |
| 2019/0017790 | A1 * | 1/2019 | Masinelli | F42B 12/367 |

FOREIGN PATENT DOCUMENTS

| | | | |
|---|---|---|---|
| DE | 4111959 | A1 | 10/1992 |
| DE | 4435859 | A1 | 4/1996 |
| WO | 2015/128331 | A1 | 9/2015 |

OTHER PUBLICATIONS

GPTO Office Action for DE 10 2017 011 359.9, dated Aug. 22, 2018.

* cited by examiner

Figure 1:
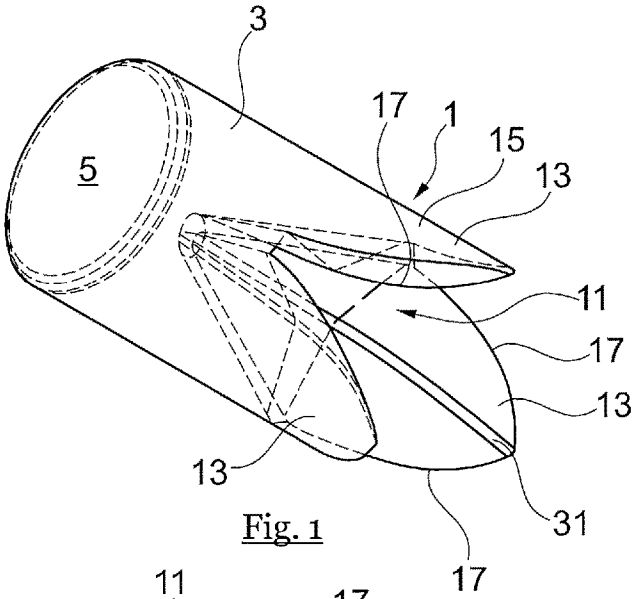
Figure 2:
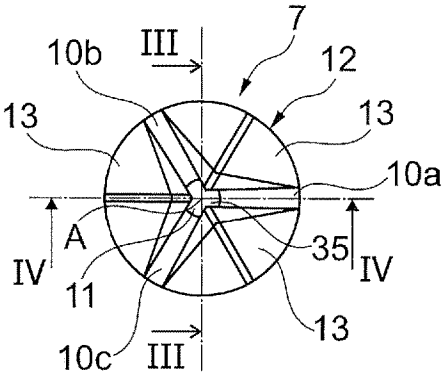
Figure 3:
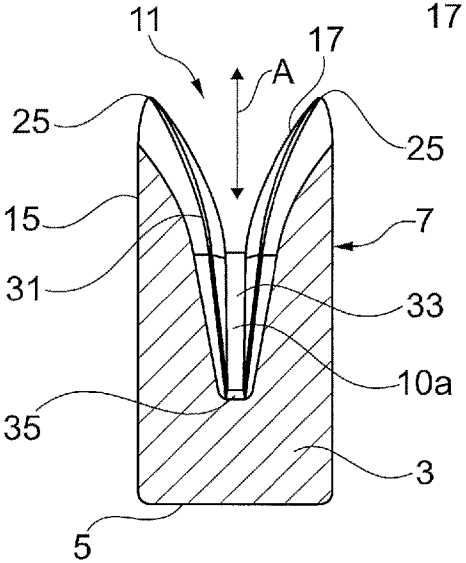
Figure 4:
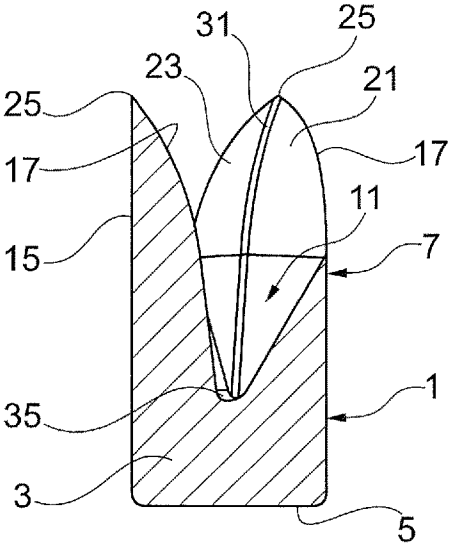

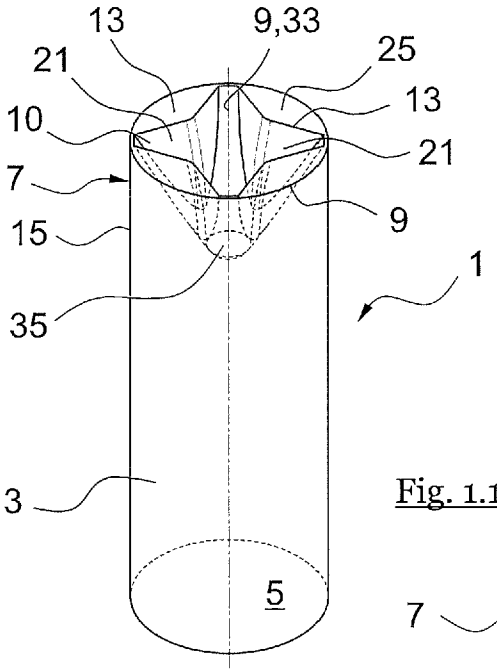
Fig. 1.1
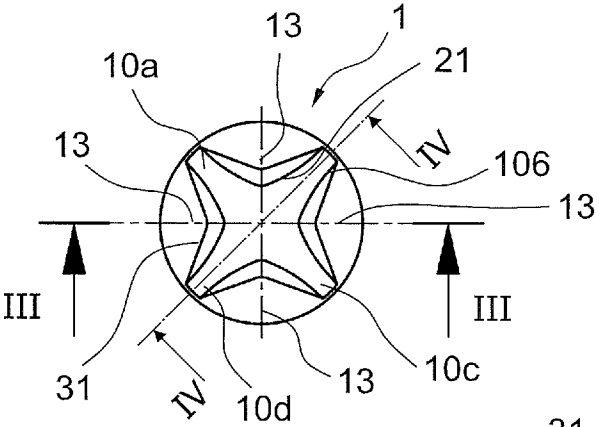
Fig. 2.1
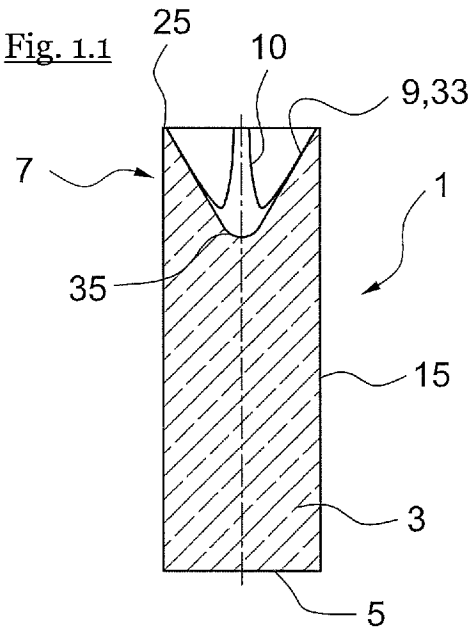
Fig. 3.1
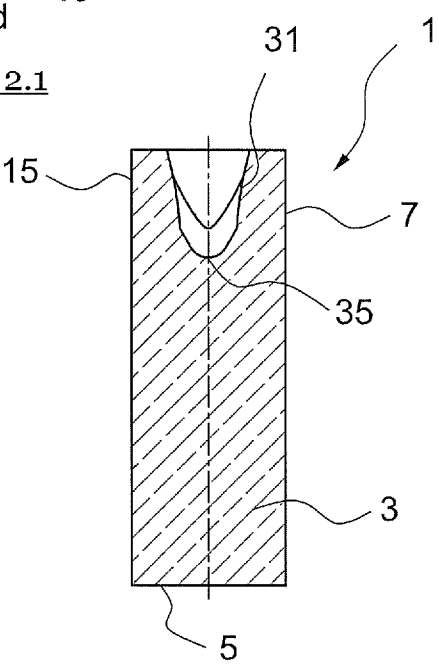
Fig. 4.1

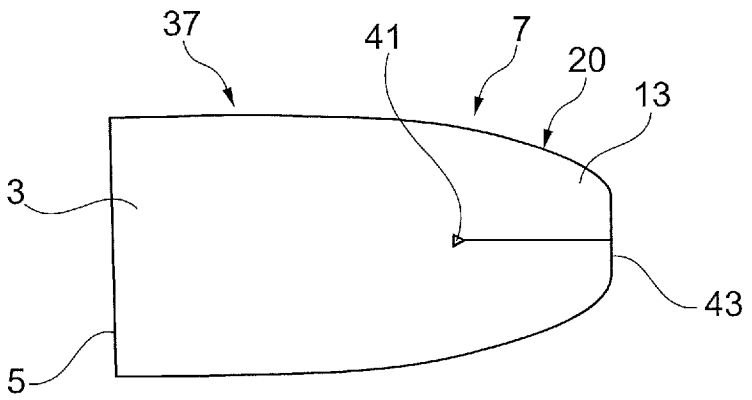
Fig. 6
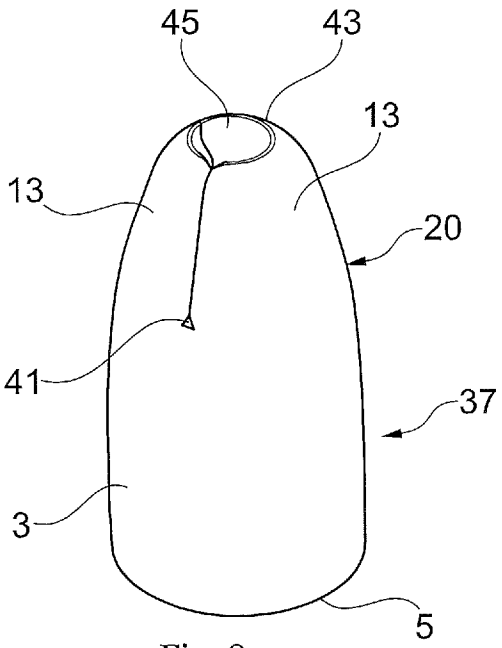
Fig. 8
Fig. 5
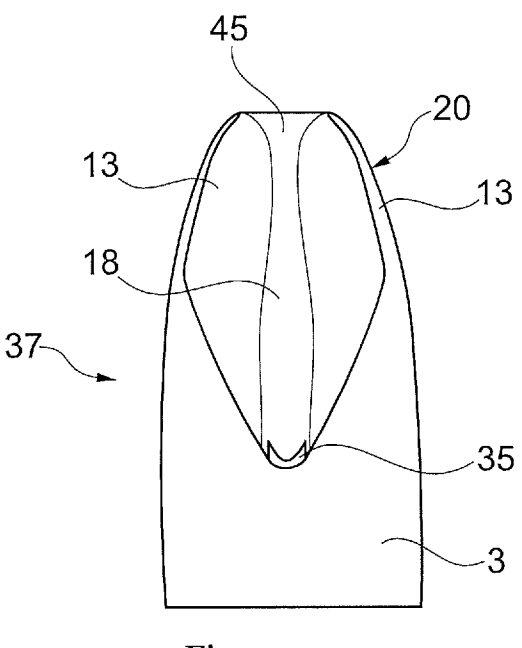
Fig. 7

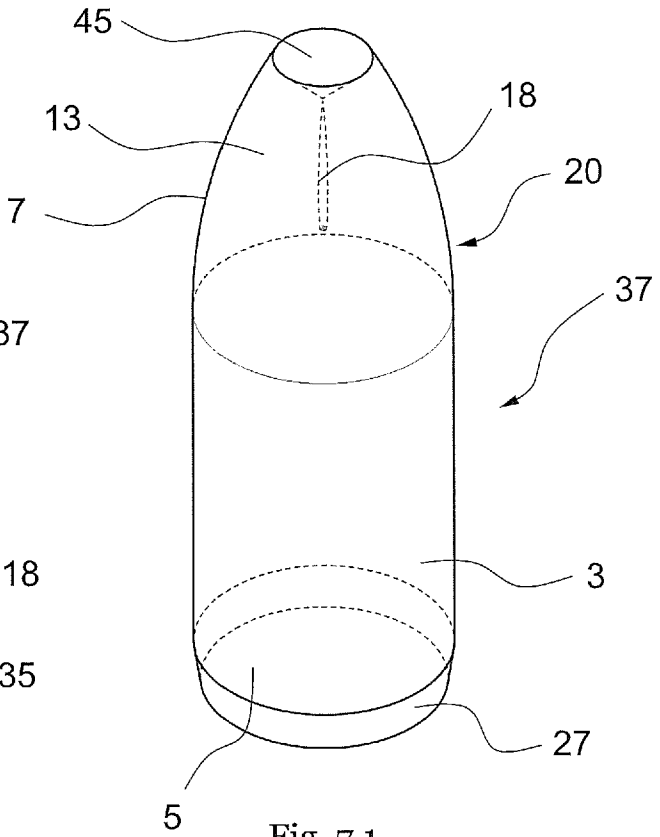
Fig. 7.1
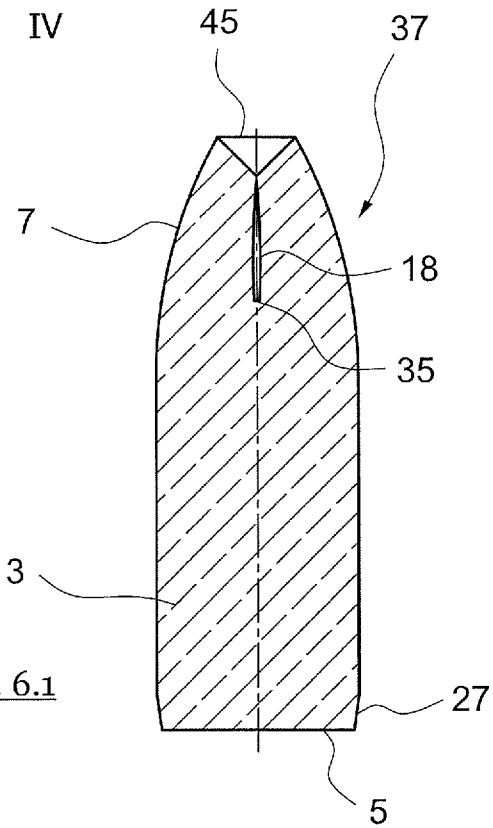
Fig. 6.1
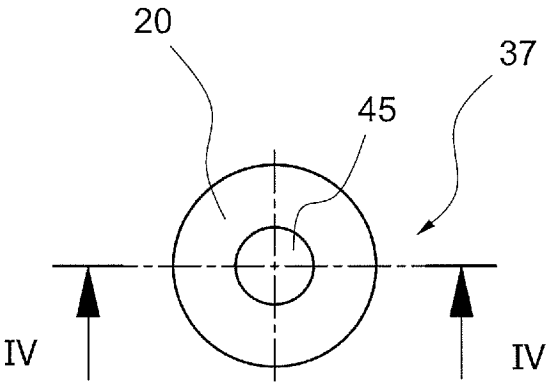
Fig. 5.1

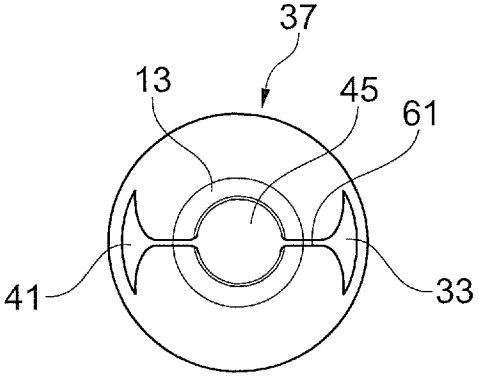
Fig. 30
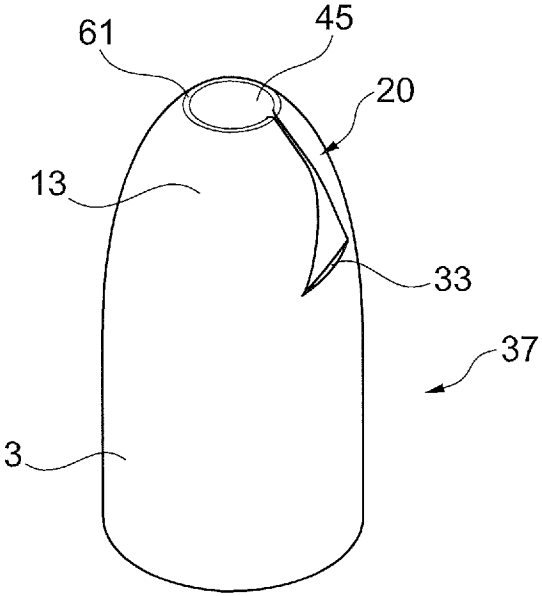
Fig. 29
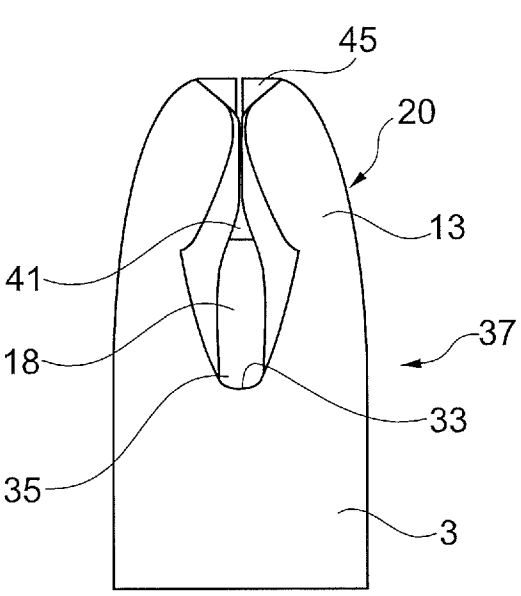
Fig. 32
Fig. 31

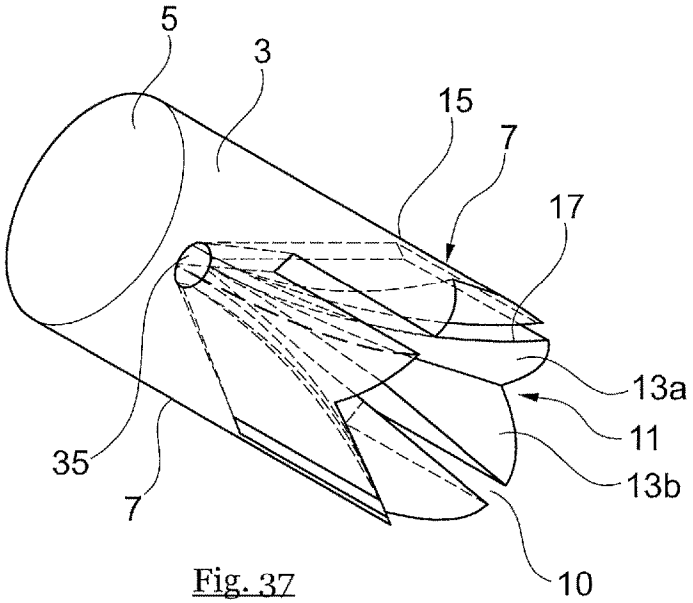
Fig. 37
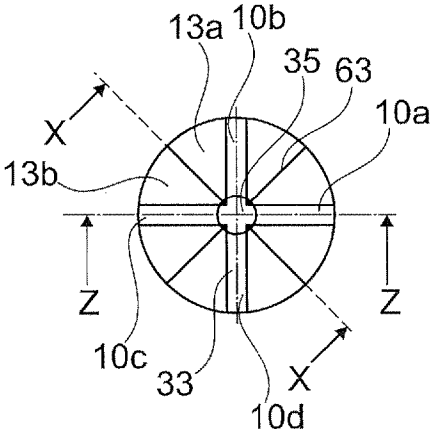
Fig. 38
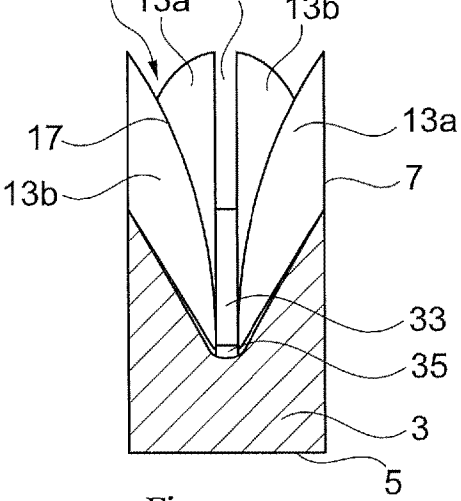
Fig. 39
Fig. 40

11
21
7
39
25
13
9,33
1
17
38
3
5

1
13
7
39
38
21
13
35
3

10a
III
13
13
10c
IV
IV
10b
III
31
13

A
11
13
15
1
39
3
7
9,33
35
38

INTERMEDIATE FOR MANUFACTURING PROJECTILES OF A DEFORMABLE BULLET, PROJECTILE, DEFORMED PROJECTILE, TOOL FOR MANUFACTURING THE INTERMEDIATE AND METHOD FOR MANUFACTURING THE INTERMEDIATE

CROSS-REFERENCE TO RELATED APPLICATIONS

This application is a U.S. national phase application filed under 35 U.S.C. § 371 of International Application No. PCT/EP2018/084238, filed Dec. 10, 2018, designating the United States, which claims priority from German Application No. 10 2017 011 359.9, filed Dec. 8, 2017, which are hereby incorporated herein by reference in their entirety.

The invention relates to an intermediate for manufacturing of projectiles, in particular, deformable bullets or partial fragmentation bullets, wherein, in particular, the finished projectile has an unfilled cavity in particular, in the region of the ogive in particular, which is limited by an ogival wall of the projectile. For the intermediate, a ductile, in particular, lead-free material, such as copper, a copper alloy, brass or the like, can be used. Furthermore, the invention relates to the projectile, in particular, the deformable bullet per se. In addition, the invention relates to a projectile that is deformed, in particular, under idealized test conditions, which projectile hits into and is intercepted by a bare gelatinous mass after being shot into it in order to examine and assess an ideal deformation behaviour. Furthermore, the invention relates to a tool for manufacturing the intermediate and, in particular, the projectile. The invention also relates to a method for manufacturing the intermediate and, if necessary, the projectile of the deformable bullet. Finally, the invention relates to a projectile deformed by use after it has hit the gelatinous mass in accordance with known test methods, is collected there and can be assessed.

It is known to form solid bullets, in particular, partial fragmentation bullets, with an unfilled cavity formed in the region of the ogive, which has a large tip opening at the ogive tip, the diameter of which frequently amounts to more than 50% of the bullet calibre. It is known to incorporate a plurality of notches in the ogival wall surrounding the cavity, which, when hitting the gelatinous mass, cause a mushroom-shaped or sepal-shaped deformation of the wall bent radially outwards. An example of such a notched wall of the ogive section of the projectile is known from WO 2015/061662 A1. The well-known bullet head has a very large ogive tip opening, at which the gelatinous mass can enter the cavity to cause the above-mentioned desired deformation. However, it has been shown that, the central ogive tip opening in the case of striker bodies with a greater hardness, such as is the case with gelatinous masses surrounded by textile materials, in the case of plaster concrete sheets, etc., this ogive tip opening is clogged by the material of greater hardness, which is why the gelatinous mass, which builds up the hydraulic pressure, cannot penetrate into the cavity, thereby not resulting in the desired mushroom-shaped deformation structure.

Furthermore, it is known to produce a projectile or bullet head with the help of a so-called intermediate or intermediate product, wherein a cold-forming process, such as deep-drawing, is used. An intermediate for manufacturing a projectile of a projectile, in particular, a deformable bullet or partial fragmentation bullet, similar to the generic object is known from U.S. Pat. No. 5,259,320. Accordingly, a blank made of copper is inserted into a cylindrical die and cold-formed by means of a mandrel or stamp, by which the mandrel penetrates into the blank in the axial longitudinal direction in order to provide it with a recess starting from the ogive side to be formed. By means of the die and the mandrel, the ductile material escapes, thereby forming the desired intermediate for the projectile. The mandrel can have a pyramidal shape with four flat inclined flank surfaces, which flow into straight dividing edges. A corresponding negative profile is pressed in the blank. The mandrel can have a conical structure to form a corresponding negative cone shape in the blank. The manufactured intermediate is provided with a closed, externally cylindrical wall and a centred press recess incorporated within the press end section. The wall runs completely and seamlessly in the circumferential direction around the press recess. In a subsequent cold-forming process, the wall is transformed into an ogival tip to produce the final product of the projectile. In this process, a completely closing inner surface contact is created in the end region of the jacket, which provides a closed cavity within the ogive of the projectile. The cavity is completely closed in the circumferential direction of the wall forming the ogive.

It has been shown with the well-known cold-formed projectile that the deformation behaviour of the projectile does not take place as desired, particularly during standardized test methods. With all the various proposed known stamps for the deep-drawing of the intermediate, it has been shown that cone-shaped or pyramidal tools used for this purpose can easily break. The service lives of such tools is uneconomically low. It has also been shown in the case of the known deep-drawing by means of a mandrel that, in the circumferential wall, stress variations and material solidifications arise that allow for an uneven deformation of the impacting projectile with a low level of controllability. In particular, it has been shown that, during deformation by means of the particularly cone-shaped mandrel, external deep-drawing shafts (cusps) arise in the region of the wall/cavity, which makes an elaborate post-processing of the projectile necessary with regard to optimal dynamics.

It is an object of the invention to overcome the disadvantages of prior art, in particular, to improve an intermediate for manufacturing a projectile, in particular, a deformable bullet, a particularly deformed projectile of a deformable bullet, a tool for manufacturing the intermediate, and a method for the manufacturing the intermediate so that an optimized simple manufacturing is made possible and the deformation behaviour is optimized when hitting a gelatinous target, even in the case of its enveloping in accordance with a standardized process. The task is achieved by means of the features of the main Claims 1, 6, 7, 11, 13 and 15.

Thereafter, an intermediate is provided for manufacturing a projectile, in particular, a deformable bullet consisting of a ductile cylindrical base body. The base body can be made of a homogeneous metal material, such as copper, copper alloy, brass, lead, etc. Preferably, the base body is made of a lead-free material. The base body can be made of a cut blank, which can be made, in particular, out of a cut ductile metal material. The base body is cold-formed according to the invention by means of pressings, in particular deep-drawing, and in particular using a stamp-die arrangement. The base body or blank to be formed to the intermediate forms as an intermediate a cylindrical, solid base end section, which preferably comprises an essentially flat end face to be directed towards the bullet casing. Furthermore, the intermediate comprises a press end section, which is diametrically opposite to the base end section in the axial direction of the projectile, wherein the press end section is formed with a central press recess incorporated by means of the pressing process and a jacket or wall limiting the press recess for the formation of an ogival shaped tip of the projectile. In addition, the intermediate can be provided with a jacket of a metal material or other suitable material, which completely covers the base body or core in the region of the base, the guide section (shoe) and up to the nose of the projectile intermediate, wherein, in particular, the nose-side end face remains open, so that access to the base body is possible. The jacket, in particular, surrounds the base body approximately completely in the circumferential direction. Only on the nose front side no jacket material is provided for the insertion of a forming tool. The jacket can be made of another or of the same material as the base body. For example, a homogeneous metal material such as copper, copper alloy, brass, lead, etc. can be used for the jacket. Preferably, the jacket is made of a lead-free material. Thereby, the base body forms the core of the intermediate of the bullet to be made of it. The core is surrounded by the jacket, in particular, being completely surrounded when the bullet is manufactured from the intermediate. The base body can preferably be two-piece, wherein a nose-side section is unaffected by the slotting, while a base-side region is formed by the slotting.

According to the invention, the wall to be formed into the ogive during the later forming process of the intermediate is formed with at least two slots extending in the axial direction of the intermediate, whereby a corresponding number of prongs or wall sections separated by the slots in the circumferential direction result. The slots or through slots completely push through the surrounding wall surrounding the cavity or the press recess radially so that, in the case of the intermediate according to the invention and also the projectile, there is a free radial access via the radial passage slots towards the cavity. Only when forming the slotted wall into an ogive section, the cavity is closed at least partially in the circumferential direction on the basis of lateral edges of structurally separated prongs formed by the slotting, thereby making contact or lying closely to one another, thereby forming a gap. Preferably, three, four, five, six or more slots or through slots can be incorporated into the wall. In a preferred embodiment, the at least two slots, in particular, exactly three or four slots (exactly three or four prongs as a result), are arranged in circumferential direction at the same circumferential distance to each other in order to form a point-symmetric slot/prong arrangement relative to the axial direction of the intermediate. According to the invention, the at least two slots separate the respective at least two prongs, which form the structure of the wall and are intended to limit a cavity in the circumferential direction of the intermediate, wherein in particular two adjacent prongs of the wall are associated with one slot. The prongs extend from a slotted base, which forms the base-end-section-side end of the slot, in the axial direction to a prong end or tip, which prong ends form the axial end of the wall and thus, the intermediate. According to the invention, the at least two slots extend by more than 10% of an axial total longitudinal expansion of the intermediate from the wall end towards the base end section. The total length of the extension of the slot to be considered should be the axial dimension from the wall end to the slotted base at the transition of two adjacent prongs. Due to the intermediate being a single piece, in particular the cold-forming, the respective prong grows towards the respective prong end in the axial direction from the base end section, which terminates geometrically through the slot in the axial direction, wherein the circumferential width of each prong of the at least two prongs preferably decreases in the axial direction towards the prong end continuously and evenly, whereby, in particular, the circumferential width of the slot lying between two prongs increases in the axial direction towards the wall end, in particular, gradually and/or continuously. In a preferred embodiment, the slotting can be continuous or have a slotted base for sealing the cavity or the press recess radially in the circumferential direction, wherein the slotted base is used radially on the outside to complete a continuous step-free, in particular, cylindrical outer side of the intermediate. In this case, the slotting can form a canal structure extending in the longitudinal direction of the bullet, which is open to the hollow interior. A depth of the slotting from the cavity towards the slotted base can vary, in particular, continuously increase in the longitudinal direction towards the base of the intermediate. In particular, the slotting is fully incorporated within the base body and, if necessary, in the jacket surrounding the base body. Not only the approximately cylindrical outer side of the prongs, but also the outer side of the slotted base of the base body or of the jacket connecting two adjacent prongs allow for a completely cylindrical outer side of the intermediate to form. The slotted base is continuous in the circumferential direction on the cavity side, in particular, equal in width, wherein the slotted base extends continuously towards the longitudinal axis of the intermediate in the common cavity floor of the inner cavity. The inner sides of the prongs formed by the slotting also terminate in the cavity floor.

The slotting and thus the desired inner hollow profile is shaped in such a way for the intermediate that, when forming the intermediate into the bullet, the prongs incorporated by means of the slotting serve as gripping arms and/or a separate tip, made of plastic for example, is inserted and attached to it for the formation of the nose of the projectile, in particular, being pressed. During the forming process of the intermediate of the bullet, in which the slotted region is formed radially inwards utilising the slotting, this can be used to achieve a clamping of the tip. The intermediate shape according to the invention correlates deformation of the blank without the formation of deep-drawn shafts, which is very easy to realize but even. The mould forming the shape of the intermediate according to the invention provides a space for the material of the intermediate to be formed later on to escape due to the formation of the slots between (in the circumferential direction) the prongs, in particular the material of the prongs. When pressing or deep-drawing in accordance with the cold-forming process, undesirable corrugated formations are largely avoided. In addition, a bullet is provided with the intermediate according to the invention, which is realized exclusively by means of a cold-forming process, in particular, without having to use machining methods. The cold-formed intermediate/projectile also achieves the desired partial fragmentation deformation behaviour without resulting in a splintering of the bullet when hitting into gelatinous mass in accordance with standardized test methods.

In a further embodiment of the invention, the at least two slots extend by more than 20%, 250, 30%, 35%, 40%, 45% or 50% of the total axial extension of the ogive to still be designed later in the region of the slotted press end section provided with a press recess. Preferably, the at least two slots extend across the entire axial longitudinal expansion of the press end section in such a way that the ogive to be formed is completely realized by the wall formed with at least two slots, precisely three or four of them. The prongs or wall sections elongated by the corresponding length of the slots form the ogival wall to limit the cavity of the projectile, which is designed to be open at the ogive tip with an opening having a clear cross-section according to the invention that is less than 20%, 15%, 10% or 5% of the calibre cross-section of the projectile.

The at least two slots define a circumferential width to be measured in the circumferential direction, in particular, thereby growing from the base end section at the level of the slotted base. In a further embodiment of the invention, the circumference width of at least two slots increases from the slotted base towards the jacket tip, in particular, in a continuous manner. Preferably, the gradient of the flank edge of the prong limiting the slot is essentially constant in its progression from the slotted base towards the wall tip, in particular, in a main slotted base between the slotted base towards the wall end, wherein the slotted base is rounded in the same way as the wall tip also has a rounding with a changed gradient. In addition or as an alternative, the at least two slots of the slotted base can open continuously in the axial direction, wherein the slot opening is at a maximum at the wall tip in particular.

Preferably, the at least two prongs are essentially identical in shape and measurement in order to form a symmetrical, in particular, a point-symmetric structure of the intermediate at least in the region of the press end section or completely, which will largely form the ogive of the projectile. The at least two prongs grow from the slotted base and the press recess arc in the axial direction. The prongs can also be shaped as spikes, wherein they may not necessarily, but can preferably run into a pointed end, which is preferably rounded, wherein the prong end can extend in the circumferential direction in an obtuse manner.

In a preferred further embodiment of the invention, the design shape of the respective prong is decisive. Preferably, an inner surface facing the press recess of the respective prong is convex in the circumferential direction and/or in the axial direction. Preferably, in a cross-sectional view of the respective prong, a material thickness of the prong that increases towards the centre of the circumferential direction is provided, wherein, in particular, the outward-pointing outer surface of the prong is cylindrical, and, in particular, already essentially corresponds to the calibre of the projectile. Two flank surfaces, shaped towards the axial centre axis of the prongs, in particular, being axis-symmetrical, on the inner side of the prong extend from the edge of the prong extending in the axial direction all the way to its centre, thereby limiting the slot. They can be flat, concave or convex. Preferably, the two flank surfaces, which abut each other, are at an angle to each other, wherein the intersection of the flank surfaces essentially corresponds to the centre axis of the prong, along which the prong is designed to be strongest and has the greatest material thickness. Preferably, the centre region of the prong is formed with a material extension maximum, which extends as an edge from the prong tip to the base-end-side section. Preferably, a convex inner surface in the circumferential direction essentially on half circumference width of the prong has an edge-like projection extending into the press recess, which preferably extends in a straight line from the axial height of the slotted base to the prong tip. In particular, the flat, convex or concave flank surface of the prong can descend from the edge-like projection towards a lateral edge of the prong limiting the respective adjacent slot as far as the material thickness of the prong is concerned. Preferably, the edge- or bar-like projection is rounded towards both flank inner surfaces.

In a convex embodiment of the inner surface of the prong in the axial direction, the convex inner surface is preferably designed without a projection.

In a preferred embodiment of the invention, the outer surfaces of the prong are cylindrically formed, in particular, according to the die used for the method. The lateral boundary edge of the prong represents the end of the cylindrical outer side of the prong, at which there is a profile break towards the inner surface of the prong, which inner surface has the convex shape in the circumferential direction or in the axial direction.

In a further embodiment of the invention, instead of an edge- or bar-like projection extending into the process recess, a recess which also extends in a straight line from the prong tip towards the axial height of the slotted base like a groove or a notch can be formed, which interrupts the convex design of the flank inner surface.

In a further embodiment of the invention, the at least two prongs define a wall thickness in a circumferential cross-slot view. The wall thickness of the prong preferably increases from a lateral edge limiting the respective adjacent slot (transition between the cylindrical outer surface and the inner side of the prong) at a certain axial height and, in particular, along the entire axial extension towards a wall thickness maximum. From the wall thickness maximum, the wall thickness can decrease again to the opposite lateral edge, in particular, continuously. Preferably, the wall thickness maximum in circumferential direction is formed essentially in the centre of the prong. Alternatively, instead of the wall thickness maximum, a reduction of the wall thickness in the form of a recess can be provided, which abuts a wall thickness elevation. In such an embodiment, the respective prong comprises two wall thickness maxima, which are limited by the recess. From the respective wall thickness maximum, the wall thickness decreases towards the adjacent lateral edge, which limits the slot. The wall thickness maximum extends over a region of the axial extension of the prong, particularly in the axial centre range of the prong. Preferably, the wall thickness maximum can extend essentially from the prong end to the axial height in the region of the slotted base and beyond up to the press recess floor.

In a preferred embodiment of the invention, the press recess extends over more than 50%, in particular, between 50% and 80%, in particular, of more than 60%, preferably between 60% and 80%, in particular, in the range of 75% of the axial total extension of the intermediate or projectile. The press recess defines a recess ground, in the centre of which the slotted bases of at least two slots extend radially and, if applicable, axially towards the cylindrical outer side. The die-recess-free base end section consists of the solid full material of the blank and is limited by the press recess floor and the slotted bases extending away from it in the axial direction. By the jacket being slotted, the press end section of the intermediate extends away from this boundary.

The projection formed on the inner surface of the respective prong, in particular the wall thickness maximum, preferably extends in the axial direction beyond the axial height of the slotted base, in particular, essentially completely up to the press recess floor. Preferably, the project into the recess ground passes continuously without forming a profile projection. The same applies to the recess in the region of the inner surface of the respective prong, which can be formed instead of a projection under certain circumstances.

Preferably, a recess ground, which represents the dead-end region of the press recess, is spherically shaped. Alternatively, the recess ground can also be flat, which has a maximum width of 10 mm or a few millimetres. The recess ground can extend radially in such a way that it merges into a slotted base, in particular all slotted bases of the at least two slots, in particular, continuously. The slotted bases can, of course, be shaped as strips or like a groove, rounded and terminates into a corresponding form of the central recess ground.

In a further embodiment of the invention, the outer side of at least two prongs is executed cylindrically, while the inner surface curves convexly, namely towards a prong tip, wherein the curvature gradient can gradually increase with respect to the vertical. In a preferred embodiment of the invention, exactly three prongs are provided for the wall of the press end section, which are arranged at an angle of 120° at an equal circumferential distance to each other. Alternatively, exactly four prongs can be provided, whose centre axis are arranged essentially at a 90° circumferential distance to each other. The respective prongs have an identical or similar shape and an identical cross-section, in particular, across the entire axial progression from the recess ground to the prong tip.

In a further embodiment of the invention, exactly two prongs are provided, wherein both slots separating the prongs on both sides narrow in a radial progression towards a centre (the longitudinal axis of the intermediate) and expand from the centre again radially outwards. The exactly two prongs are identically shaped and lie symmetrically opposite each other.

The deformation control on impact, for example, into an ideal gel-like substance, is realized by the special embodiment of at least two prongs in conjunction with the press recess and, ergo, the at least two slots. The convex region of the inner side of the prong causes a strengthening in the region of the weakening of the press end section of the intermediate incorporated by the press recess. The slot, which limits two prongs and decreases from the pointed end to the slotted base, strengthens the prong foot that enters the base end section. The dimensional stability exists across the entire axial progression and in the cross-section along the axial progression of the prong from the recess ground to the prong end.

In a preferred embodiment of the invention, the stamp, which should be used for profiling the press end section for the intermediate, is formed according to a Phillips screwdriver, the diameter of which is greater than the diameter of the intermediate. Two-bar, three-bar, four-bar or multi-bar screwdrivers can be used. It is the bars of the blade of the Phillips screwdriver that incorporate the slots into the blank to form the intermediate, wherein the central section of the screwdriver forms press recesses.

Furthermore, the invention relates to a projectile for a deformable bullet, which is made of a ductile blank, which is firstly being cold-formed into the intermediate. The projectile is ultimately realized by means of a forming process. According to the invention, the projectile should be realized by means of the intermediate according to the invention.

In addition, the invention relates to a projectile, in particular, of a deformable bullet or partial fragmentation bullet, which has a cylindrical, solid base end section and an ogive section connecting to the base end section as a single piece with a wall for the extensive enclosing of a particularly unfilled cavity and a centred opening at a tip of the ogive section with a clear opening cross-section of less than 20%, 15%, 13%; 10%, 8% or 5% of the calibre cross-section of the projectile defined by the base end section. Preferably, the maximum dimension, which is the longest linear dimension to be measured, for example, in the case of a Y-shaped opening, a star-shaped opening, an I-shaped opening, for example, from a star limb to the opposite boundary wall is less than 17%, 15%, 13% or 10% of a diameter of the base end section. Surprisingly, it has been shown that such a dimensioned ogive tip opening is sufficient to break through harder materials, such as elastic materials or textile fabrics, without this being accompanied by occupancy or blockage of the ogive tip opening. When entering the gelatinous mass in accordance with the standardized test methods, the gelatinous material can then easily penetrate into the empty cavity of the ogive section in order to build up the hydraulic pressure, which causes the desired partial deformation of the projectile.

Furthermore, the invention relates to a projectile, in particular, a deformable bullet. The projectile comprises a cylindrical solid base end section, which preferably comprises a flat end face, which in a further embodiment can have a central recess or indentation, which is axially aligned in the direction of the ogive tip. The base end section is used to be inserted into a case of the bullet or ammunition. Furthermore, the projectile has a press end section lying diametrically opposite to the base end section in the axial direction, which essentially corresponds to that of the intermediate. The press section has a central press recess incorporated by pressing and a wall limiting the press recess, which is formed into an ogival shaped point. This creates a cavity within the projectile in the region of the ogive or the wall. The cavity is unfilled and empty so that, in particular, in accordance with the standardized test method, gelatinous material can penetrate into the cavity in order to build up the hydraulic pressure, which is supposed to trigger the deformation behaviour according to the invention. According to the invention, the wall of the projectile has at least two wall sections. It is clear that the above-mentioned prongs or wall sections of the ogive form the projectile as soon as the prongs are formed from their outer surface-side cylindrical orientation towards the pointed-arched ogive. The ogive should preferably be tangent ogive in shape. In the projectile according to the invention, adjacent wall sections are bent in the circumferential direction in such a way that they come into contact with each other at least in sections so that, in the region of contact of the wall sections, a cavity formed by the press recess, in particular, during the formation of the intermediate, is enclosed in the circumferential direction (i.e. in the region of the sectional contact of the lateral edges of the ogive sections). The enclosure is complete in the circumferential direction as soon as the lateral edges make contact. The lateral edges do not have to be completely in contact, but, as indicated above, contact can be made in sections.

In a preferred embodiment of the invention, the cavity, which is to be limited by the wall sections in the circumferential direction, is not fully opened, but has at least three openings, a central opening at the ogive tip, as already stated above, and at least two side openings in the region of the slotted bases, which adjust in the creation of the intermediate. The number of side openings depends on the number of slotted bases. Preferably, the side openings are formed identically in the clear cross-section. The cross-section of the side openings can have an essentially triangular, heart or spade shape and can extend across a small region up to a range of more than 30% of the axial extension of the cavity.

In a further embodiment of the invention, the projectile is manufactured on the basis of the intermediate according to the invention. The completed intermediate is then cold-bent to form the respective ogive section. For this purpose, it can be inserted into an appropriate die.

In a preferred embodiment of the invention, a contact length of adjacent ogive portions at their lateral edges is over 20%, 30%, 40%, 50%, 60%, 70%, 80% or respectively 90% of a total length of the lateral edges of the respective ogive sections. The lateral edges are measured from the tip of the respective ogive section to a slotted base. Preferably, there is contact of the lateral edges along the entire length of the lateral edges along the entire length of the lateral edges so that the ogive sections making contact completely close the cavity. A complete closure is difficult to achieve in terms of production so that a small opening of less than 2 mm or 1 mm can be assumed to remain in the zone of the slotted base, which does not affect aerodynamics and impact deformation. This side opening, which results from the slotted base in the intermediate and the subsequent forming towards the ogival shape of the wall, can extend by less than 1 mm along the lateral edges of the wall sections or over an essential region along the axial extension of the cavity, up to more than 50% of the axial length of the cavity.

A flat or linear contact of the lateral edges for completely circumferentially enclosing of the cavity in the region of the contact is not necessary according to the invention. Of course, the ogive formed by the bent wall sections along the lateral edges can have a narrow gap (without contact), wherein a gap of less than 1 mm or 2 mm can be set independently of the calibre size. Preferably, however, a longitudinal contact between a zone of the lateral edges of adjacent wall sections is advantageous, in particular, to define the opening edge of the centred ogive tip opening. The contact range along the lateral edges can be less than 3 mm, preferably between 1 mm and 5 mm, more preferably, at a calibre of 9 mm.

In a preferred embodiment of the invention, the respective tips of the ogive portions are formed into a particularly substantial circular opening, which lies centred to the longitudinal axis of the projectile at the tip of the ogive section and is open towards the in particular empty cavity, wherein, in particular, the opening cross-section of the mouth comprises a Y-shape, an I-shape or a star shape. A plurality of opening tongues can meet at a common opening centre, wherein the opening tongues are arranged essentially at an equidistant circumference section with relation to one another. The opening centre is centrally located, thereby being coaxial to the longitudinal axis of the projectile.

Furthermore, the invention relates to a projectile, in particular, a deformable bullet. This projectile according to the invention can be combined with the above-mentioned projectile detail. Preferably, the projectile according to the invention is made of a ductile material, such as copper, a copper alloy, brass or the like. The projectile is dimensioned and shaped in such a way, in particular being cold-formed, that, after the projectile has been fired and hits into a gelatinous mass, in which it should also get stuck in particular, the projectile is deformed in such a way that at least two prongs that are bent radially outwards and in the projectile's longitudinal direction are formed by a particularly essentially cylindrical and largely undeformed base end section. The prongs are made of a solid material as a single piece with the base end section. Due to the slotting through the intermediate and the resulting side passage openings in the wall limiting the cavity, a deformation joint at the axial height of two adjacent slot arcs is created, whereby a defined unfolding/swivel deforming is realized radially outwards and back into the axial direction. The prongs have a kind of sepal shape in the deformed state and extend accordingly from the base end section. Preferably, it is the above-described prongs with respect to the intermediate, which are bent radially inwards after the intermediate production for the formation of the ogive. The opposite radial fungus-shaped folding deformation is caused by the hydraulic pressure building up in the cavity upon entry into the gelatinous mass, which was limited by the respective prongs. Via the opening at the ogive tip of the projectile, gelatinous mass enters the cavity upon impact and causes a splitting and folding-out of the prongs in the above-mentioned manner, wherein a long slot length realizes a wide radial extension of at least two prongs. Surprisingly, in the use of the intermediate according to the invention and thus of the projectile according to the invention, it became apparent that, in addition to the at least two prongs, other tooth-shaped, prong-shaped or jagged-shaped radially outward-pointing nib- or tooth-shaped projections form, which lie in the transition between two adjacent prongs. Between the at least two bent-back prongs, two further identical or at least similarly shaped, radially protruding pointed teeth are formed by the impact deformation within the gelatinous mass. The at least two bent-back teeth also extend as a single piece from the base end section of the projectile, wherein the majority of kinetic energy of the projectile is abolished by deformation of the outwardly bent prongs and the outwardly bent intermediate teeth. According to the invention, it has been shown that the radial extension of at least two teeth is less than that of the at least two adjacent prongs.

Preferably, there are exactly three or exactly four radial prongs curved towards the outside, wherein a shorter pointed tooth is respectively formed between two adjacent prongs.

The radial extension of the at least two teeth is less than that of the at least two prongs. Preferably, the radial extension of at least two teeth is less than 50% of the radial extension of the prongs. The dimensional difference in the radial direction between the prong and the teeth can be set by the length of the slots incorporated into the intermediate of the projectile. It has surprisingly been shown that wall sections and the slotted base structures becoming apparent in the process, in particular, as a rounded or flat slotted base surface, form due to the through slots incorporated into the intermediate. In interaction with the prong, in particular, due to the convex curvature on the inner surface, a specific deformation in the region of the slotted base is forced, which leads to the above-mentioned intermediate tooth structure according to the invention in the deformed projectile.

It is the region of the slotted base in combination with the solid base end section and the adjacent prongs, which is why the pointed teeth form adjacent to the bent prongs in the transition region to the base end section, which also protrude radially outwards in a mushroom-like manner.

Preferably, the base end section of the deformed projectile has a deformation-side central recess, the floor of which results almost unchanged from the press recess floor of the intermediate. From this recess, the at least two prongs and the at least two teeth nib-like radially extend towards the outside, wherein the prongs have a convex top side. The at least two teeth can also have a convex radial extension. However, it may be that these are not clearly formed, particularly in the case of short teeth of less than 2 mm.

In a further embodiment of the invention, the at least two deformed prongs of the projectile and/or at least two deformed teeth of the projectile have a central material reinforcement, which, in particular, extend in a straight line in the longitudinal direction of the respective prongs and/or the respective tooth, in particular, from the central recess on the base end section. This reinforcement is realized by means of a material accumulation, which is already provided in the intermediate according to the invention.

In addition or as an alternative, in the case of the deformed projectile, there can be a constriction formed between a prong and the adjacent intermediate tooth, in particular, in the case of viewing axially, which constriction separates the respective tooth from the respective prong.

Furthermore, the invention relates to a tool, such as a stamp or a mandrel, for pressing a blank used in a cylindrical die made of a ductile material, such as copper, a copper alloy, brass or the like. The blank can be a single-piece base body or be made of two pieces, which has a base body designed as a core, which is surrounded by a jacket that is also made of a ductile material. In the case of such a blank, in particular, a hunting bullet, in particular, the partial fragmentation bullet is formed. The tool is used to form, from the blank, an intermediate, in particular, according to the invention or a projectile according to the invention. According to the invention, the tool has a press head, which is shaped in accordance with a blade of a slotted screwdriver, in particular, an SL-type, a PH-type, or a PZ-type slotted screwdriver, wherein, in particular, the maximum diameter of the blade is larger, in particular, by at least 0.5 mm, 1 mm or 2 mm, but preferably less than 5 mm, than the calibre of the projectile to be created.

In a preferred embodiment of the invention, the press head is made of a hardened material, such as a carbide, which can be selected from the group of known carbides. In particular, the press head can be selected from a hardened steel with a Vickers hardness of more than 55 HV 5. It is clear that a surface-hardened steel can also be used for the press head.

Furthermore, the invention relates to a method for manufacturing an intermediate, in particular, according to the invention for manufacturing the projectile of a bullet. Preferably, the invention relates to a method for manufacturing a projectile according to the invention, in particular, on the basis of the intermediate according to the invention. In a method according to the invention, a cylindrical die is used, which should preferably correspond to the calibre of the bullet. A blank made of a ductile material, such as copper, a copper alloy, brass or the like, is inserted into the cylindrical die. To create the intermediate according to the invention, a press head is inserted into the die to cold-form the blank, in particular to deep-draw it. Preferably, in the method according to the invention for the creation of the intermediate, in particular, the projectile, a cold-forming process is exclusively used. Preferably, all machining manufacturing processes are dispensed with. It has been shown that a precise projectile optimized with regard to deformation characteristic can be provided if a slotted screwdriver blade is used for the cold-forming of the blank for the press head. Surprisingly, it has been shown that even classic conventional blade shapes, such as the SL-type, the PH-type, of the PZ-type are suitable for using the stamping tool according to the invention for the cold-forming of the blank.

Preferably, the method according to the invention is realized in that a tool according to the invention is used.

With regard to the tool according to the invention, it should be noted that, in a cross-sectional view, there can be an axis-symmetric gradient with relation to the axial direction of the tool between the bars of the blades of the screwdriver forming the slots in the blank. Between the inclined bars, there should be an angle greater than 45 and less than 80°, preferably between 50° and 70°, in particular, being about 60°.

Preferably, the press head according to the invention for forming the slots has three bars or exactly four bars, which serve to incorporate the slots radially extending from the central cavity into the intermediate and/or should be arranged at equidistant circumferential distances to each other. In the case of bars, the engaging edges for the formation of the slotted bases should be either rounded or flat, wherein the bars, inclined from a tip falling back with the central section of the tool, can extend radially outwards. It is clear that the angle of inclination should be the same for all bars, be it two, three, four or more. The bars are used to form the slots described above, the slot width of which can be adjusted according to the bar width of the tool. Preferably, the bar widths should be less than 2 mm with a calibre of 9 mm for example.

The blade comprises a flank surface arrangement between adjacent blades, which should be concave at least in the circumferential direction and/or in the axial direction when viewed as a whole. With the concave transition surfaces between the bars, the desired convex top side contours of the prong of the intermediate are formed, which leads to the intensified desired deformation and the associated energy reduction in the projectile according to the invention.

The known, in particular standardized test method mentioned above, in which the deformation behaviour of a projectile is to be analysed by firing it into a gelatinous mass (gelatine block), can be based on the following test procedures, both of which are to be regarded by reference here as part of the disclosure. On the one hand, the FBI protocol, "FBI Ammunition Protocol—Brass Fetcher Ballistic Testing," is referenced. In addition, the technical directive (TR), cartridge 9 mm×19, is reduced in pollutants, in particular, the 2009 status, the police, the states and the federal government. The editorial team is conducted by the Police Technical Institute (PT!) of the German Police College (DHPol). The procedures indicated there for providing an ideal test environment should be part of the disclosure of the present documents.

Further characteristics, advantages and features of the invention are illustrated by the following description of preferred embodiments of the invention on the basis of the enclosed drawings which show in the following:

FIG. 1 a perspective view of an intermediate of the invention for manufacturing a projectile according to the invention in accordance with a preferred embodiment;

FIG. 2 a top view of the intermediate in accordance with FIG. 1;

FIG. 3 a cross-sectional view along the section line III-III in accordance with FIG. 2;

FIG. 4 a cross-sectional view of the intermediate along section line IV-IV in accordance with FIG. 2;

FIG. 5 a lateral view of a projectile according to the invention in a preferred embodiment based on the intermediate in accordance with FIGS. 1 to 4;

FIG. 6 a top view of the projectile in accordance with FIG. 5;

FIG. 7 a cross-sectional view of the projectile in accordance with FIGS. 5 and 6;

FIG. 8 a perspective view of the projectile in accordance with FIGS. 5 to 7;

FIG. 1.1 a perspective view of an intermediate of the invention for manufacturing a projectile according to the invention in accordance with a further preferred embodiment;

FIG. 2.1 a top view of the intermediate in accordance with FIG. 1.1

Figure 10:
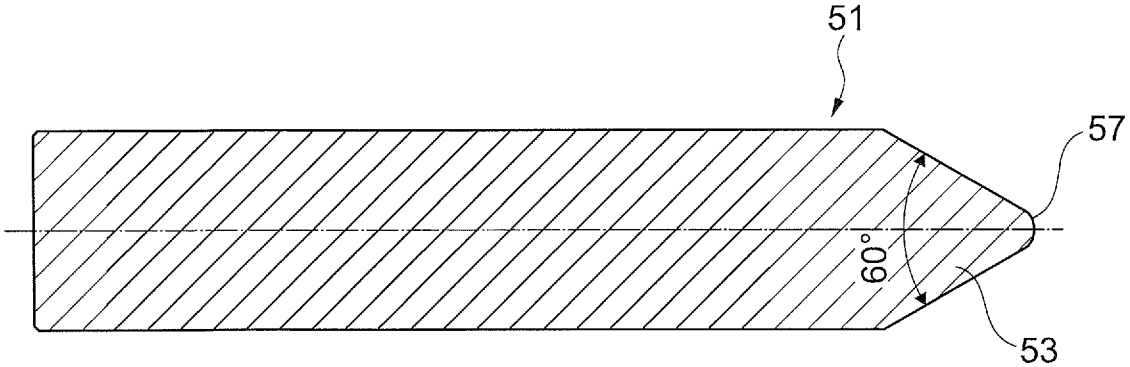
Figure 12:
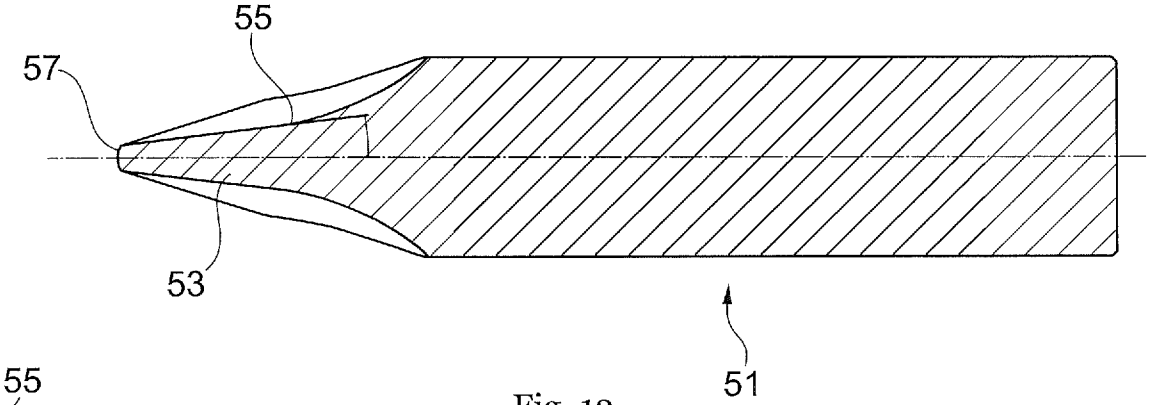
Figure 9:
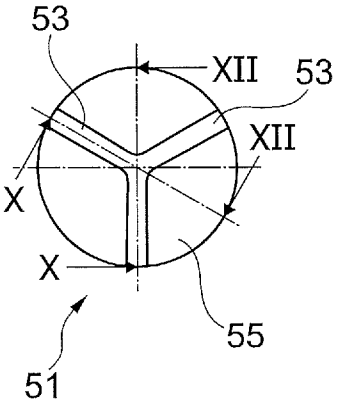
Figure 11:
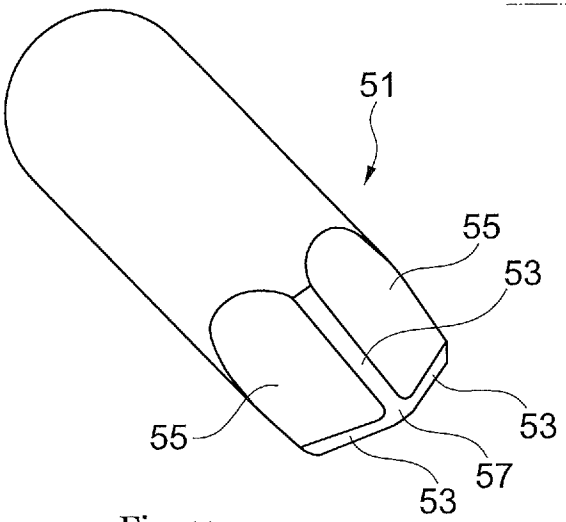
Figure 13:
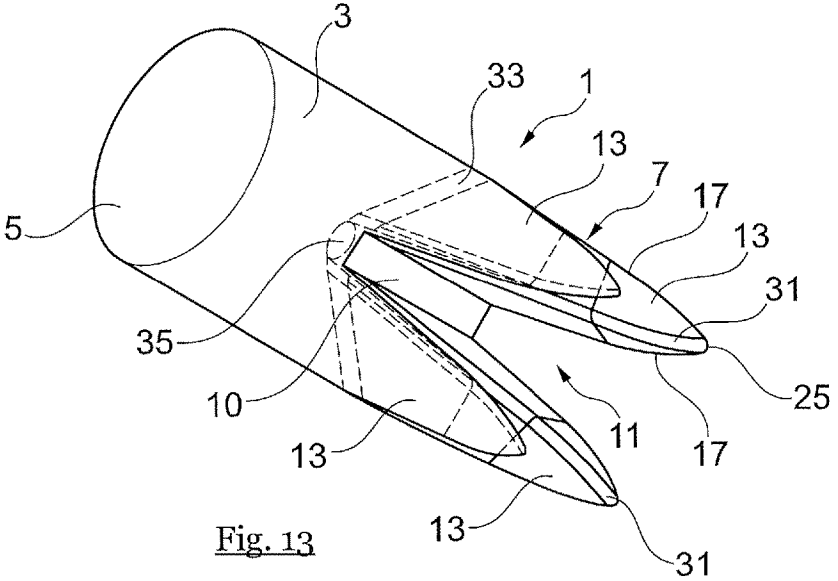
Figure 14:
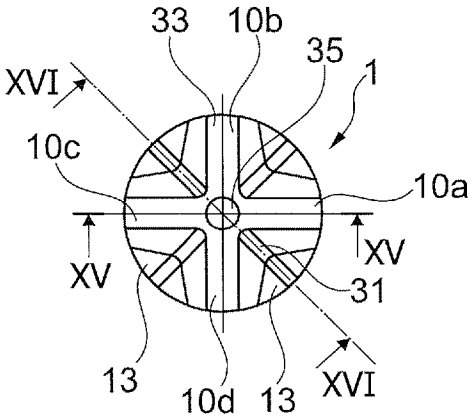
Figure 15:
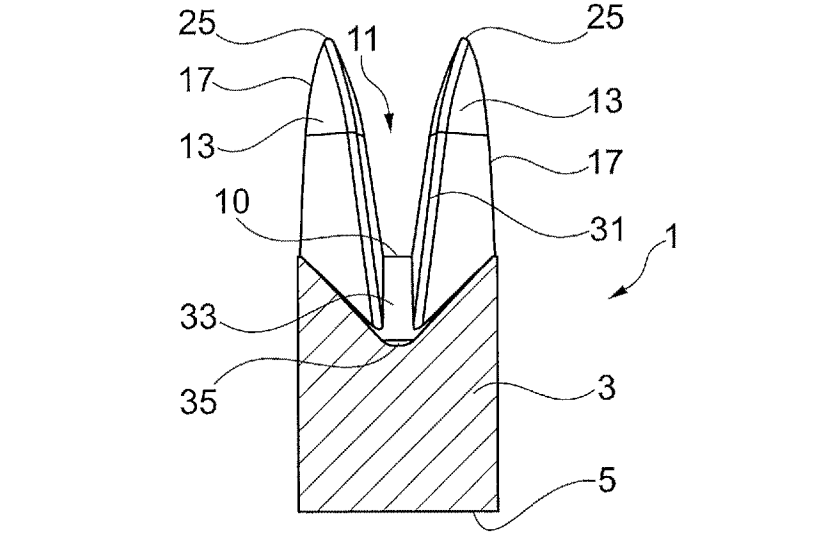
Figure 16:
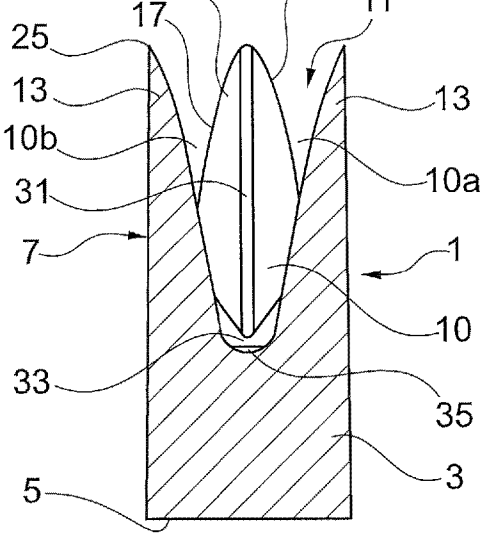
Figure 17:
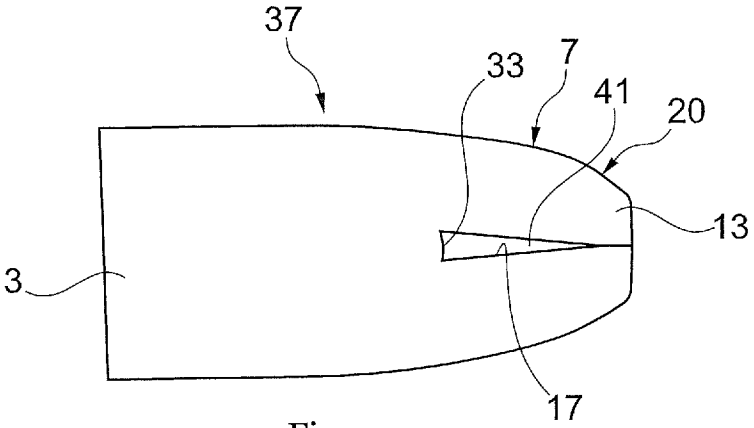
Figure 18:
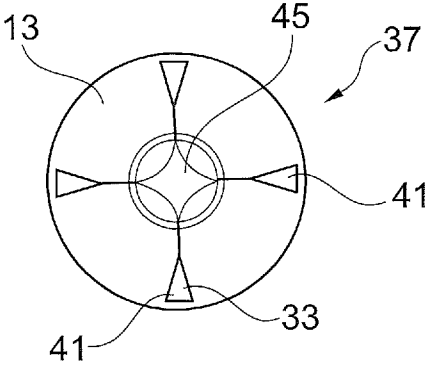
Figure 19:
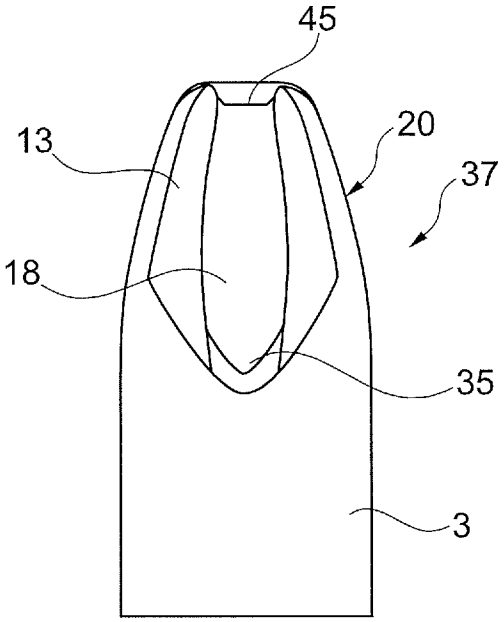
Figure 20:
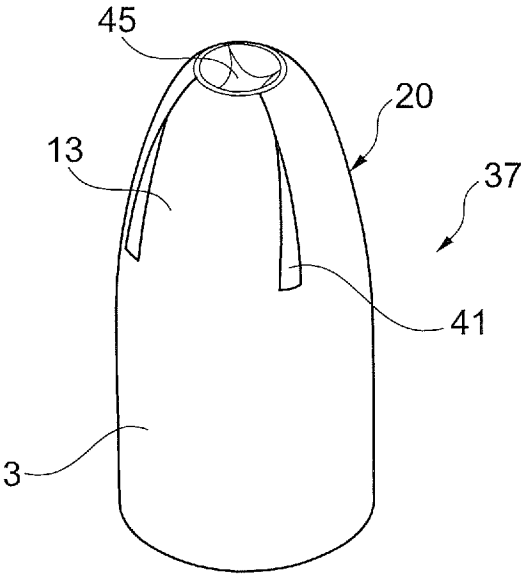
Figure 21:
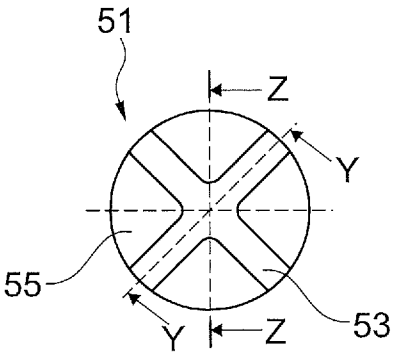

FIG. 3.1 a cross-sectional view along section line III-III in accordance with FIG. 2.1;

FIG. 4.1 a cross-sectional view of the intermediate along section lines IV-IV to FIG. 2.1;

FIG. 5.1 a top view of a projectile according to the invention in a further preferred embodiment based on the intermediate according to the invention in accordance with FIGS. 1.1 to 4.1;

FIG. 6.1 a cross-sectional view of the projectile along section line VI-VI in accordance with FIG. 5.1; and FIG. 7.1 a perspective view of the projectile in accordance with the FIGS. 5.1 and 6.1;

FIG. 9 a top view of a tool according to the invention for manufacturing the intermediate in accordance with FIGS. 1 to 4 or the projectile in accordance with FIGS. 5 to 8;

FIG. 10 a cross-sectional view of the tool along the section line X-X;

FIG. 11 a perspective view of the tool in accordance with FIGS. 9 and 10;

FIG. 12 a cross-sectional view of the tool along the section line XII-XII in accordance with FIG. 9;

FIG. 13 a perspective view of an intermediate according to the invention in a further preferred embodiment;

FIG. 14 a top view of the intermediate in accordance with FIG. 13;

FIG. 15 a cross-sectional view of the intermediate along the section line XV-XV to FIG. 14;

FIG. 16 a cross-sectional view of the intermediate along the section line XVI-XVI to FIG. 14;

FIG. 17 a lateral view of a projectile according to the invention in a further preferred embodiment on the basis of the intermediate in accordance with FIGS. 13 to 16;

FIG. 18 a top view on the projectile according to the invention in accordance with FIG. 17;

FIG. 19 a cross-sectional view of the projectile in accordance with FIGS. 17 and 18;

FIG. 20 a perspective view of the projectile in accordance with FIGS. 17 to 19;

FIG. 21 a top view of a tool according to the invention for manufacturing the intermediate according to the invention in accordance with FIGS. 13 to 16 of the projectile in accordance with FIGS. 17 to 20 in a further embodiment according to the invention.

Figure 22:
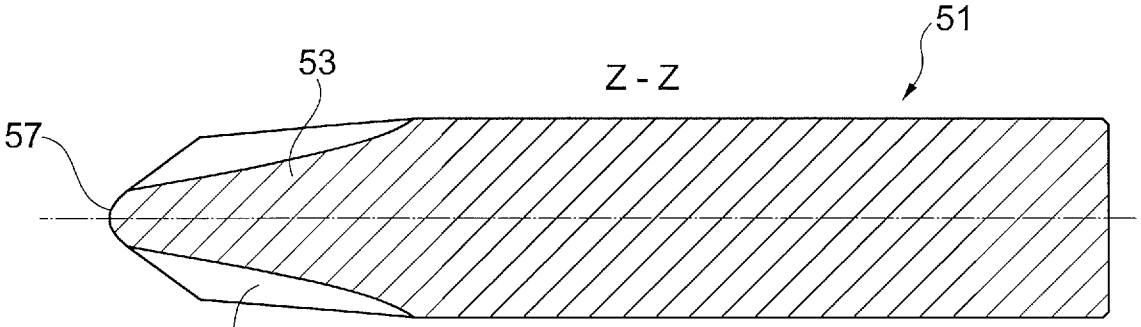
Figure 24:
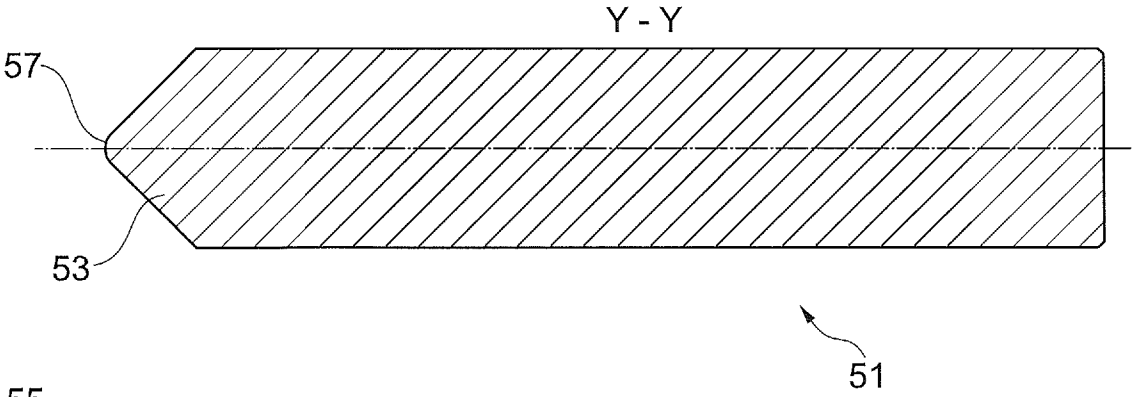
Figure 23:
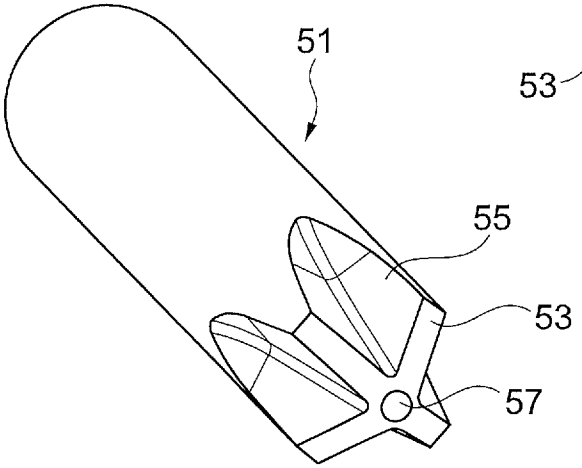
Figure 26:
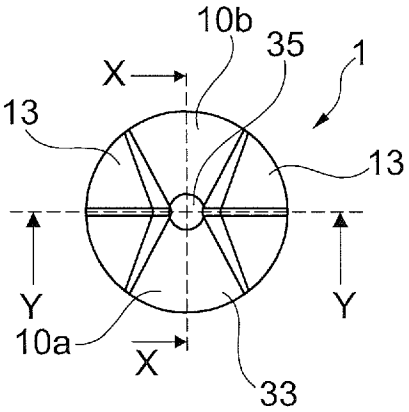
Figure 28:
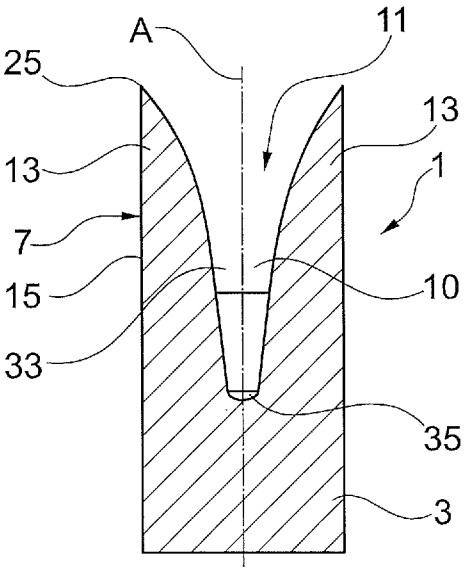
Figure 25:
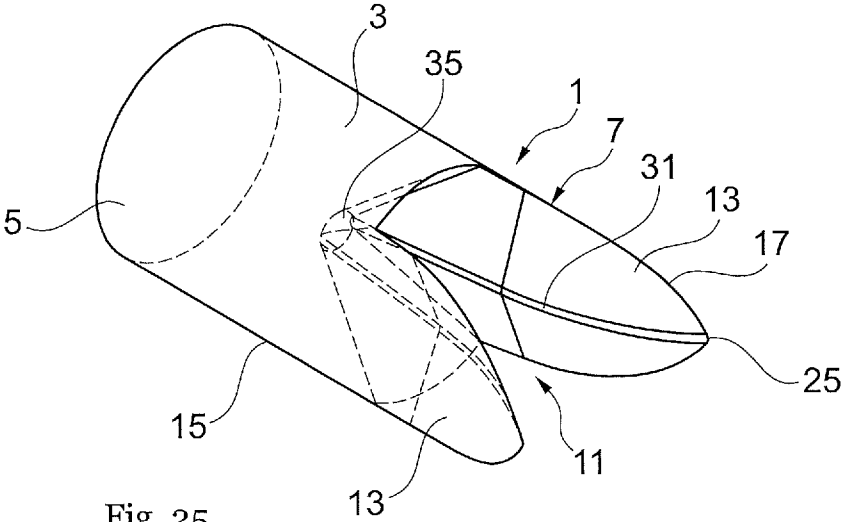
Figure 27:
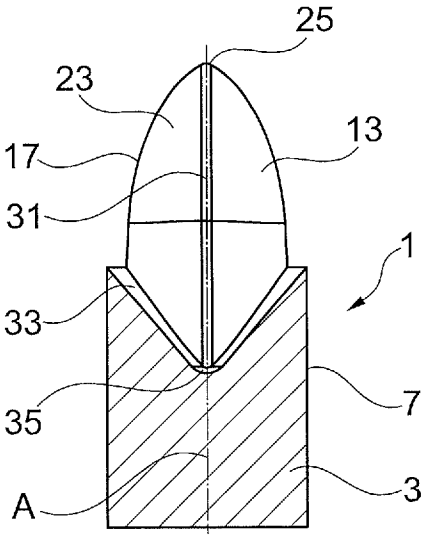
Figure 34:
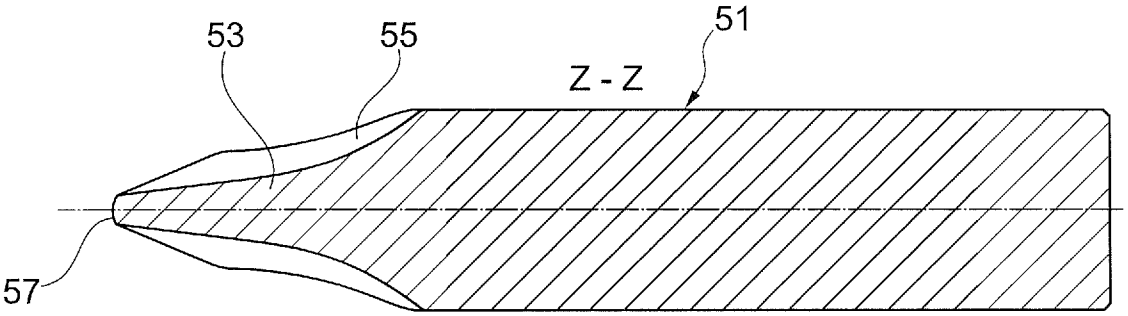
Figure 36:
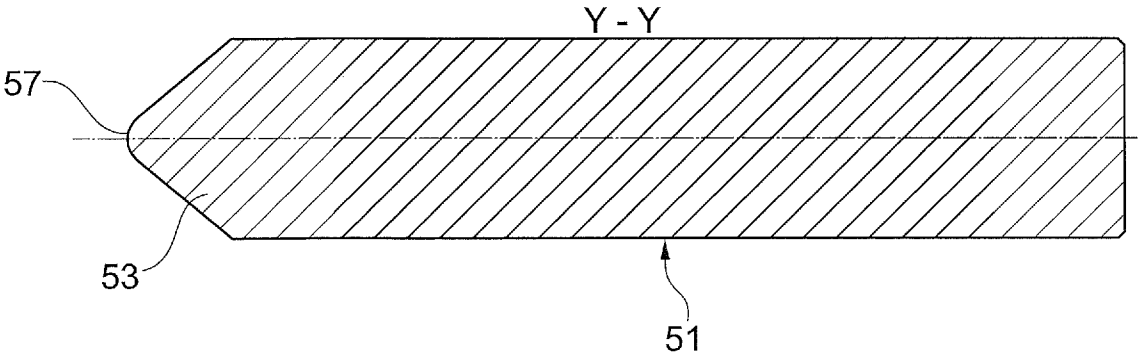
Figure 33:
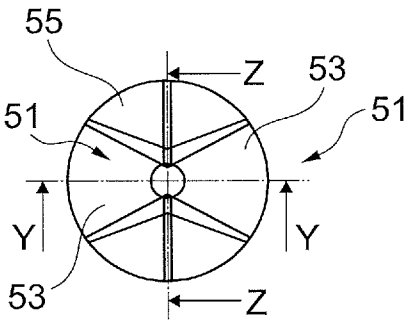
Figure 35:
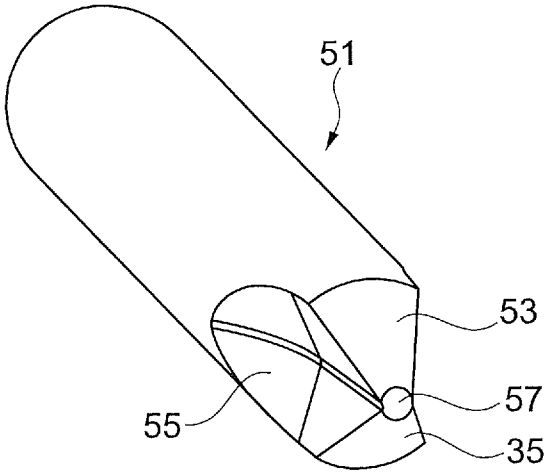
Figure 41:
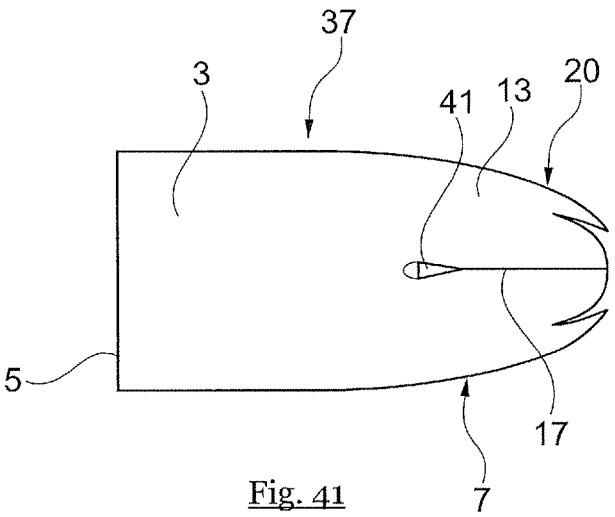
Figure 42:
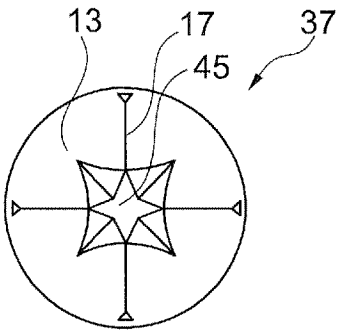
Figure 43:
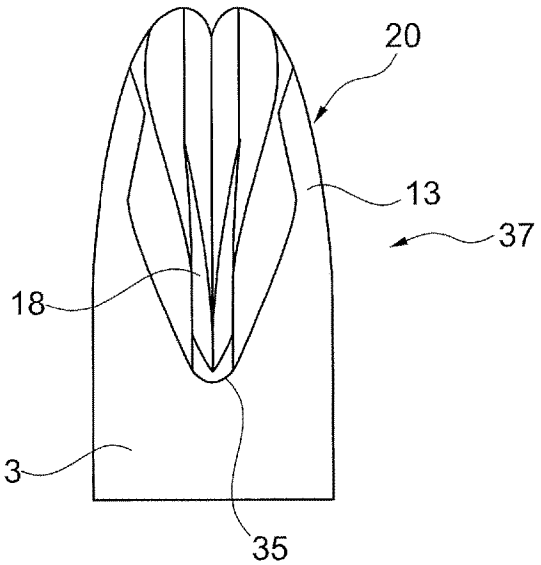
Figure 44:
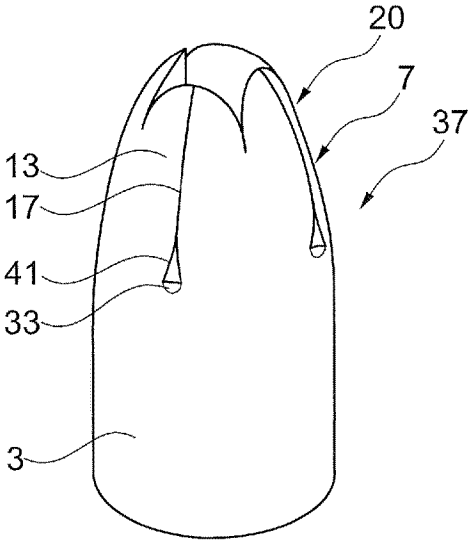
Figure 46:
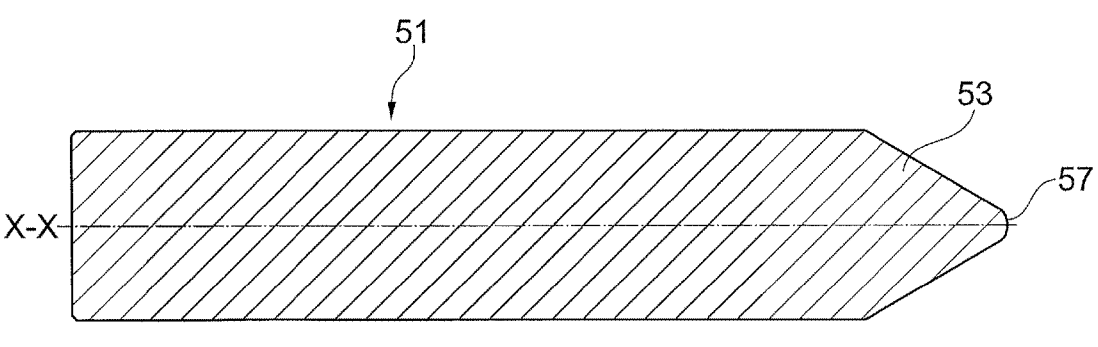
Figure 48:
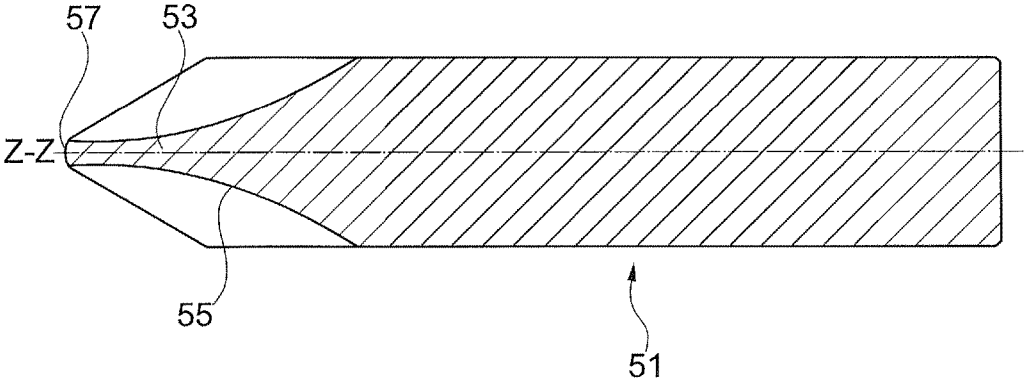
Figure 45:
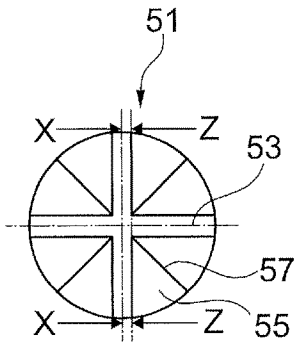
Figure 47:
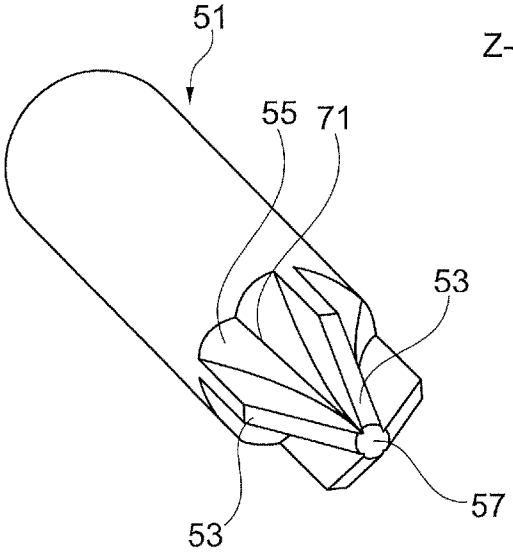
Figure 49:
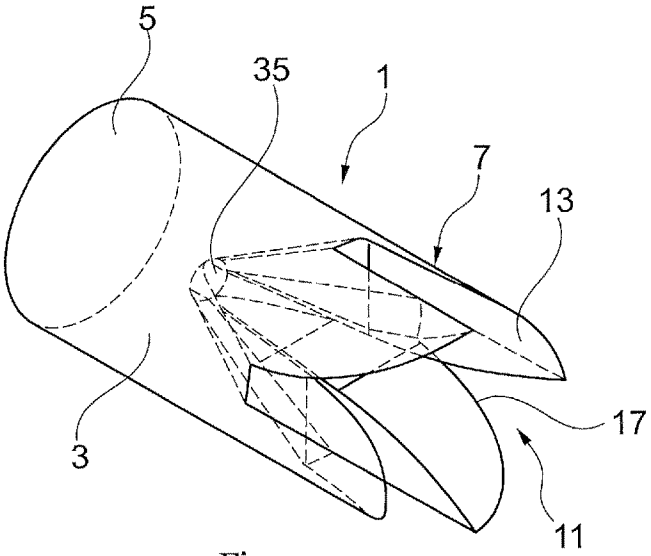
Figure 50:
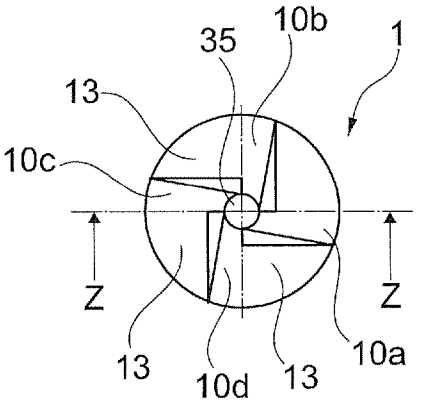
Figure 51:
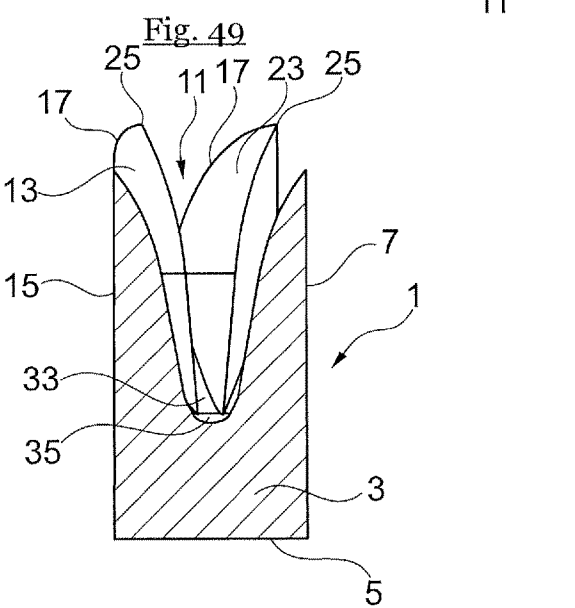
Figure 52:
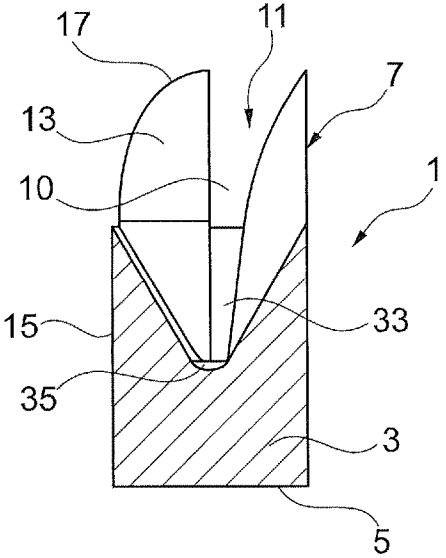
Figure 54:
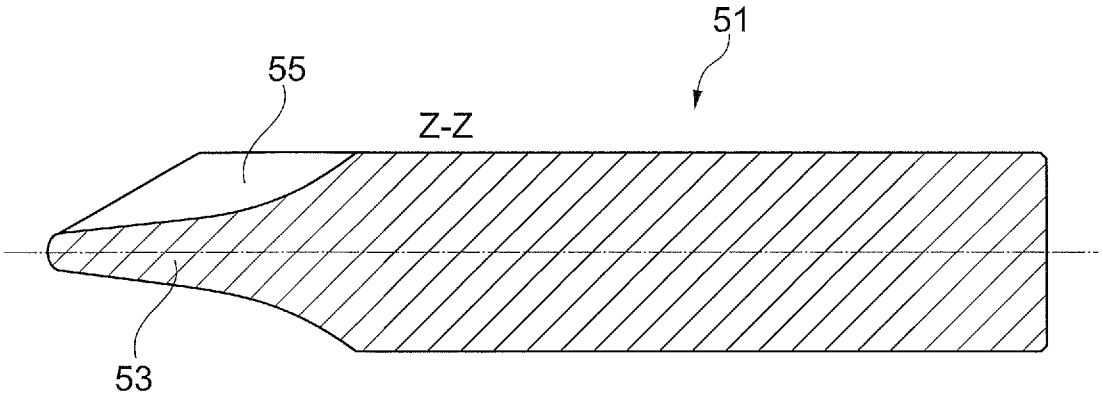
Figure 53:
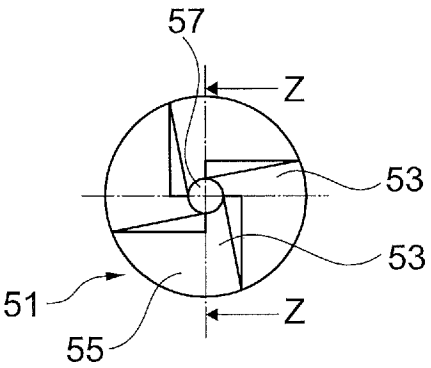
Figure 55:
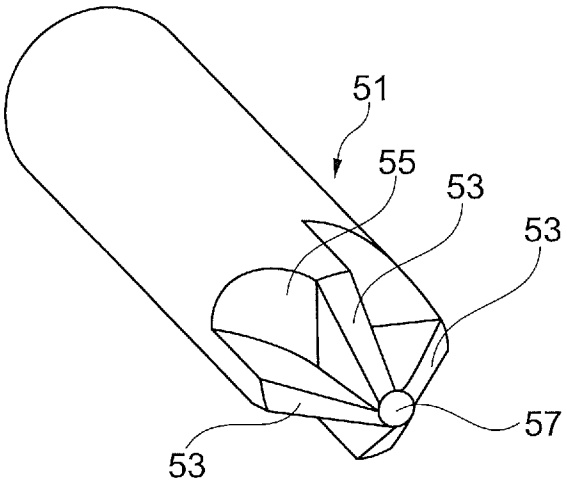
Figure 57:
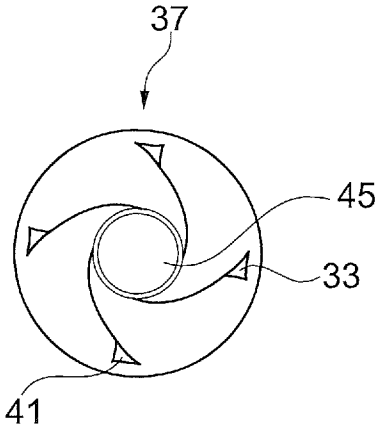
Figure 59:
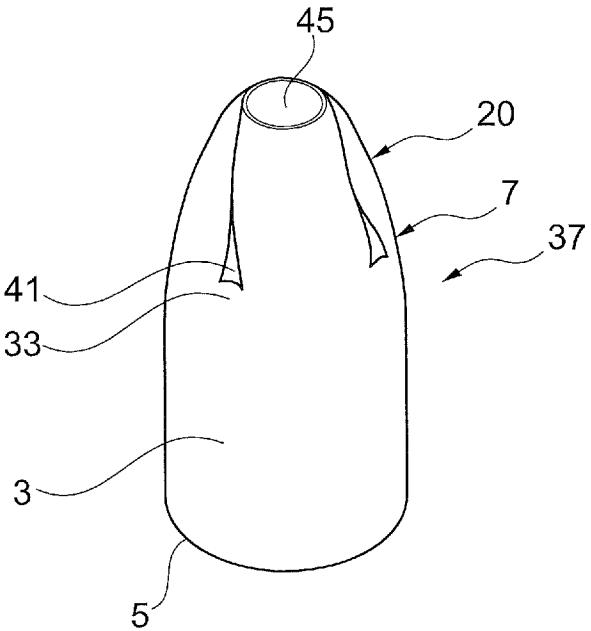
Figure 56:
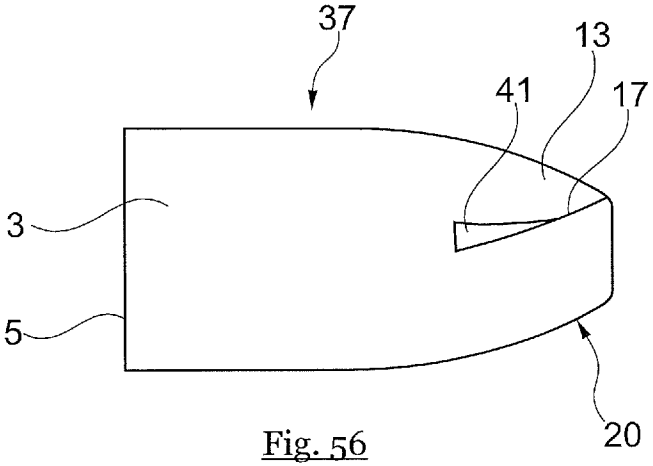
Figure 58:
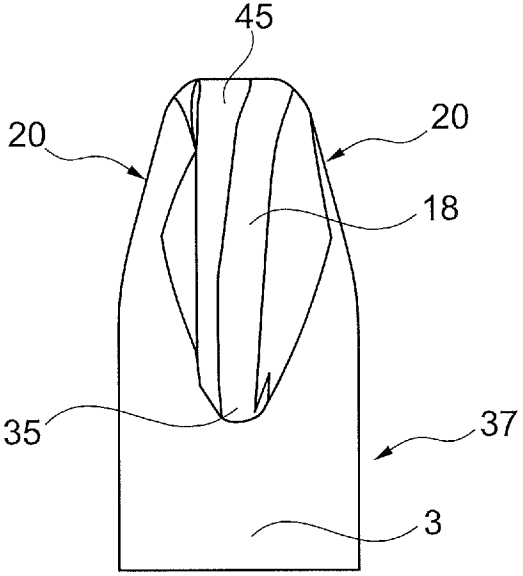
Figure 61:
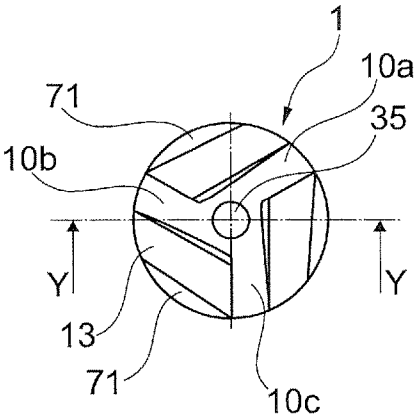
Figure 63:
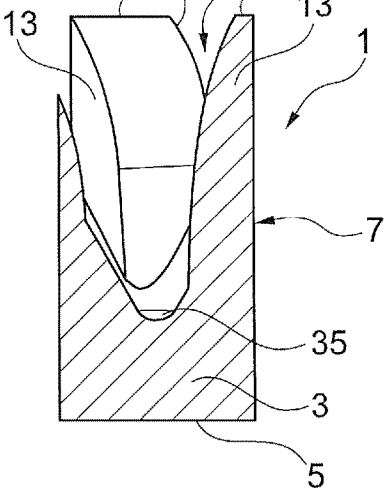
Figure 60:
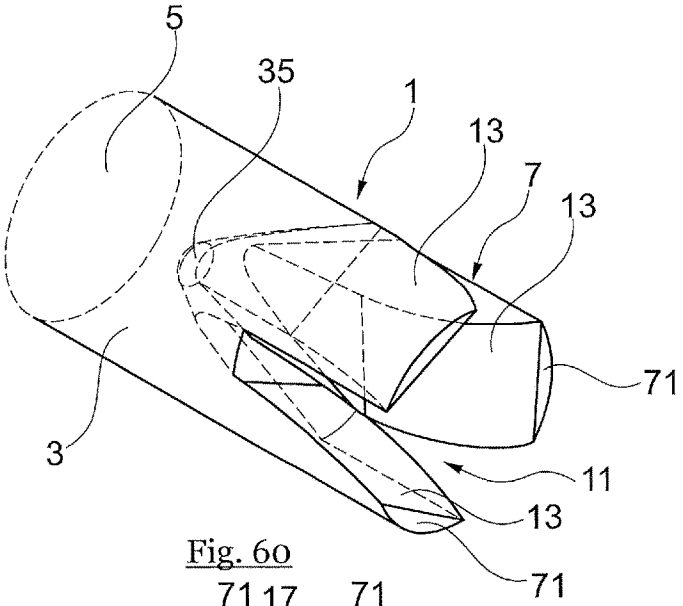
Figure 62:
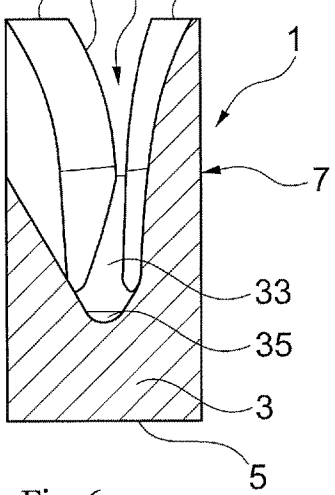
Figure 65:
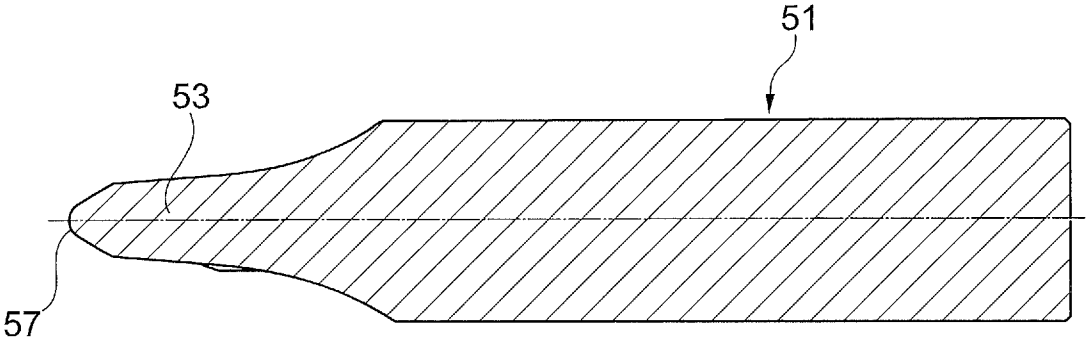
Figure 67:
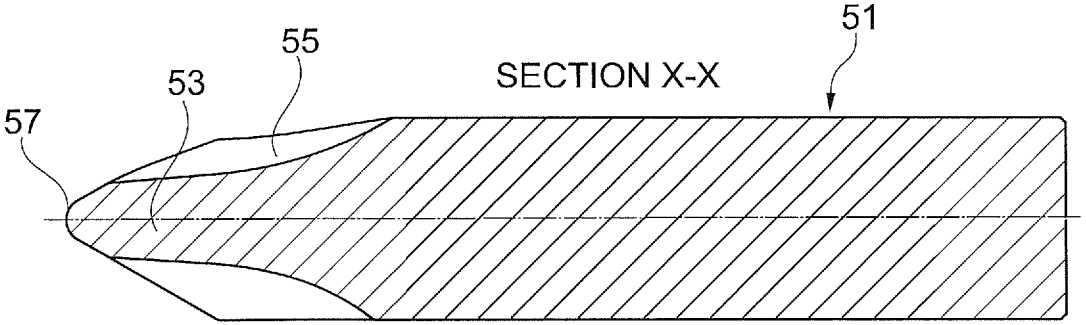
Figure 64:
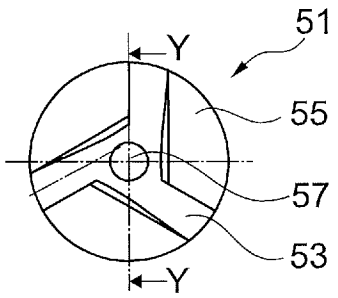
Figure 66:
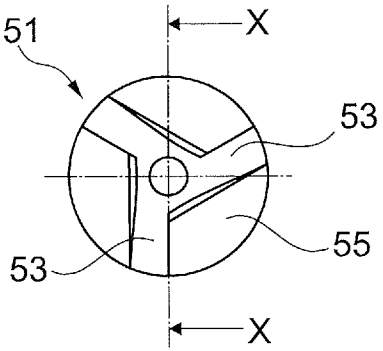
Figure 68:
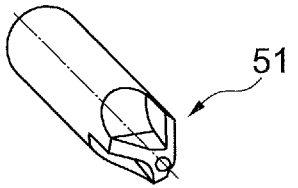
Figure 70:
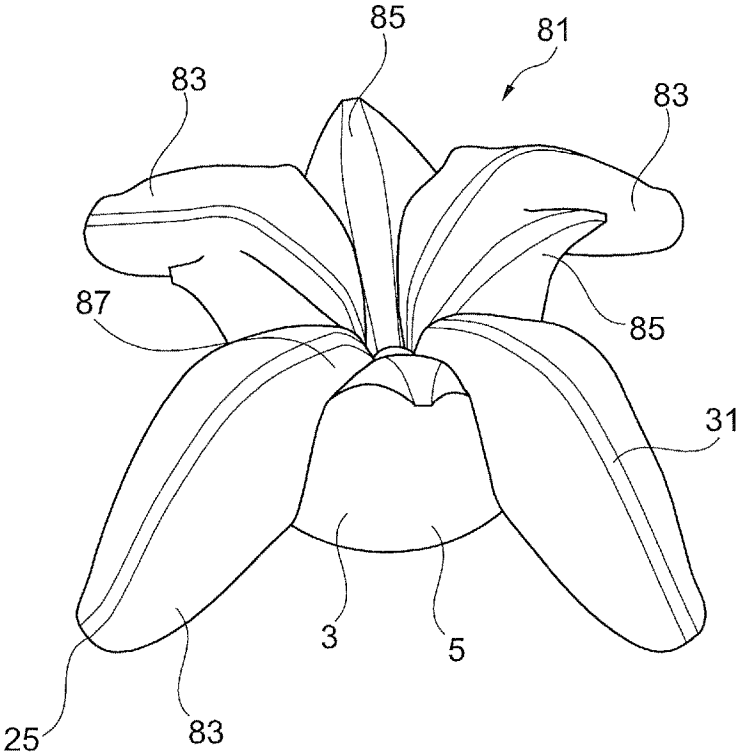
Figure 69:
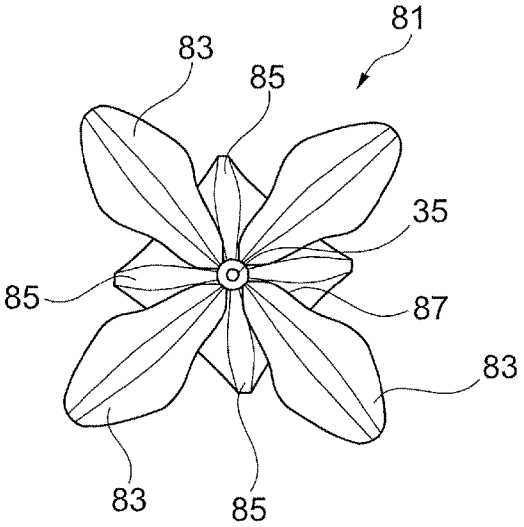
Figure 71:
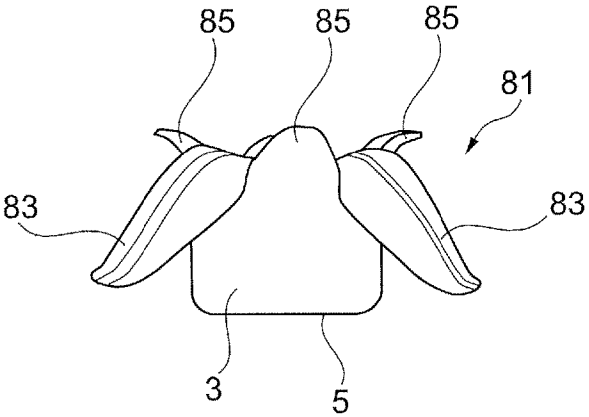
Figures 72, 73, 74, 75:
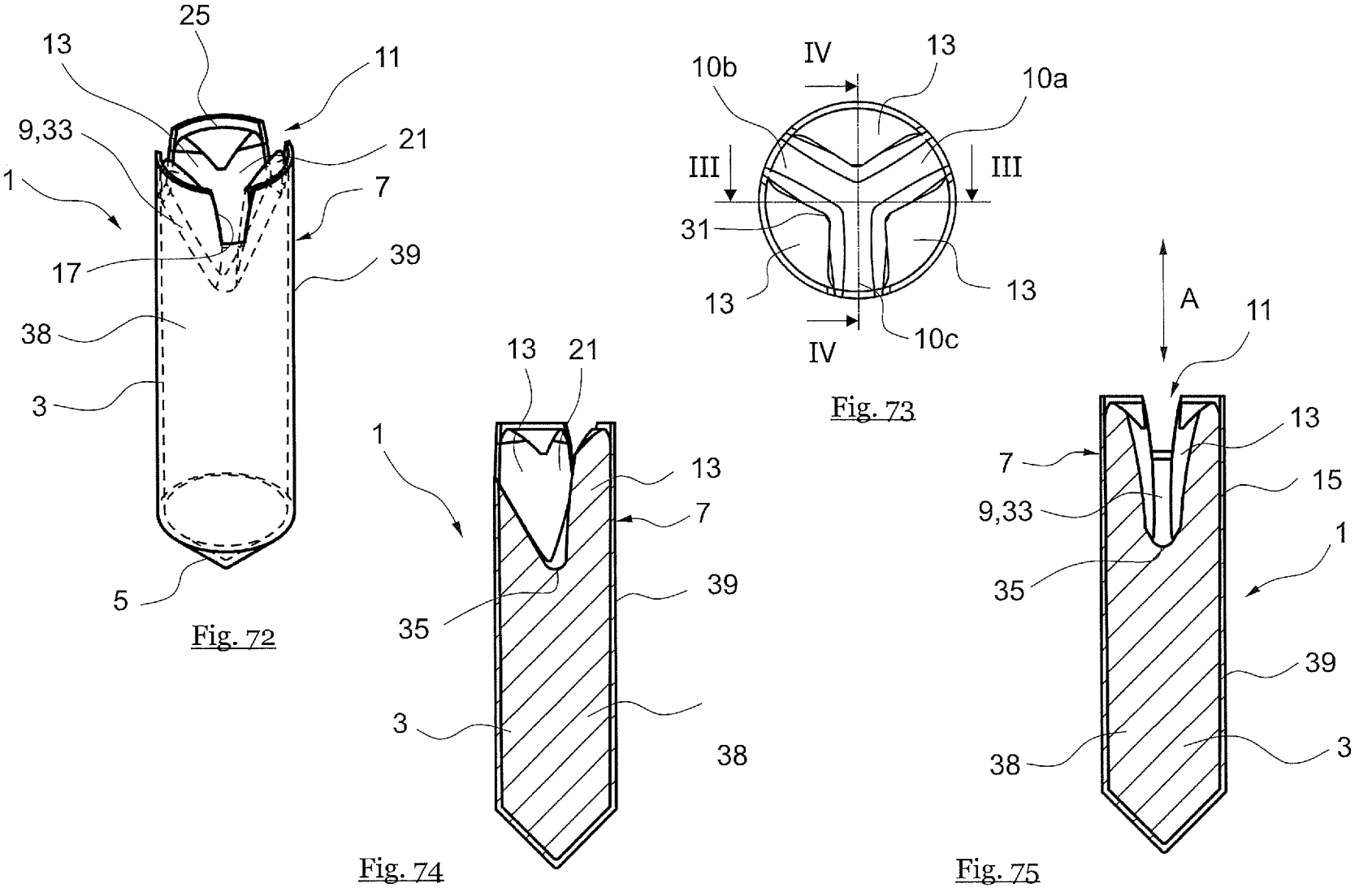
Figure 77:
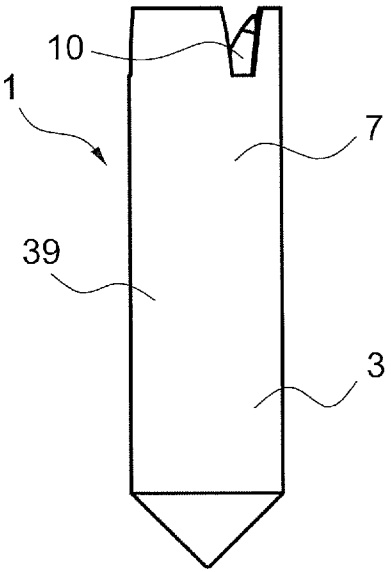
Figure 76:
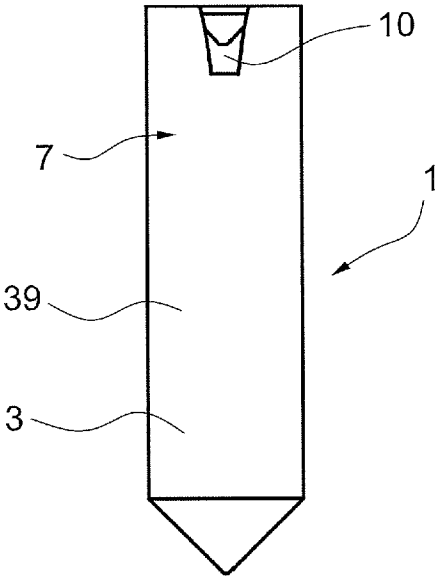
Figure 79:
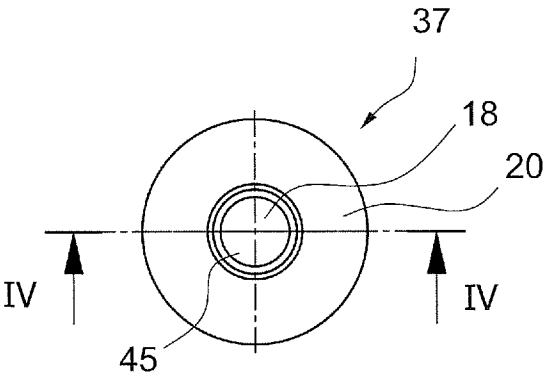
Figure 78:
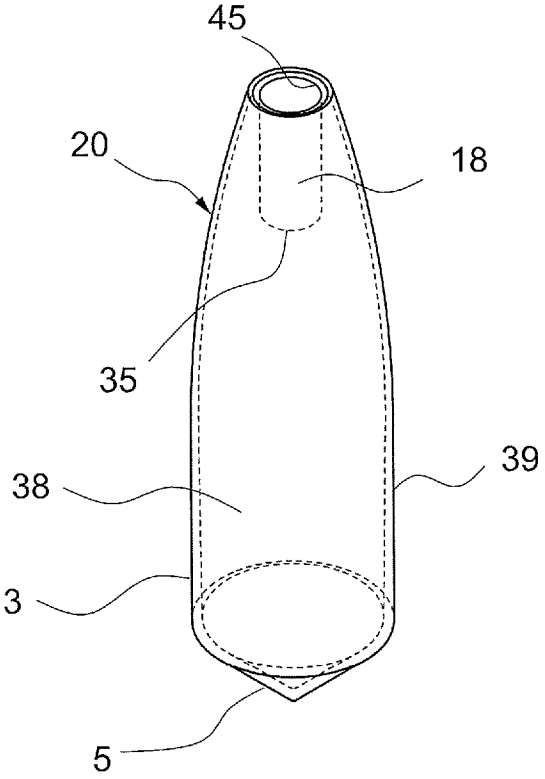
Figure 82:
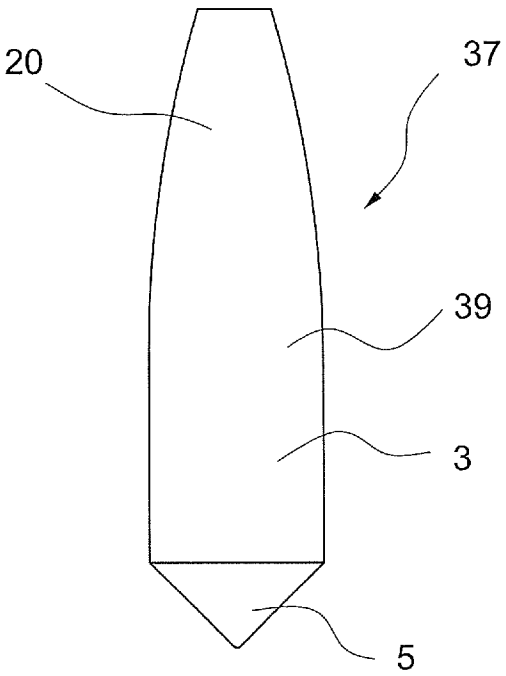
Figure 81:
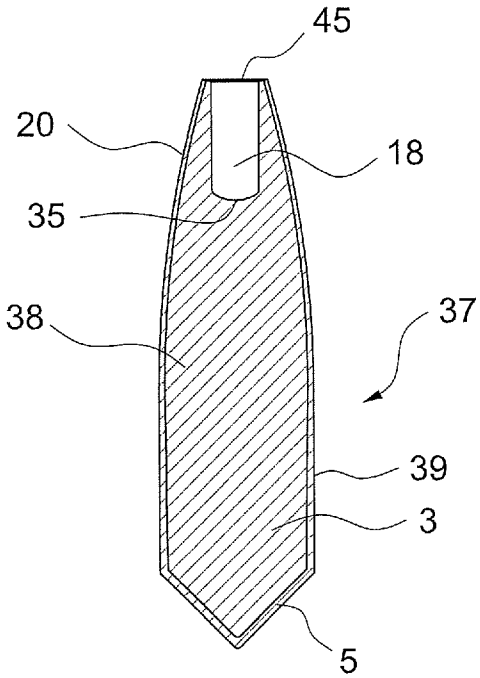
Figure 80:
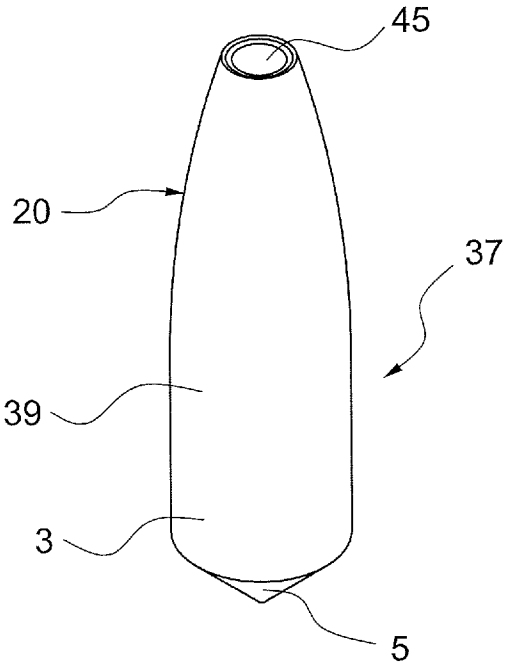
Figures 83, 84, 85, 86:
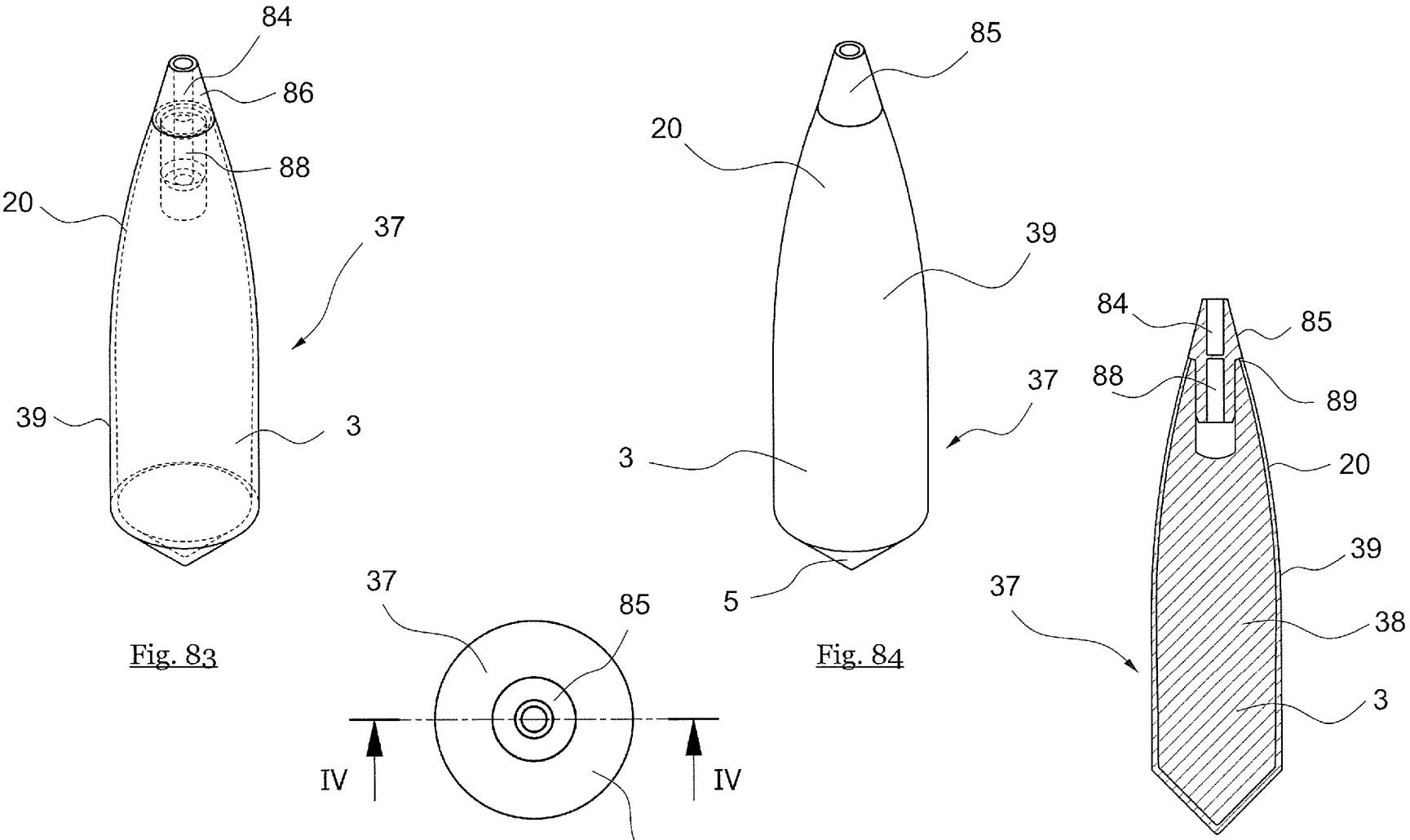
Figure 87:
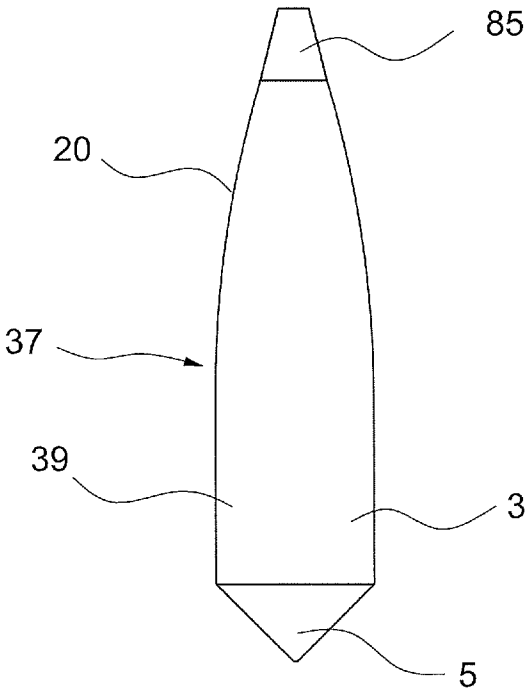
Figures 88, 89, 90, 91:
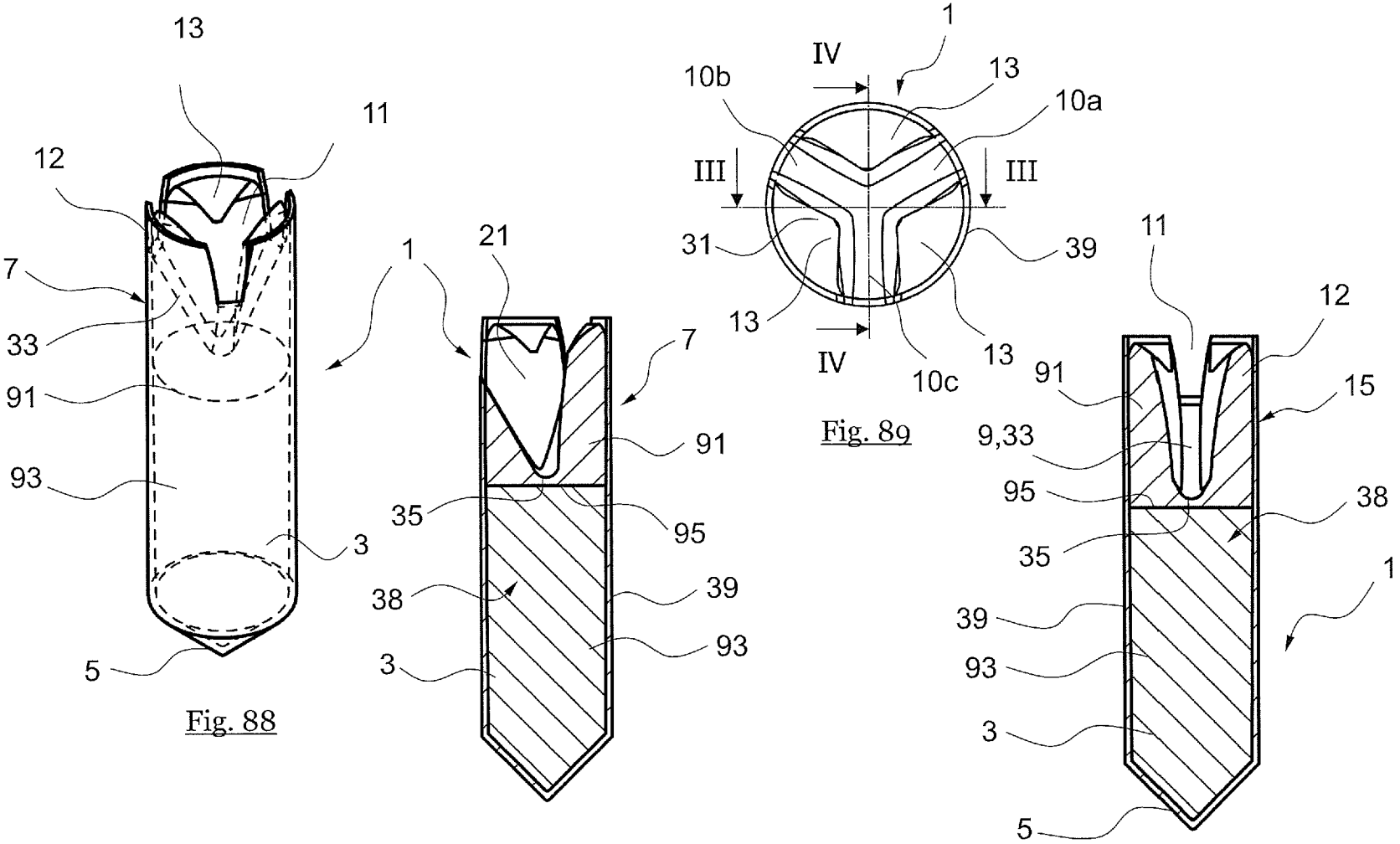
Figure 93:
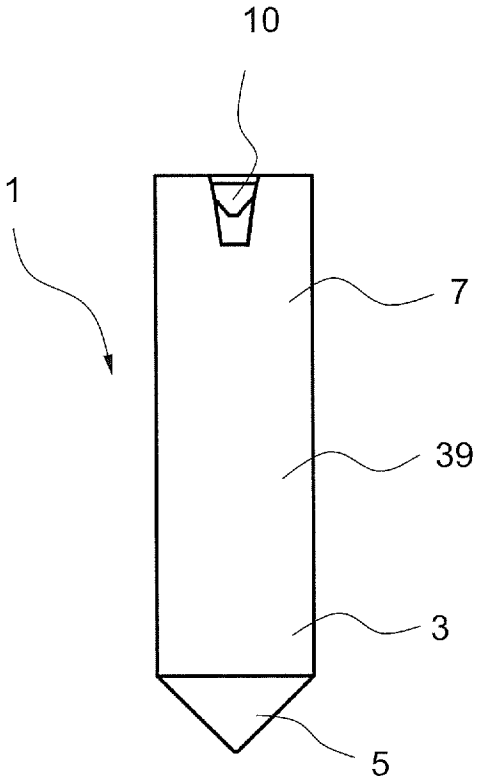
Figure 92:
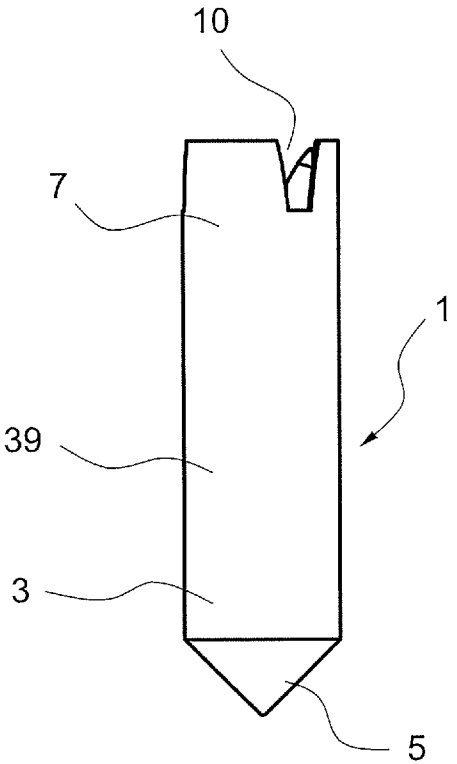
Figure 95:
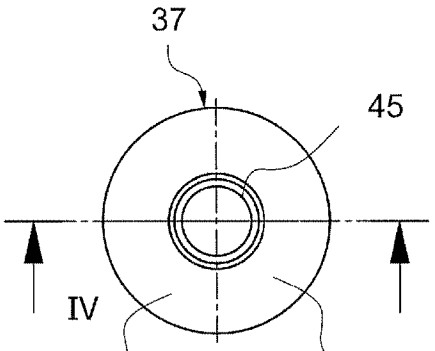
Figure 97:
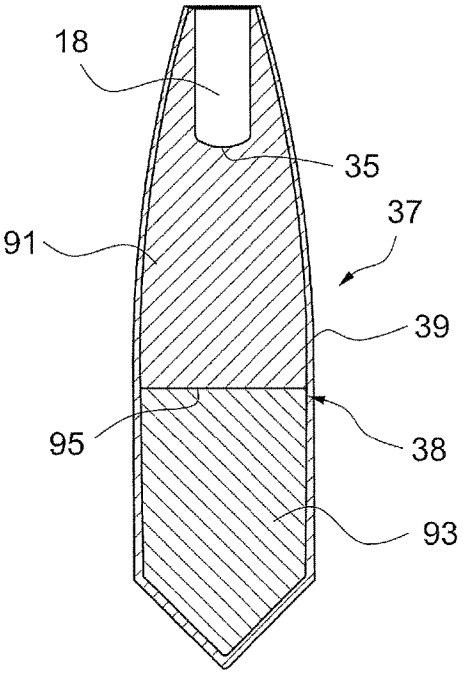
Figure 96:
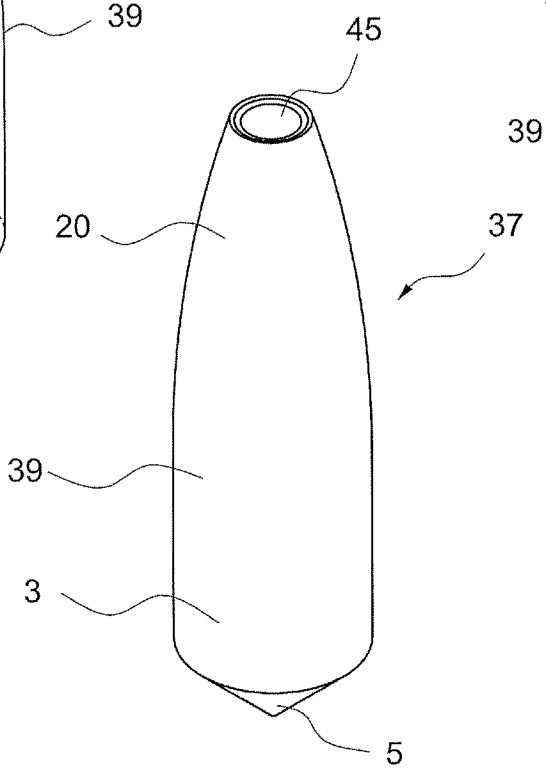
Figure 94:
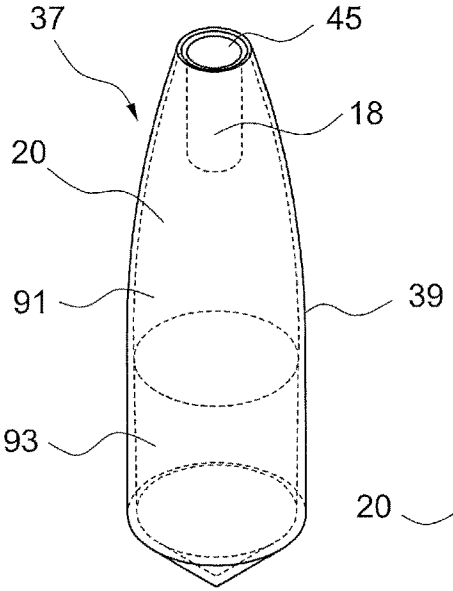
Figure 99:
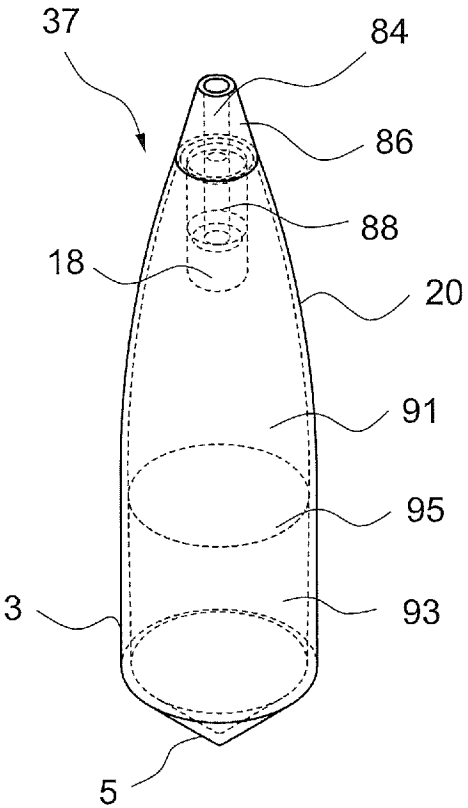
Figure 98:
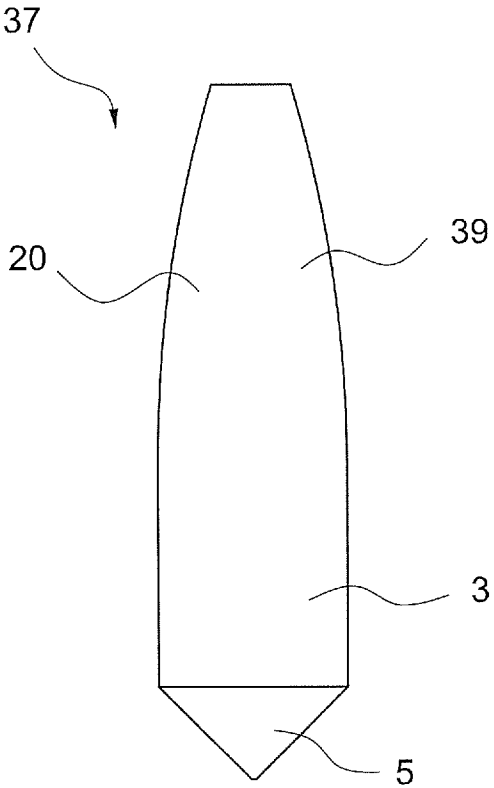
Figures 100, 101, 102, 103:
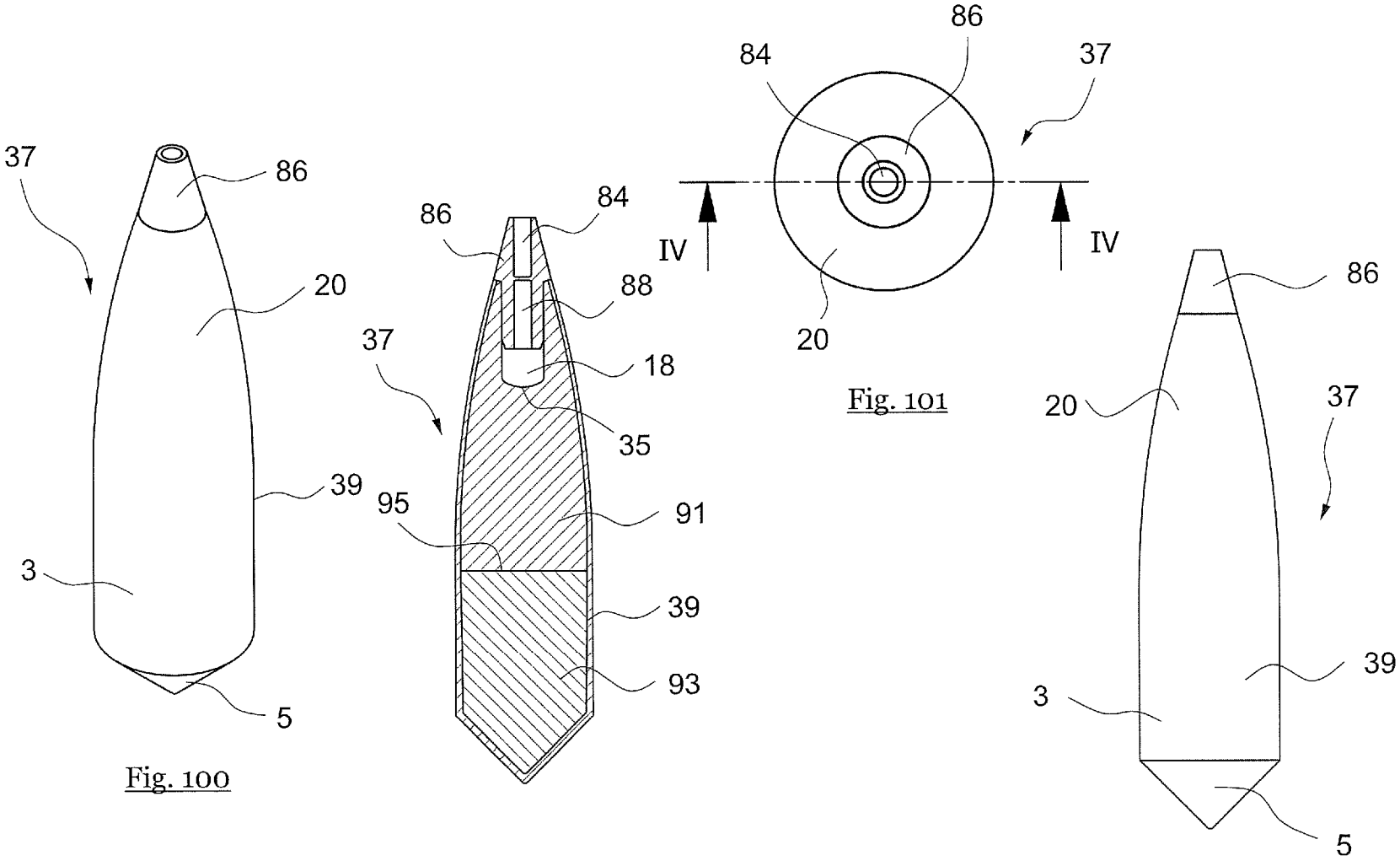
Figure 107:
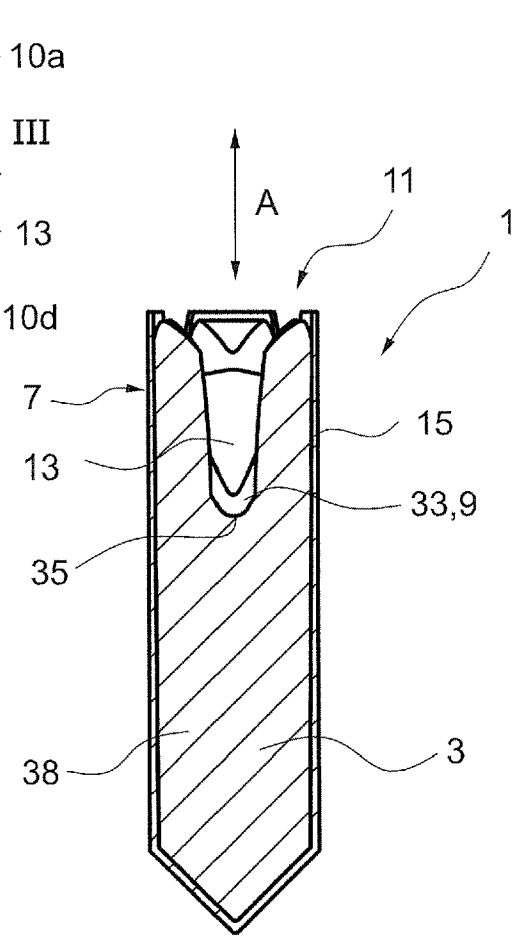
Figure 105:
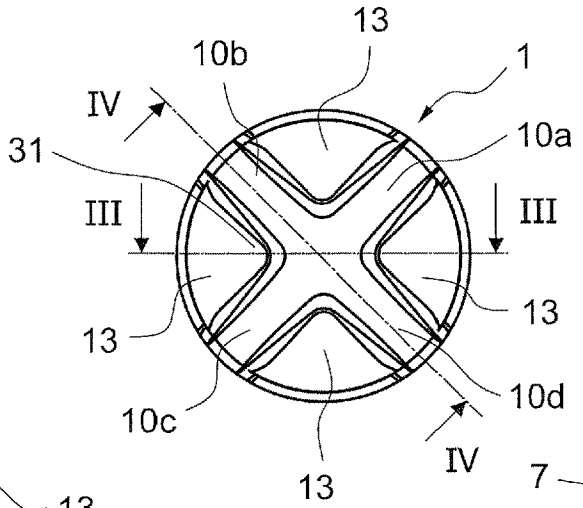
Figure 106:
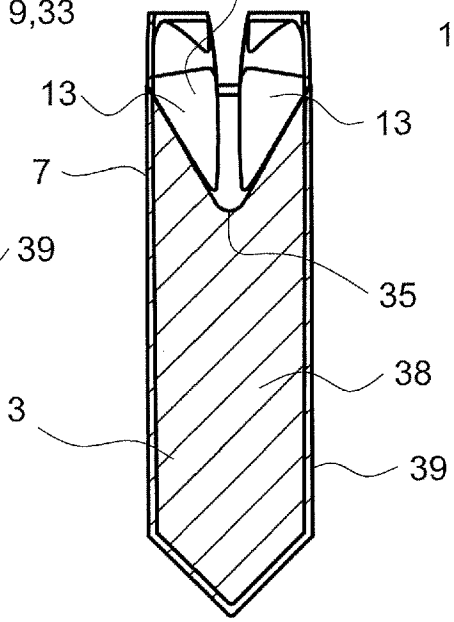
Figure 104:
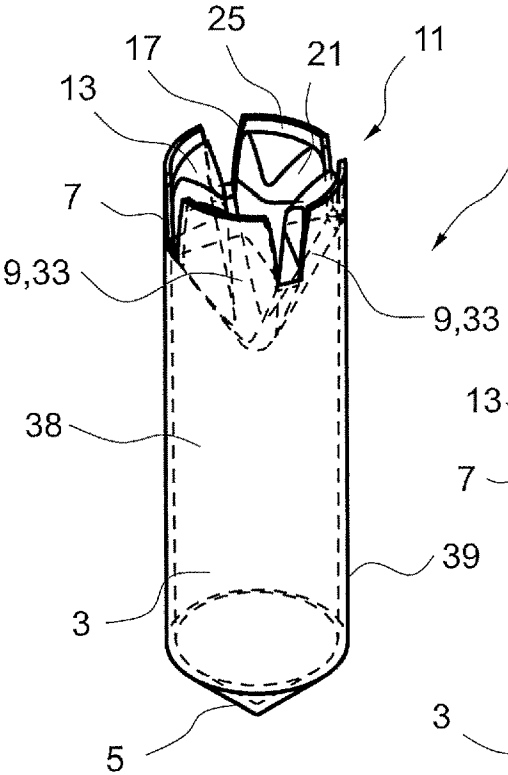
Figure 109:
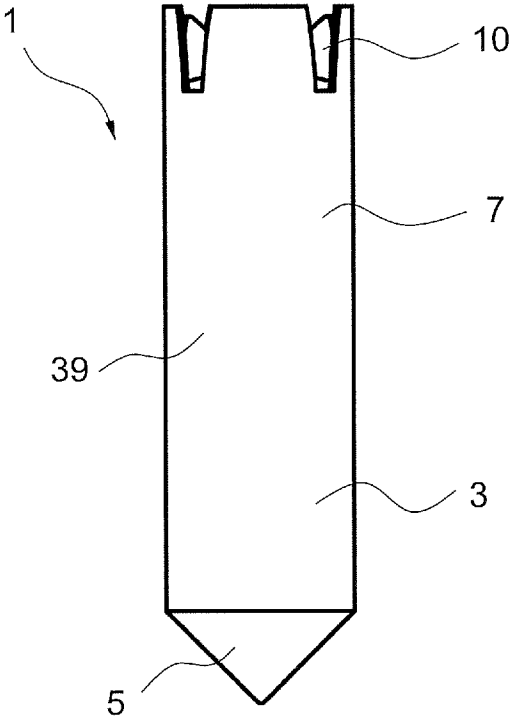
Figure 108:
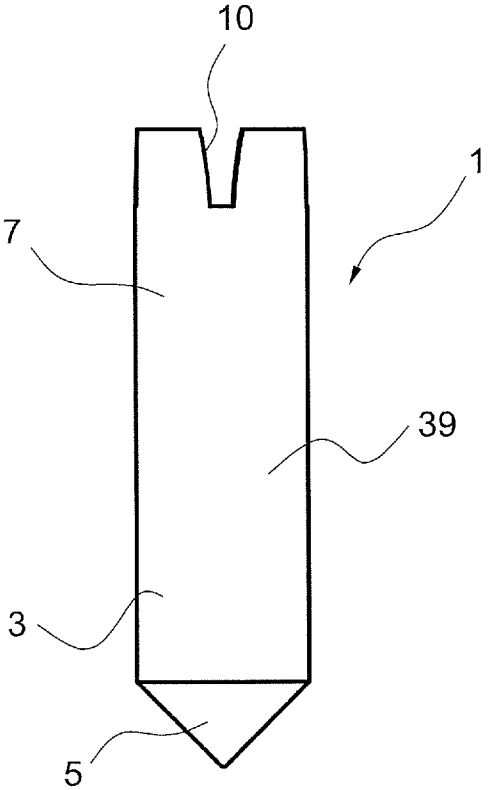
Figure 111:
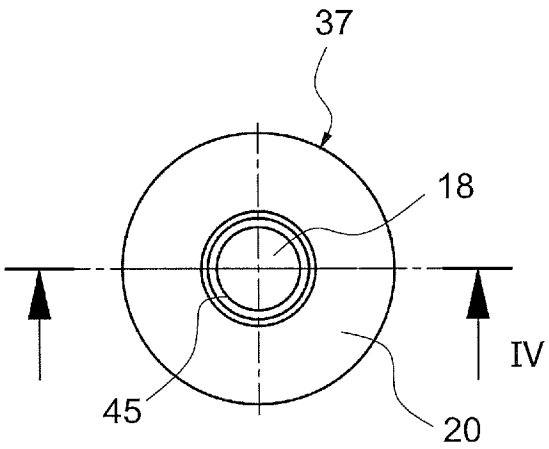
Figure 110:
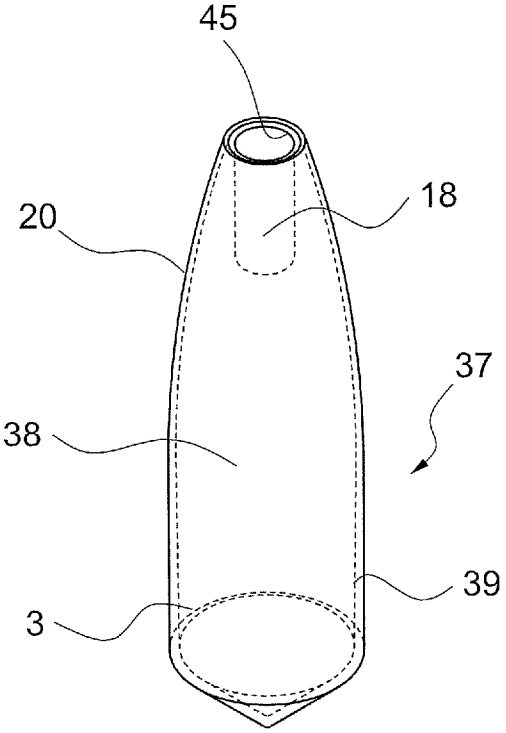
Figures 112, 113, 114, 115:
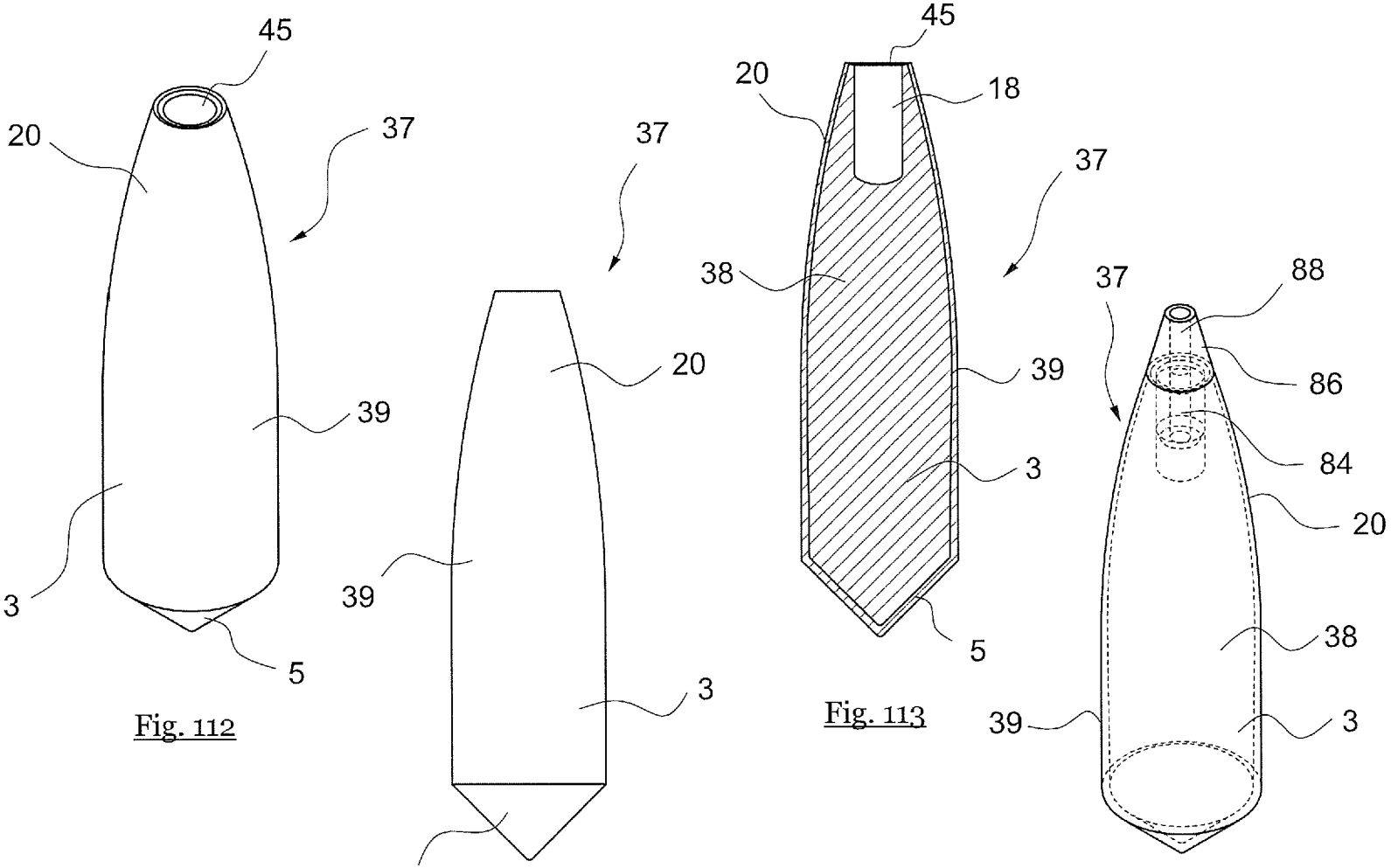
Figures 116, 117, 118, 119:
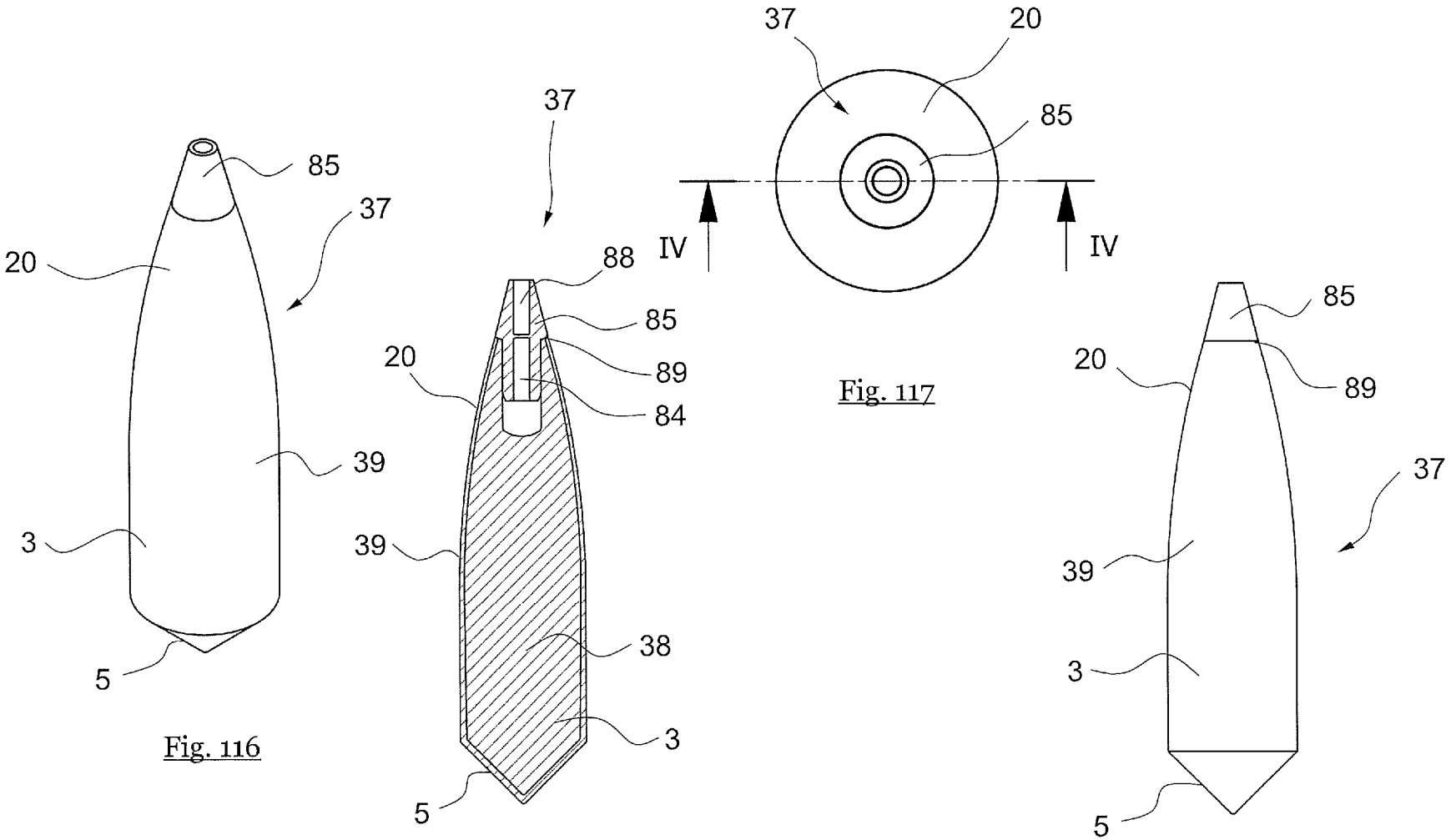
Figure 123:
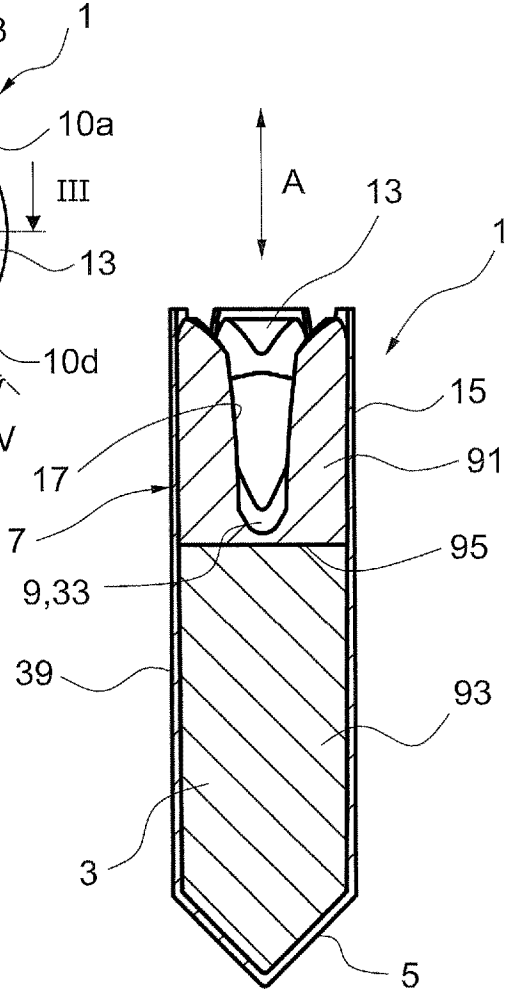
Figure 121:
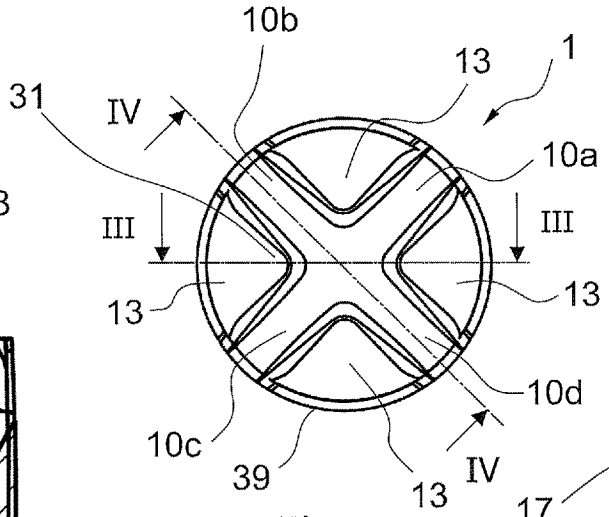
Figure 122:
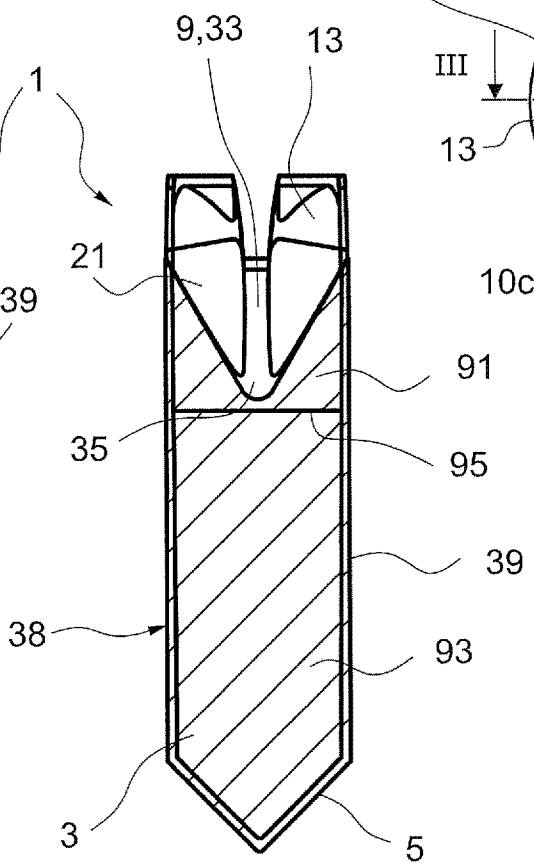
Figure 120:
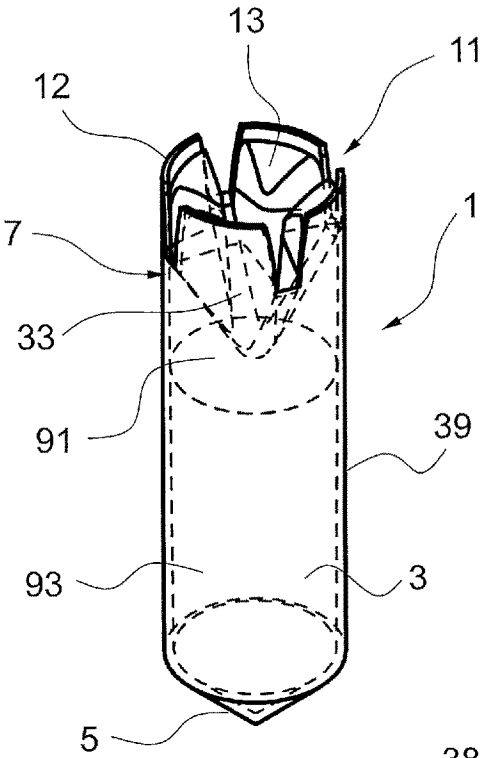
Figure 125:
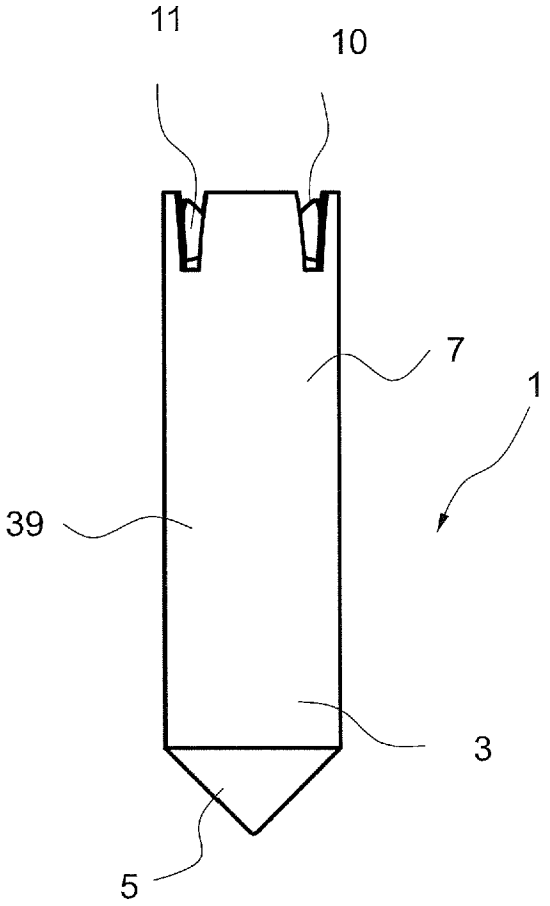
Figure 124:
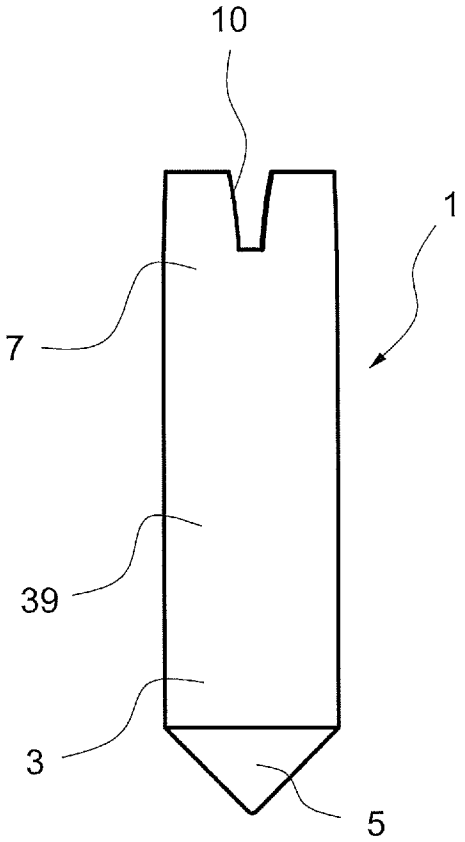
Figure 127:
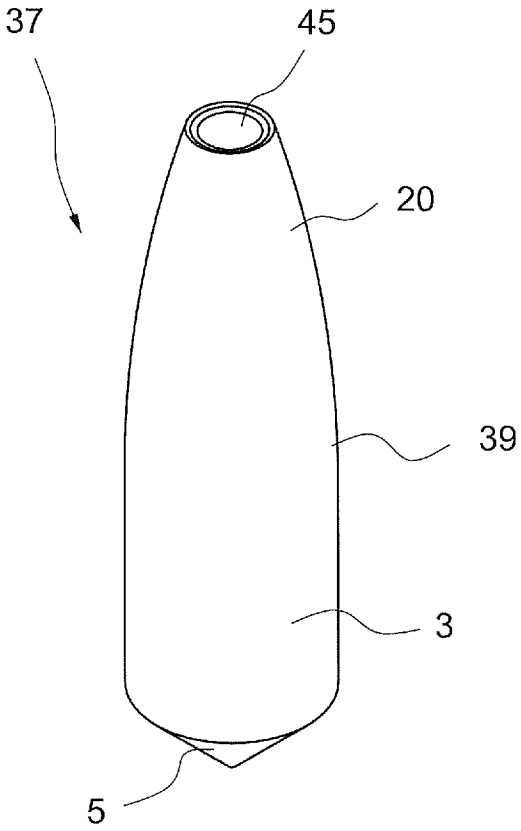
Figure 126:
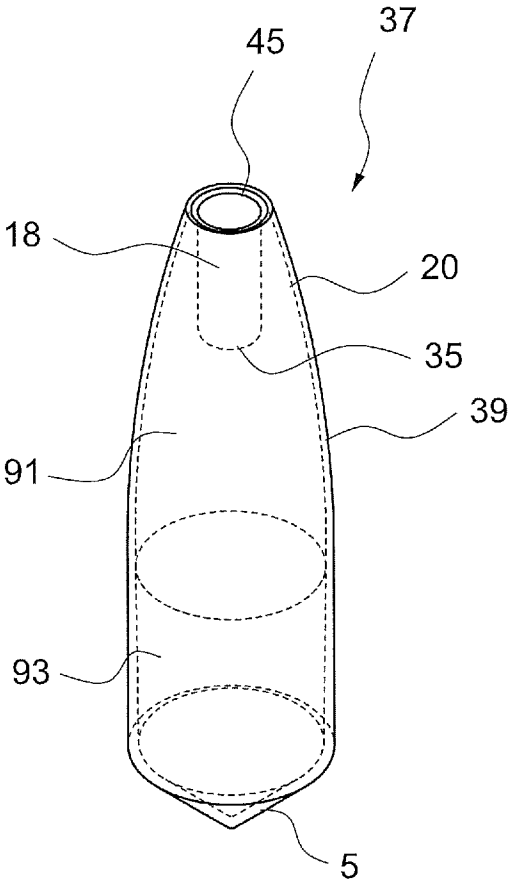
Figure 128:
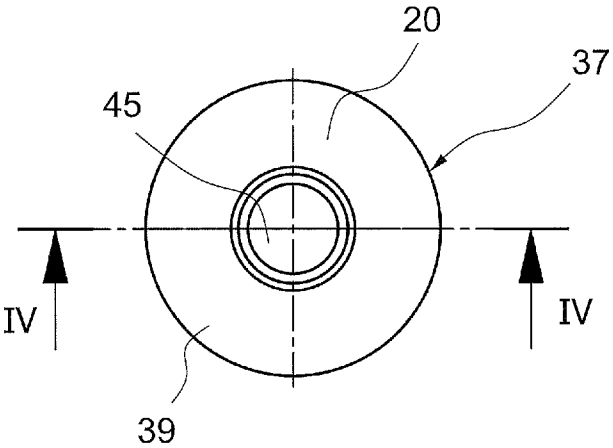
Figure 130:
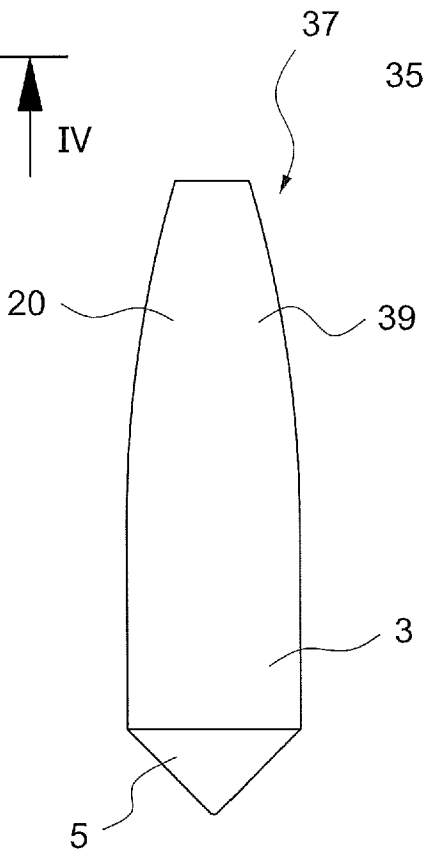
Figure 129:
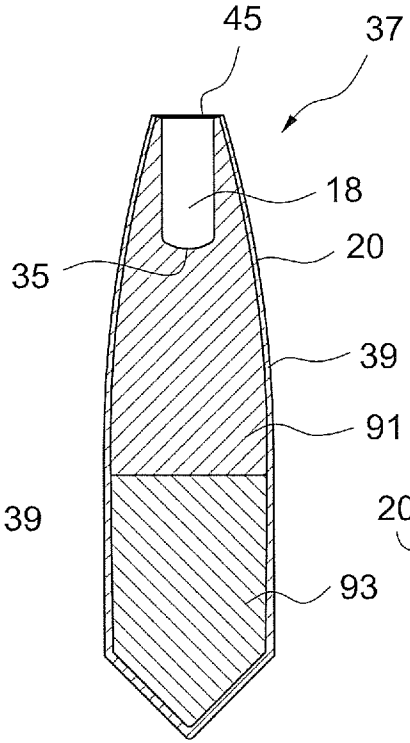
Figure 131:
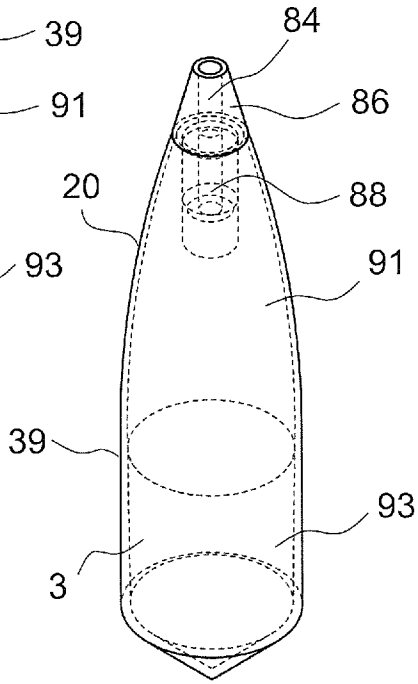
Figure 135:
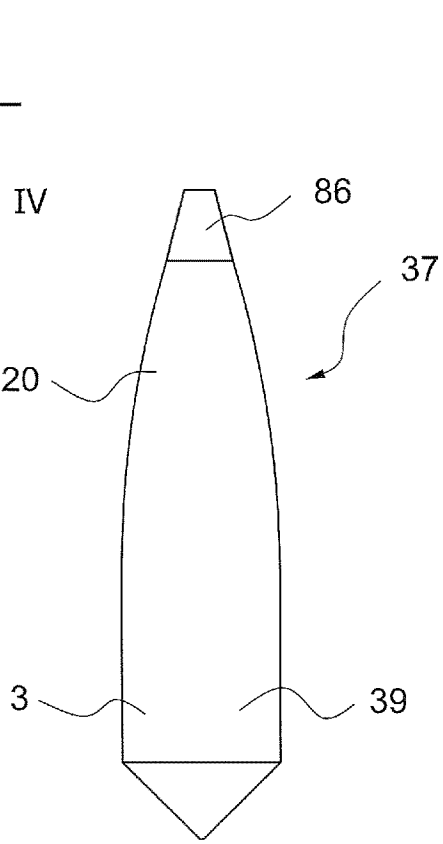
Figure 133:
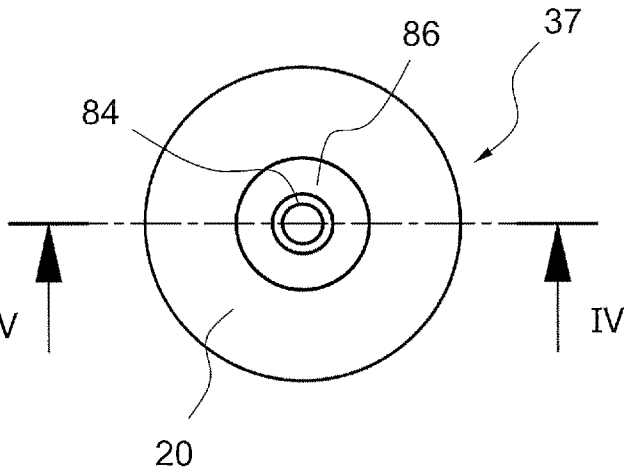
Figure 134:
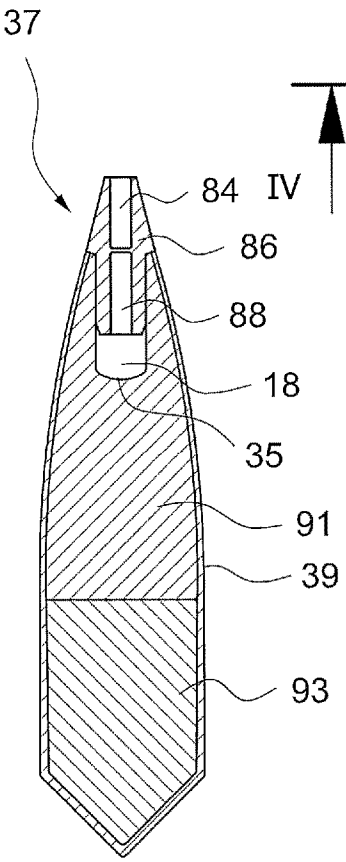
Figure 132:
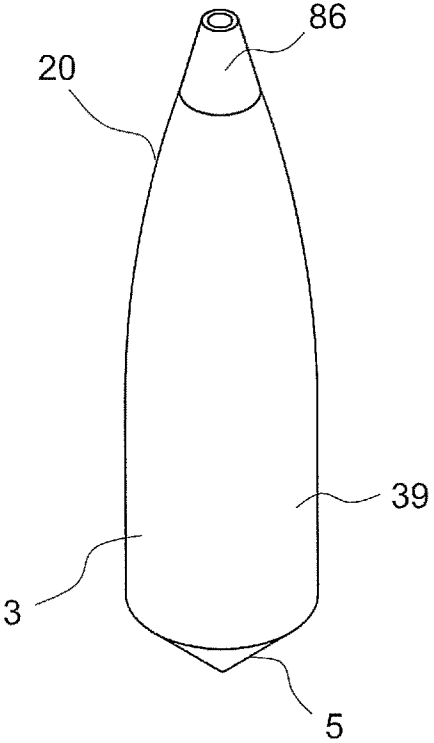

FIG. 22 a cross-sectional view of the tool along the section line Z-Z in accordance with FIG. 21;

FIG. 23 a perspective view of the tool in accordance with FIGS. 21 and 22;

FIG. 24 a cross-sectional view of the tool along the section line Y-Y in accordance with FIG. 21;

FIG. 25 a perspective view of an intermediate according to the invention in a further preferred embodiment;

FIG. 26 a top view of the intermediate in accordance with FIG. 25;

FIG. 27 a perspective view of the intermediate along section line X-X in accordance with FIG. 26;

FIG. 28 a cross-sectional view of the intermediate along the section line Y-Y in accordance with FIG. 26;

FIG. 29 a perspective view of a projectile according to the invention according to a further preferred embodiment based on the intermediate in accordance with FIGS. 25 to 28;

FIG. 30 a top view of the projectile according to the invention in accordance with FIG. 29;

FIG. 31 a cross-sectional view of the projectile according to the invention in accordance with FIGS. 29 and 30;

FIG. 32 a perspective view of the projectile according to the invention in accordance with FIGS. 29 to 31;

FIG. 33 a top view on a tool according to the invention in a further preferred embodiment for manufacturing the intermediate according to the invention in accordance with FIGS. 25 to 28 or the projectile in accordance with FIG. 29 to 32;

FIG. 34 a cross-sectional view of the tool along the section line Z-Z in accordance with FIG. 33;

FIG. 35 a perspective view of the tool in accordance with FIGS. 33 and 34;

FIG. 36 a cross-sectional view of the tool along the section line Y-Y in accordance with FIG. 33;

FIG. 37 a perspective view of an intermediate according to the invention in further preferred embodiment;

FIG. 38 a top view of the intermediate in accordance with FIG. 37;

FIG. 39 a cross-sectional view of the intermediate along the section line X-X in accordance with FIG. 38;

FIG. 40 a cross-sectional view of the intermediate along the section line Z-Z to FIG. 38;

FIG. 41 a lateral view of a projectile according to the invention in a further preferred embodiment on the basis of the intermediate in accordance with FIGS. 37 to 40;

FIG. 42 a top view of the projectile in accordance with FIG. 41;

FIG. 43 a cross-sectional view of the projectile in accordance with FIGS. 41 and 42;

FIG. 44 a perspective view of the projectile in accordance with FIGS. 41 to 43;

FIG. 45 a top view on a tool according to the invention in a further preferred embodiment for forming the intermediate in accordance with FIGS. 37 to 40 or FIGS. 1.1 to 4.1 or the projectile in accordance with FIGS. 41 to 44 or FIGS. 5.1 to 7.1;

FIG. 46 a cross-sectional view along the X-X section line in accordance with FIG. 45;

FIG. 47 a perspective view of the tool in accordance with FIGS. 45 and 46;

FIG. 48 a cross-sectional view of the tool along the section line Z-Z in accordance with FIG. 45;

FIG. 49 a perspective view of an intermediate according to the invention in accordance with a further preferred embodiment;

FIG. 50 a top view of the intermediate in accordance with FIG. 49;

FIG. 51 a cross-sectional view along the section line Z-Z in accordance with FIG. 50;

FIG. 52 a cross-sectional view along the section line to FIG. 50, which is rotated by 45° with relation to the axis Z-Z in accordance with FIG. 50;

FIG. 53 a top view of a tool according to the invention in a further preferred embodiment for manufacturing the intermediate in accordance with FIGS. 49 to 52;

FIG. 54 a cross-sectional view of the tool along the section line Z-Z in accordance with FIG. 53;

FIG. 55 a perspective view of the tool in accordance with FIGS. 53 to 54;

FIG. 56 a lateral view of a projectile according to the invention in a further preferred embodiment on the basis of the intermediate in accordance with FIGS. 49 to 52;

FIG. 57 a top view of the projectile in accordance with FIGS. 56 and 57;

FIG. 58 a cross-sectional view of the projectile in accordance with FIGS. 56 and 57;

FIG. 59 a perspective view of the projectile in accordance with FIGS. 56 to 58;

FIG. 60 a perspective view of an intermediate according to the invention in a further preferred embodiment;

FIG. 61 a top view of the intermediate in accordance with FIG. 60;

FIG. 62 a cross-sectional view along the section line Y-Y in accordance with FIG. 61;

FIG. 63 a sectional view along a section line rotated by 60° with respect to the section line Y-Y in accordance with FIG. 61;

FIG. 64 a top view of a tool according to the invention in a further preferred embodiment for manufacturing an intermediate in accordance with FIGS. 60 to 63;

FIG. 65 a cross-sectional view along the section line Y-Y in accordance with FIG. 64;

FIG. 66 a top view on a tool rotated by 60° in accordance with FIG. 64;

FIG. 67 a cross-sectional view along the section line X-X in accordance with FIG. 66;

FIG. 68 a perspective view of the tool in accordance with FIGS. 64 to 67;

FIG. 69 a perspective top view of a deformed projectile according to the invention after being fired based an intact projectile in accordance with FIGS. 17 to 20;

FIG. 70*a* a perspective view of the deformed projectile in accordance with FIG. 69;

FIG. 71 a lateral view of the projectile according to the invention in accordance with FIGS. 69 and 70;

FIG. 72 a perspective view of an intermediate according to the invention in a further embodiment for manufacturing a partial fragmentation bullet in accordance with a preferred embodiment;

FIG. 73 a top view of the intermediate in accordance with FIG. 72;

FIG. 74 a cross-sectional view along the section line III-III in accordance with FIG. 73;

FIG. 75 a cross-sectional view of the intermediate along the section line N-N in accordance with FIG. 73;

FIG. 76 a lateral view of the intermediate in accordance with FIGS. 72 to 75;

FIG. 77 another lateral view of the intermediate in accordance with FIGS. 72 to 76;

FIG. 78 a perspective view of a projectile according to the invention in a first construction in accordance with a preferred embodiment on the basis of the intermediate in accordance with FIGS. 72 to 77, wherein dashed lines should not indicate visible edges from the outside;

FIG. 79 a top view of the projectile in accordance with FIG. 78;

FIG. 80 a perspective view of the projectile according to the FIGS. 78 and 79, wherein the lines are left out;

FIG. 81 a cross-sectional view of the projectile along the section lines in N-N in accordance with FIG. 79;

FIG. 82 a lateral view of the projectile in accordance with FIGS. 78 to 81;

FIG. 83 a perspective view of a projectile according to the invention in a second embodiment on the basis of the intermediate in accordance with FIGS. 72-77 and the projectile in accordance with FIGS. 78-82, wherein the dashed lines show edges that are not visible from the outside;

FIG. 84 a perspective view of the projectile in accordance with FIG. 83 without dashed lines;

FIG. 85 a top view of the projectile in accordance with FIGS. 83 and 84;

FIG. 86 a cross-sectional view of the projectile along the section lines IV-IV in accordance with FIG. 85;

FIG. 87 a lateral view of the projectile in accordance with FIGS. 83 to 87;

FIG. 88 a perspective view of an intermediate according to the invention for manufacturing a partial fragmentation bullet according to the invention with two separate core components in accordance with a preferred embodiment of the invention;

FIG. 89 a top view of the intermediate in accordance with FIG. 88;

FIG. 90 a cross-sectional view of the intermediate along section lines IV-IV in accordance with FIG. 89;

FIG. 91 a cross-sectional view of the projectile along the section lines III-III in accordance with FIG. 89;

FIG. 92 a lateral view of the projectile in accordance with FIGS. 88 to 91;

FIG. 93 another lateral view of the intermediate in accordance with FIGS. 88 to 92;

FIG. 94 a perspective view of a projectile according to the invention in a first embodiment on the basis of the intermediate in accordance with FIGS. 88-92;

FIG. 95 a top view of the projectile in accordance with FIG. 94;

FIG. 96 a perspective view of the projectile in accordance with the FIGS. 94 and 95;

FIG. 97 a cross-sectional view of the projectile along the section lines N-N in accordance with FIG. 95;

FIG. 98 a lateral view of the projectile in accordance with FIGS. 94-97;

FIG. 99 a perspective view of a projectile according to the invention in a second embodiment on the basis of the intermediate according to the invention in accordance with FIGS. 88 to 93, wherein the invisible edges of the projectile are shown with dashed lines;

FIG. 100 a perspective view of the projectile in accordance with FIG. 99 without dashed lines;

FIG. 101 a top view of a projectile in accordance with the FIGS. 99 and 100;

FIG. 102 a cross-sectional view of the projectile along the section lines N-N in accordance with FIG. 101;

FIG. 103 a lateral view of the projectile in accordance with the FIGS. 99 to 102;

FIG. 104 a perspective view of an intermediate of the invention for manufacturing a projectile according to the invention, such as a partial fragmentation bullet, in accordance with a preferred embodiment of the invention;

FIG. 105 a top view of the intermediate in accordance with FIG. 104;

FIG. 106 a cross-sectional view along section line IV-IV in accordance with FIG. 105;

FIG. 107 a cross-sectional view along the section line III-III in accordance with FIG. 105;

FIG. 108 a lateral view of the intermediate in accordance with FIGS. 104 to 107;

FIG. 109 another lateral view of the intermediate in accordance with FIGS. 104 to 108;

FIG. 110 a perspective view of a projectile according to the invention in a first embodiment based on the intermediate according to the invention in accordance with FIGS. 104 to 109, wherein dashed lines indicate edges which are not visible from the outside;

FIG. 111 a top view of the projectile in accordance with FIG. 110;

FIG. 112 a perspective view of the projectile in accordance with FIGS. 110 and 111;

FIG. 113 a cross-sectional view of the section lines IV-IV in accordance with FIG. 111;

FIG. 114 a lateral view of the projectile in accordance with FIGS. 110 to 113;

FIG. 115 a perspective view of a projectile according to the invention in a second embodiment on the basis of the intermediate according to the invention in accordance with FIGS. 104 to 109, wherein dashed lines indicate edges that are not visible from the outside;

FIG. 116 a perspective view of the projectile in accordance with FIG. 51 without a line;

FIG. 117 a top view of the projectile in accordance with FIGS. 115 and 116;

FIG. 118 a cross-sectional view of the projectile along section line IV-IV in accordance with FIG. 117;

FIG. 119 a lateral view of the projectile in accordance with FIGS. 115 to 117;

FIG. 120 a perspective view of an intermediate of the invention for manufacturing a projectile according to the invention, such as a partial fragmentation bullet, in a preferred embodiment;

FIG. 121 a top view of an intermediate in accordance with FIG. 120;

FIG. 122 a cross-sectional view of the intermediate along section line IV-IV to FIG. 121;

FIG. 123 a cross-sectional view of the intermediate along the section line III-III in accordance with FIG. 121;

FIG. 124 a lateral view of the intermediate in accordance with FIGS. 120 to 123;

FIG. 125 another lateral view of the intermediate in accordance with FIGS. 120 to 124;

FIG. 126 a perspective view of a projectile according to the invention in a first embodiment on the basis of the intermediate according to the FIGS. 120-125, wherein dashed lines indicate edges that are not visible from the outside;

FIG. 127 a perspective view of the projectile in accordance with FIG. 126 without dashed lines;

FIG. 128 a top view of the projectile in accordance with FIGS. 126 and 127;

FIG. 129 a cross-sectional view of the projectile along section line IV-IV in accordance with FIG. 128;

FIG. 130 a lateral view of the projectile in accordance with FIGS. 126-130;

FIG. 131 a perspective view of a projectile according to the invention in a second embodiment on the basis of the intermediate according to the invention in accordance with FIGS. 120-125, wherein dashed lines indicate edges that are not visible from the outside;

FIG. 132 a perspective view of the projectile in accordance with FIG. 131 without a line;

FIG. 133 a top view of the projectile in accordance with FIGS. 131-132;

FIG. 134 a cross-sectional view of the projectile along section line IV-IV in accordance with FIG. 133; and FIG. 135 a lateral view of the projectile in accordance with FIGS. 131-134.

In FIG. 1, an example is shown on the basis of a perspective view for an intermediate according to the invention or intermediate product for manufacturing a projectile or bullet of an ammunition according to the invention, in particular, a deformable bullet or partial fragmentation bullet. It should be noted that, for all perspective views, such as FIG. 1, the dashed lines are invisible contour edges in accordance with a perspective view. To better clarify the profile within the intermediate, the invisible contours are dashed.

In FIGS. 1 to 4, the intermediate according to the invention is generally provided with the reference number 1. The intermediate 1 consists of a blank, which is cut to length from a cylindrical rod section and is then inserted into a die, which is not shown in more detail. The blank is then cold-formed to form the design form of the intermediate in accordance with FIGS. 1 to 4.

The intermediate 1 comprises a cylindrical, solid base end section 3 with a flat end face 5. The base end section 3 comprises an edge rounding on the flat end face 5 for easy insertion into a case of an ammunition (not shown).

In axial direction A, the base end section 3 passes into a press end section 7, wherein the transition between the base end section 3 and the press end section 7 can be defined by a press recess 11 incorporated into the blank. In the top view in accordance with FIG. 2, it is apparent that, in the axial direction, the press recess has a star shape, in which three slot arms 10*a* to 10*c* extend radially from an axial centre (cavity 18 of the projectile 37) radially towards the outer side. These slot arms 10*a* to 10*c* form a completely continuous slotting in a wall 12 of the press end section 7, which wall 12 results due to the prongs 13 resulting due to the through slotting 10*a* to 10*c*. The slots 10*a* to 10C completely separate the prongs 13, wherein the slots 10*a* to 10*c* extend continuously from the radial outer side of the intermediate 1 towards the recess centre (the cavity 18) at the longitudinal axis A. In a radial cross-section (not shown here in more detail), the prongs 13 are therefore structurally separated by the slotting.

From the recess 11, the cavity 18 (see FIGS. 5 to 8) results, which forms, in particular, during the forming of the prongs 13 into the ogive section 20. During this forming, the cylindrically extending prongs on the outer side are shaped radially inwards in order to form the ogival outer side, wherein the cavity 18, in particular, upon contact of the lateral edges 17 of the prongs 13, is partially closed in the circumferential direction.

In the embodiment in accordance with FIGS. 1 to 4, the press end section 7 comprises three prongs extending from the press end section 13, all of which have essentially the same outer shape and are arranged at equidistant circumference sections of about 1,200 to one another. Each prong 13 at the stage of the intermediate in accordance with FIGS. 1 to 4 has a cylindrical outer surface 15, which ends at a lateral edge region 17 of the prong 13, at which, viewed in the circumferential direction, the cylindrical outer surface 15 abruptly ends. A pair of inner flank surfaces 21, 23 extend from the edge region 17 towards the press recess 11, which inner flank surfaces 21, 23, have a convex shape both in the axial direction as well as in the circumferential direction. When viewed in accordance with FIGS. 1 to 4, the shape of the intermediate has the shape of a solid sepal. Each prong 13 runs together from the base end section 3 to a prong tip 25, wherein a circumferential width of each prong 13 continuously decreases starting from one foot of the prong in the transition region to the base end section 3 towards the prong tip 25.

As is apparent in the cross-sectional views of the FIGS. 3 and 4 in particular, each prong 13 comprises a material reinforcement or material accumulation 31 in the region of a centre of the prong 13 in the longitudinal axis progression of the intermediate 1. The material accumulation 31 is responsible for a convex embodiment of the inner side flank surfaces 21, 23 and represents an aspect to achieve a controlled deformation of the projectile 37 resulting from the intermediate 1, in particular, when it is fired into a gelatine block (not shown in more detail) in accordance with the above-mentioned test methods.

The material accumulation 31 extends essentially in a straight line from the prong tip 25 to the prong foot at the transition region to the base end section 3. As is apparent in FIGS. 2, 3 and 4, for each of the slots 10*a* to 10*c*, a slotted base 33 extends in the radial direction towards a central recess ground 35, wherein the recess ground 35 in the lateral view is lower than the further progression of the slotted bases 33 in the radial direction. The slotted bases 33 rise from the central recess ground 35 in the radial direction. The slotted bases 33 are essentially flat or rounded and are designed for a 9 mm bullet approximately between 0.5 mm to 4 mm or 5 mm wide. The weakening of the intermediate 1 due to the recess 11 incorporated by means of deep-drawing in combination with the subsequent forming in order to form the ogive section 20 causes that, upon impact of the bullet 37 formed from the intermediate 1, for example, in accordance with FIGS. 5 to 8, the material is used as a force deformation joint in the region of the slotted base, since it runs along the connecting line of two adjacent slotted bases 33. The plastic deformation joint allows the prongs to fold 13 radially outwards, as is shown, for example, in the deformed projectile 81 in accordance with FIGS. 69 to 71. The prongs 83 form in a sepal-like manner or extend in tongue-like manner radially towards the outside.

As is apparent in FIG. 3, the slotting 10*a* to 10*c* extends from the axial maximum extension of the prong tip 25 up to the base end section 3 across more than 50% of the total length of the intermediate 1.

After the intermediate 1 has been deep-drawn without the need for applying further machining manufacturing measures, the intermediate 1 is ready to be formed into a finished projectile. The forming process for the formation of the projectile 37 mainly consists of forming the press end section 7 with the prongs 13 separated by slots into an ogive section 20. Thereby, the prongs 13 are so radially deformed inwards in such a way that the lateral edges 17 of the prongs 13 enter into or approximately enter into contact, as is shown in FIGS. 5, 6 and 8 in particular. In the preferred embodiment in accordance with FIGS. 1 to 8, the lateral edges 17 are brought approximately completely into contact up to a side passage opening 41 in the region of the slotted base 33. The side passage opening 41 can be less than 1 mm in size and includes a triangular, heart or spade shape. In the embodiment in accordance with FIGS. 1 to 8, it is advantageous to keep the side opening 41 as small as possible. The lateral edges 17 are in contact with each other and form (in contrast to the prior art, which teaches exclusively surface indentations or weakening points) adjacent boundary surfaces, which form a separation structure between the prongs 13 lying adjacent to one another. The adjacent lateral edges 17 extend up to the pointed end 43 of the ogive section 20, on which a particularly essentially star-shaped, centred opening 45 is formed, which serves to penetrate a gelatinous mass in the standardized test methods, which causes the desired deformation (in accordance with FIGS. 69 to 71) due to the build-up of a hydraulic pressure. The central opening 45 should thereby be significantly less than 20% of the cylindrical cross-section of the base end section 3. In the case of the projectile 37 shown in FIGS. 5 to 8, the opening cross-section of the opening 45 is about 10% or less of the cylindrical cross-section of the base end section 3.

In the embodiment according to the invention in accordance with FIGS. 1.1 to 7.1 another example of an intermediate 1 is shown, wherein, for better readability of the figure description and to avoid repetitions for identical components of the intermediate 1, the same reference numbers are used as in the case of the embodiment in accordance with FIGS. 1-8. The intermediate 1 differs from the intermediate 1 in accordance with FIGS. 1 to 4 on the one hand in the depth of the insertion of the press recess 11 and in the number of the slot arms on the other, namely having four slot arms 10*a* to *d*. The axial depth of the press recess 11 corresponds to about 20-30% of the total longitudinal expansion of the intermediate 1, which is clearly apparent in FIGS. 3.1 and 4.1. In contrast to the embodiment in accordance with FIGS. 1-4, the slot arms 10*a* to 10*d* do not form a complete radial breakthrough in the wall 12 of the press end section 7. Rather, the wall 12 is cylindrically closed on the outside due to the slotted bases 9, wherein the wall thickness at the axial end in the region of the press recess 11 is thin. The slotted base 9 runs essentially in a straight line at a constant gradient in the longitudinal direction to a recess ground 35, which is circular/concave. The prongs 13 also flow into the recess ground 35. The prongs 13 have a convex shape on the cavity side with a ridge (material accumulation 31), which extends centrally towards the recess ground 35. The outer surface 15 of the intermediate 1 is completely cylindrical, also at the height of the end face end, at which the press recess 11 is incorporated. The press recess 11 can be incorporated by means of a tool, as is shown in FIGS. 21-24, wherein also other shapes of an embossing die can be used, as it is known in the region of the screwdriver bit shapes (screwhead profile).

After the intermediate 1 has been deep-drawn without the need for applying further machining manufacturing measures, the intermediate 1 is ready to be formed into a finished projectile 37. With regard to the projectile 37 in accordance with FIGS. 5 to 8, the same reference numbers are used for easy readability of the figure description and for the avoidance of repetitions for the same or similar components of the projectile 37. The forming process for the formation of the projectile 37 mainly consists of forming the press end section 7 with the prongs 13 separated by slots into an ogive section 20. Thereby, the prongs 13 are so radially deformed inwards in such a way that the prongs 13 enter into or approximately enter into contact, as is shown in FIGS. 5.1 to 7.1 in particular. In the embodiment in accordance with FIGS. 5.1 to 7.1, the inner flank surfaces are approximately at least largely brought into contact to form a radially completely closed cavity 18, which extends from the recess ground 35 in the axial longitudinal direction to the tip of the projectile 37, at which a funnel-shaped crater recess is formed. In the embodiment in accordance with FIGS. 5.1 to 7.1, the outer surface of the ogive 20 is favourably completely closed. At the pointed end 43 of the ogive section 20, a particularly essentially circular, centred opening 45 is formed, which serves to penetrate a gelatinous mass in the standardized test methods, which causes the desired deformation (in accordance with FIGS. 69 to 71) due to the build-up of a hydraulic pressure. The central opening 45 should thereby be significantly less than 20% of the cylindrical cross-section of the base end section 3. In the case of the projectile 37 shown in FIGS. 5 to 8, the opening cross-section of the opening 45 is about 20% or less of the cylindrical cross-section of the base end section 3. On the base side, the projectile 37 has a small bevel 27 to make it easier to work with an ammunition case.

The following description, an example of a deep-drawing tool to create the intermediate 1 in FIGS. 1 to 4 or the projectile 37 in FIGS. 5 to 8 is explained. In the design according to the invention of the tool for the forming of the intermediate 1, according to the invention, a classical known tool, namely a slotted screwdriver, which is used in the embodiment in accordance with FIGS. 9 to 12, has a three-slot or three-bar blade.

In the following, the press head/tool according to the invention in accordance with FIGS. 9 to 12 is generally provided with reference umber 51, which comprises the deformation bars 53 forming slots 10*a* to 11*c* extending radially, which are separated by inner flank surfaces 55, which are designed to be essentially concave in the axial direction as well as in the circumferential direction. The maximum outer diameter of the tool 51 according to the invention in accordance with FIGS. 9 to 12 (also applies to the tools described later) is slightly greater than the calibre of the projectile to be created 37 or the intermediate to be manufactured 1. For example, the size difference is between 1 mm and 2 mm.

As in evident in FIG. 10, the bars 53 are at an angle of 60° to each other in the cross-sectional view. From the top view, it is evident that the bars 53 are arranged in a 120° angle offset to each other, thus forming a point-symmetric structure. The bars run into a central tip 51, which is rounded or spherical.

It has been shown that using the tool 51 according to the invention, namely the press head or the blade of a correspondingly shaped slot screwdriver, a deep-drawing process can be carried out on the blank of ductile material, such as ductile metal, such as copper, a copper alloy, brass or the like, for the formation of the intermediate 51, which does not suffer from the difficulty of the earing, meaning the formation of waves. Extensive post-processing is not necessary when using the tool according to the invention.

Another preferred embodiment of an intermediate 1 according to the invention show FIGS. 13 to 16. For easier readability of the figure description, the same reference numbers for the identical or similar components of intermediate 1 in accordance with FIGS. 1 to 4 used to make the intermediate 1 in accordance with FIGS. 13 to 16.

The intermediate 1 in accordance with FIGS. 13 to 16 differs from that in accordance with FIGS. 1 to 4 by the number of slots 10*a* to 10*d* and the number of prongs 13, namely four. As is particularly evident in FIG. 14, the slotted bases 33 extend in a cross-shaped manner from the common recess ground 35 outwards in the radial direction, thereby rising (FIG. 13).

The prongs have a convex, belly-shaped top side towards the press recess 11, which reaches a maximum in the form of the material reinforcement 31. The prongs 13 extend in accordance with the unformed intermediate 1 on the outside cylindrically straight and inside convex slightly inclined outwards towards the prong tips 25.

In FIGS. 17 to 20, the intermediate 1 in accordance with FIGS. 13 to 16 is transformed into a projectile 37, wherein, for better readability compared to the projectile 37 in accordance with FIGS. 5 to 8, the same reference numbers are used for similar or identical components.

Unlike the projectile in accordance with FIGS. 5 to 8, the projectile comprises 37, in accordance with FIGS. 17 to 20, a significantly larger side opening 41, which has a triangular shape, wherein the clear width of the side opening 41 from the slotted base towards the prong tip 25 gradually decreases. The contacting lateral edges 17 of the prongs 13 lie only in the pointed region along a few millimetres, especially in the case of a 9 mm calibre. In this way, the cavity 18 is closed in the short adjacent region in the circumferential direction, while the cavity 18, which results from the press recess 11, is accessible through the four side passage openings 41 laterally and the centred opening 45 axially.

The opening 45 centred in the longitudinal direction of the projectile at the top of the ogive section is essentially square with rounded corners. The cross-sectional surface of the opening 45 is also significantly less than 20%, 15% or 10% of the cylindrical cross-sectional surface of the base end section 3. The small cross-sectional surface prevents that stronger components seal the opening against the gelatinous mass, whereby the gelatinous material cannot penetrate into the cavity 18 in order to build up the hydraulic forces for splitting the prongs 13 there.

The tool 51 according to the invention, using which the intermediate in accordance with FIGS. 13 to 16 is provided in FIGS. 21 to 23 with reference number 51. The same and identical components of the tool are provided with the same reference numbers to make it easier to read.

In contrast to the embodiment in accordance with FIGS. 9 to 12, the tool 51 comprises four bars in accordance with FIGS. 21 to 24 for the formation of four slots 10 in the wall of the press end section 7 of the intermediate 1. The four bars 53 are arranged at a right angle to each other. As is apparent in FIG. 23 in particular, the flank surface regions 55 between the bars 53 have a concave shape to form the convex surface shape with the material reinforcement 31 of the intermediate 1.

In FIGS. 25 to 28, another further preferred embodiment of the intermediate 1 according to the invention is shown, wherein, for identical and similar components of the intermediate 1, the same reference numbers are used like in the above-described embodiments.

In contrast to the above embodiments, the intermediate 1 in accordance with FIGS. 25 to 28 only has one slot that extends completely from a radial side to the opposite side through the longitudinal axis centre, which is best apparent in FIG. 26. The slot 10 forms the press recess 11 and divides the wall for enclosing the cavity 18 into two prong sections 13, which tapers to the tip 25 both in the width direction as well as material thickness here. The same also applies to the prongs in accordance with other embodiments, which are described and are still to be described.

In accordance with the top view of FIG. 26 and the cross-sectional view in accordance with FIG. 28, the slotted base 33 is relatively wide and extends on the outer radial side by almost half the diameter of the base end section 3. On the outer side, the slotted base 33 tapers into the recess ground 35, which lies centrally to the longitudinal axis A of the intermediate 1.

As is clearly apparent in FIG. 25, the prongs 13 have a convex shaped inner top side which faces towards the pressing recess 11 and comprises a material reinforcement 31, which, as described above, extends from the prong tip 25 to the recess ground 35.

In contrast to the other embodiments, the slotted base 33 rises particularly with regard to the longitudinal axis A at an angle of about 30 to 60°, approximately between 400 and 50°. The slotted base essentially runs in a straight line towards the outside in a radial manner.

The projectile manufactured, and in particular, formed from the intermediate 1 in accordance with FIGS. 25 to 28 is shown in FIGS. 29 to 32, wherein the same reference numbers are used for the same reference numbers with respect to the projectile description already described above. As is evident in FIGS. 29 to 32, the ogive section comprises 20 large side openings 41, which results from the wide slotted base 33 of the intermediate 1 in accordance with FIGS. 25 to 28. As is also evident, the clear cross-section of the side opening 41 decreases towards the tip of the ogive section 20. It is also evident that there is no contact between the slotted lateral edges 17 even in the region of the centred opening 45. This means that it is not necessary for the lateral edges 17 to make contact in order to form the projectile 37 according to the invention. The bent prongs 13 limit the cavity 18, which is accessible from the centred opening 45 as well as from both side openings 41. Between the lateral edges 17 approximately making contact in the region of the central opening 45, a gap 61 is formed, which should have a width of less than 2 mm or 1 mm.

As is evident in FIG. 30, the central opening 45 in the region of the acute angle of the ogive section 20 essentially has an hourglass shape, wherein the clear cross-section of the opening 45 is significantly less than 20% or 10% of the cylindrical surface of the base end section 3. In the lateral view in accordance with FIG. 29 and the cross-sectional view in accordance with FIG. 31, a special design of the ogive section 20 is apparent, in which a bottle neck shape is provided at the pointed end of the wall, whereby the general ogive section design is different in accordance with the other embodiments.

In FIGS. 33 to 36, another embodiment of the tool 51 according to the invention is shown, wherein, for easier readability, the same reference numbers are used as was the case with the tool embodiments previously described above. The press head 51 in accordance with FIGS. 33 to 36 comprises only two bars 53 for the formation of the two slots 10*a* and 10*b* according to the intermediate in accordance with FIGS. 25 to 28. The concave flank surfaces 55 can be easily recognized in FIGS. 33 and 35.

The embodiment of the intermediate 1 in accordance with FIGS. 37 to 40 differs from the embodiment of the intermediate 1 in accordance with FIGS. 13 to 16 in that the prong has no purely convex top side facing the press recess 11 but a concave design with a linear material reduction 63 (indentation or crevice), which forms a splitting of the prong into two prong sections 13*a* and 13*b*, which each leads into its own prong tip 25*a*, 25*b*. The "split" prongs are structurally separated from four narrow slots 10*a* to 10*d*.

The intermediate 1 in accordance with FIGS. 37 to 40 has a convex curvature at least in the axial direction but not in circumferential direction due to the material reduction 63.

In FIGS. 41 and 42, the projectile 37 according to the invention is manufactured on the basis of the intermediate 1 in accordance with FIGS. 37 to 40. For better readability of the figure description, the same reference numbers are used for identical and similar components of projectile 37. In the embodiment of the projectile 37 in accordance with FIGS. 41 to 45, the side opening 41 is less than half of the longitudinal extension of the lateral edge 17.

For a large part of the edge of the side 17 there is a contact-like installation of the lateral edges 17 to each other to limit the cavity 18 in the circumferential direction.

In contrast to the embodiments described above, the intermediate 1, at the pointed end of the ogive section 20, comprises a star shape whose clear cross-sectional surface is significantly less than 20% of the cross-sectional surface of the base end section 3. In particular, the cross-sectional surface of the opening is less than 15% or 10%.

The upper final edge in the region of the star-shaped central opening 45 forms the end of the respective prong 13, wherein lateral edges 17 lie on one another, thereby making contact.

In FIGS. 45 to 48, the tool 51 according to the invention, namely the press head, is shown, using which the intermediate 1 should be manufactured in accordance with FIGS. 37 to 40. Similar to the tool in accordance with FIG. 21 to 24, the tool 51 has four bars, wherein the flank surfaces 55 are formed at least in circumferential direction in a convex manner with a ridge 71. The four bars 53 extend at a right angle to each other.

In FIGS. 49 to 52, another intermediate 1 according to the invention is shown with a more complicated, non-axis-symmetric prong structure. The structure of intermediate 1 in accordance with FIGS. 49 to 52, for which the same reference numbers are used for similar and identical portions, as explained above, comprises a press recess 11, which has continuous slots 10. The slots 10*a* to 10*d* run radially slightly outside, in particular, tangentially to the recess ground towards the longitudinal axis A of the intermediate 1. The prongs 13 also have a convex top side and grow as a single piece out the base end section 3. They reach a prong tip 25.

The intermediate 1 in accordance with FIGS. 49 to 52 is bent into a projectile 35 in accordance with FIGS. 56 to 59. As is evident, the side openings 41 and the lateral edges 17 of the respective prongs are screw-shaped with respect to the longitudinal axis A, which derives from the non-purely radial slots 10*a* to 10*d* of the intermediate 1.

Also, the central opening 45 of the projectile 37 in accordance with FIGS. 56 to 59 has a smaller clear cross-sectional surface than the cylindrical cross-sectional surface of the base end section 3. The clear cross-sectional surface of the central opening 45 is significantly smaller than 20% or 15% or 10%.

The cavity 18 is open to the side via the side openings 41 and via the central opening 45. About half of the axial length of the lateral edges 17 is in contact, so that there the cavity is closed in the circumferential direction. The other half of the lateral edges 17 is spaced for the formation of the side opening 41.

In FIGS. 53 to 55, the tool 51 according to the invention is shown, which is used for manufacturing the intermediate 1 according to the invention. As is particularly evident in FIG. 55, the four bars do not run in the centre through the longitudinal axis of the tool, but slightly offset tangentially to the pointed region 57. Due to this displacement, the slightly twisted shape of the lateral edges 17 and the side opening 41 result.

Ultimately, with FIGS. 60 to 63, a further embodiment of the intermediate 1 according to the invention is shown, wherein, for identical or similar components, the same reference numbers are used. The intermediate 1 comprises three slots 10 *a* to 11*c* that run radially, but slightly offset to the longitudinal axis A like the initially described embodiment in accordance with FIGS. 1 to 4. This results in the prongs 13 shown in FIGS. 60 to 63. The prongs 13 lead at their end into an essentially flattened end 71.

The surface facing to the press recess 11 is convex in shape, wherein its thickness decreases in the axial progression towards the end 71.

The intermediate shown in accordance with FIGS. 60 to 63 can be transformed into a projectile 37, which is not shown in the figures in more detail.

The tool 51 according to the invention in accordance with FIGS. 65 to 68 is designed to manufacture the intermediate 1 in accordance with FIGS. 61 to 63. The bars 53 responsible for the slots 10*a* to 11*c* are also offset towards the longitudinal axis of the tool 51 in order to incorporate corresponding slot shapes into the intermediate 1.

In FIGS. 69 to 71, a deformed projectile according to the invention is shown, which essentially corresponds to the object of the invention in accordance with FIGS. 13 to 20. The deformed projectile 81 comprises four tongue-like single-piece prongs 83 extending from the base end section 3, the shape of which can be designated as a sepal-like shape. As is evident in FIGS. 69 to 71, the bent prongs 83 comprise a centre reinforcement 33, which extends from the prong tip 25 to the recess ground 35. The deformation of the prongs 83 can also be called a mushroom-shaped deformation. According to the invention, between two adjacent deformed prongs, there is another pointed projection 85 radially extending outwards, which essentially has the shape of a shark tooth and extends in a convex shape radially outwards.

As evident in FIG. 71, the teeth 85 extend above the deformed prongs 83 and have a significantly shorter longitudinal extension than the formed prongs 83. The pointed teeth 85 result from a deformation in the region of the slotted base 33 between the respective adjacent prongs 83. The continuous slot design and the formation of a narrow slotted base 33 in the region of the base end section 3 forces the formation of additional pointed teeth 85 between the bent prongs 83. In the region between the teeth 85 and the bent prongs 83, nib-shaped constrictions 87, form, which are typical for an ideal deformation under the above-mentioned test conditions.

As is apparent in the top view of FIG. 65, the deformed profile is approximately double-axis-symmetric and forms four further radially extending outwards, in particular pointed teeth 85, in addition to the four folded prongs 85.

FIGS. 72-75 show a further embodiment of an intermediate 1 according to the invention, wherein, for the better readability of the figure description and to avoid repetitions for identical or similar components of the intermediate 1, the same reference numbers are used. The intermediate 1 in accordance with FIGS. 72-77 is similar to the intermediate 1 in accordance with FIGS. 1-4 in that the press recess 11 forms three slot arms 10*a* to *c*, which are arranged at equidistant distances (120°) to each other. The slot arms 10*a* to *c* are slightly wider and run essentially radially evenly towards the outer side. The slots partially run through continuously towards the outer surface 15 in a radial manner. The prongs 13 are shaped identically to one another and have a convex inner flank surface 21 facing the cavity 18. A significant difference from the intermediates 1 described above is that the base body of the intermediate 1 is made of two pieces, namely being made of a core 38 and a jacket 39. The core 38 is a solid material, for example, formed from a ductile material, such as copper or lead, which is completely surrounded by the thin-walled jacket 39 also made of a ductile material. Only the end face, on which the forming tool in axial direction A is retracted for the formation of the press recess 11, is not covered by the jacket 39. When inserting the press recess 11, both the base body, the core 38, as well as the attached jacket 39 are plastically deformed to insert the desired slotting (1*o*). The intermediate 1 has a conical final shape at the opposite end face 5 opposite the press end section 7. The jacket 39 slightly protrudes axially at the end of the press end section 7 so that no material of the core 38 can project beyond the edge of the jacket 39.

After the intermediate 1 has been deep-drawn without the need for applying further machining manufacturing measures, the intermediate 1 is ready to be formed into a finished projectile, in particular, a partial fragmentation bullet. The forming process for the formation of the projectile 37 mainly consists of forming the press end section 7 with the prongs 13 separated by slots into a suitable ogive section 20, in particular, being pressed. In this process, the prongs 13 are radially deformed inwards in such a way that the lateral edges 17 of the prongs 13 enter into contact, as is shown in FIGS. 78 to 83 in particular. In the preferred embodiment in accordance with FIGS. 78 to 82, the lateral edges 17 are fully brought into contact until a completely closed outer surface 15 in the region of the cavity 18 and the slot arms 10 of the intermediate 1 has been formed. In the case of the embodiment in accordance with FIGS. 78 to 82, it is advantageous to make the side opening 41 disappear. The cavity 18 extends cylindrically from the recess ground 35 up to the end 43 of the ogive section 20, at which a particularly essentially circular, centred opening 45 is formed, which serves to penetrate a gelatinous mass in the standardized test methods, which causes the desired deformation (in accordance with FIGS. 69 to 71) due to the build-up of a hydraulic pressure. The central opening 45 should thereby be significantly less than 20% of the cylindrical cross-section of the base end section 3. In the case of the projectile 37 shown in FIGS. 5 to 8, the opening cross-section of the opening 45 is about 20% or less of the cylindrical cross-section of the base end section 3.

A variant to the projectile 37 is shown in FIGS. 83-87, wherein, for the easy readability of the figure description, the same reference is used for identical components of the projectile 37.

The projectile, in particular, a partial fragmentation bullet 37 in accordance with FIGS. 83 to 87 differs from the projectile 37 in accordance with FIGS. 78 to 82 in that, at the central opening 45, a tip 86, in particular of plastic, is inserted in order to allow the ogive section 20 to taper to a pointed tip in an aerodynamic manner. The tip 86 has an essentially symmetrical structure and two blind-hole recesses 84, 88, one (84) on the open outer side of the tip 86 and another (88) at the application region that engages into the cavity 18 of the projectile 37. In the forming of the intermediate 1 to the projectile 37, the tip 86 can already be pre-assembled, so that, during forming, pressing forces for holding the tip 86 are transmitted. To provide a defined axial position of the tip 86, the latter has a circumferential section 89, on which the round end of the jacket 39 is attached.

FIGS. 88-93 show a further variant of an intermediate 1 according to the invention, wherein for the similar or identical components the same reference numbers as above are used. The intermediate 1 in accordance with FIGS. 88-93 differs from the intermediate in accordance with FIGS. 72-77 in that the core 38 is made of two pieces, namely a deformation section 91, in particular, made of a solid material, for example, made of a ductile material, such as copper or lead, in which the press recess 11 is incorporated, and an undeformed, base-side core section 93, in particular, made of a solid material, for example, made of a ductile material, such as copper or lead. The core section 93 is slightly smaller and represents more than half, for example, two-thirds of the total length of the intermediate 1. Preferably, two different materials for the deformation section are also used 90 and the base-side core section 93. However, the same material can also be used, wherein an boundary surface 95 is formed between the two sections 91, 93. The press recess 11 is incorporated exclusively in the deformation section 91, wherein the recess ground 35 is positioned close to the boundary surface 95 between the deformation section 91 and the core section 93.

The projectile 37, in particular, a partial fragmentation bullet resulting from intermediate 1 in accordance with FIGS. 88-93, is shown in FIGS. 94-97 in a first embodiment and, in FIGS. 99-103, in a second embodiment, wherein the second embodiment only differs in that the above-described tip 86 being inserted into the cavity 18. The projectile 37 in accordance with the $1^{st}$ and $2^{nd}$ embodiment differs from the projectile 37 in accordance with FIGS. 78-87 in the 2-part core, the deformation section 91 and the core section 93, wherein the deformation section 91 is essentially in the region of the ogive section 20; however, it can also extend significantly (at the expense of the core section 93) towards the base and occupy a larger portion of the core 38.

The embodiment of the intermediate 1 according to the invention in accordance with FIGS. 104 to 109 differs from the intermediate 1 in accordance with FIGS. 72-77 in that, instead of three slot arms 10 (three prongs 13), four slot arms 10*a* to *d* (prong 13) are provided. For easy readability of the figure description, the same reference numbers as above are used. From the intermediate 1 in accordance with FIGS. 104-109, the approximately same projectile 37 shown in FIGS. 110-115, can be produced, as is the case with the intermediate 1 with three prongs 13. By increasing/reducing the number of prongs/the number of slot arms, the geometry of the ogive 20 or cavity 18 can be adjusted. Also, the projectile 37 in accordance with the second embodiment with the tip 86 in accordance with FIGS. 115-119 is approximately identical to the above-described projectile 83-87 in accordance with the figures.

The embodiment of the intermediate 1 according to the invention in accordance with FIGS. 120 to 125 differs from the intermediate 1 in accordance with FIGS. 88-93 in that, instead of three slot arms 10 (three prongs 13), four slot arms 10*a* to *d* (prong 13) are provided. For easy readability of the figure description, the same reference numbers as above are used. From the intermediate 1 in accordance with FIGS. 120-125, the approximately same projectile 37 shown in FIGS. 126-129, can be produced, as is the case with the intermediate 1 with three prongs 13 in accordance with FIGS. 94-97. By increasing/reducing the number of prongs/the number of slot arms, the geometry of the ogive 20 or cavity 18 can be adjusted. Also, the projectile 37 in accordance with the second embodiment with the tip 86 in accordance with FIGS. 131-135 is approximately identical to the above-described projectile 37 in accordance with FIGS. 115 to 119. The features disclosed in the above description, the figures and the claims can be relevant for the realization of the invention in the various embodiments, both individually as well as in any combination.

REFERENCE LIST

1 intermediate
3 base end section
5 end face
7 press end section
9 slotted base
10 (*a, b, c, d*) slot arms
11 press recess
12 wall
13, 83 prongs
15 outer surface
17 edge region
18 cavity
20 ogive section
21, 23, 55 inner flank surface
25 prong tip
27 bevel
31 material accumulation
33 slotted base
35 recess ground
37 bullet, projectile
38 core
39 jacket
41 side opening
43 pointed end
45 centred opening
51 press head, tool
53 deformation bar
55 inner flank surface
57 pointed region
61 gap
63 material reduction
71 flat end
81 deformed projectile
83 folded prongs
84, 88 blind-hole recess
85 tooth
86 tip
87 nib-shaped constriction
89 section
91 deformation section
93 core section
95 boundary surface
A axial direction

The invention claimed is:

1. A projectile, comprising a cylindrical solid base end section and a press end section with a central press recess incorporated by means of pressing, and a wall limiting the press recess, which is formed into an ogival shaped tip having an opening at a tip of the ogival shaped tip, wherein the wall is formed with at least two through slots, which limit at least two structurally separated wall sections in a circumferential direction, and wherein the cylindrical solid base end section and the press end section are formed as a single piece, and wherein adjacent lateral edges of the wall sections lie opposite one another with a gap of less than 2 mm or at least partially make contact with each other in the circumferential direction.

2. The projectile according to claim 1, in which the projectile is made from an intermediate comprising a ductile blank, which is cold-formed into the intermediate by means of pressing, the intermediate comprising a cylindrical solid base end section and a press end section with a central press recess incorporated by means of the pressing and a wall limiting the press recess to form an ogival shaped tip, wherein the wall is formed with at least two slots extending in an axial direction of the intermediate, which separate at least two prongs in a circumferential direction of the intermediate, wherein the at least two slots extend by more than 10% of an axial total longitudinal extent of the intermediate from the wall end in a direction of the base end section, by being cold-formed in such a way that the at least two prongs separated in circumferential direction are folded onto one another to form the ogive section so that an opening at the tip of the ogive section is centred relative to a longitudinal axis (A) of the projectile.

3. The projectile according to claim 1, in which a contact length of adjacent wall sections at their lateral edges is over 20% of a total length of the lateral edges from a tip of the respective ogive section towards a slotted base, and there is a contact of the lateral edges along approximately the total length of the lateral edges except a region of less than 2 mm in the region of the slotted base.

4. A method for manufacturing a projectile according to claim 1, wherein a blank made of a ductile material is inserted into a cylindrical die and a press head formed according to a blade of a slotted screwdriver, wherein the maximum diameter of the blade is greater than the calibre of the projectile, is inserted into the die for creating the intermediate of the projectile and the blank is cold-formed to form a central press recess.

5. The method according to claim 4, wherein the press head is formed according to a blade of an SL-type, a PH-type, or a PZ-type slotted screwdriver.

6. The method according to claim 4, wherein the blank is made of copper.

7. The method according to claim 4, wherein the press head consists of a hardened material with a hardness greater than 55 HV 5.

8. The projectile according to claim 1, wherein adjacent lateral edges of the wall sections lie opposite one another with a gap of less than 1 mm.

9. The projectile according to claim 1, wherein adjacent lateral edges of the wall sections at least partially make contact with each other in the circumferential direction.

10. The projectile according to claim 1, wherein the opening centred at a tip of the ogive section has a maximum diameter of less than 10% of the calibre of the projectile defined by the base end section.

11. The projectile according to claim 1, wherein the opening centred at a tip of the ogive section has a maximum diameter of less than 5% of the calibre of the projectile defined by the base end section.

12. The projectile according to claim 1, wherein adjacent lateral edges of the wall sections lie opposite one another with a gap of less than 2 mm.

13. A projectile, consisting of a ductile material, wherein the projectile has a structure dimensioned and shaped in such a way that, after being fired into a gelatinous mass the projectile hits into and is caught, being stuck in it is deformed in such a way that at least two prongs radially bent outwards and bent back in the projectile longitudinal direction from a cylindrical, solid base end section are formed, wherein two other identically or similarly shaped teeth protruding from the base end section are formed between the at least two bent-back prongs, wherein the radial extension of the at least two teeth is less than that of the at least two prongs, wherein the base end section has a deformation-side central recess, from which the at least two prongs and the at least two teeth are radially bent outwards.

14. The projectile according to claim 13, in which the at least two prongs and/or the at least two teeth have a central reinforcement, which extend in the longitudinal direction of the respective prong and/or the respective tooth from the central recess, which reinforcement is realized by means of a material accumulation, and/or in which a radial constriction is formed between a prong and the adjacent tooth, which separates the adjacent tooth and prong.

* * * * *